US006505028B1

(12) United States Patent
Yoda et al.

(10) Patent No.: US 6,505,028 B1
(45) Date of Patent: Jan. 7, 2003

(54) IMAGE FORMING APPARATUS AND FIXING DEVICE FOR USE WITH THE SAME

(75) Inventors: Kaneo Yoda, Nagano (JP); Takao Kagami, Nagano (JP); Kazutoshi Fujisawa, Nagano (JP); Hiroshi Tanaka, Nagano (JP); Kenjiro Yoshioka, Nagano (JP); Naoyuki Okumura, Nagano (JP); Shuhei Mori, Nagano (JP); Yoshiyuki Takeda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/517,414

(22) Filed: Mar. 2, 2000

(30) Foreign Application Priority Data

| | | |
|---|---|---|
| Mar. 3, 1999 | (JP) | 11-056215 |
| Mar. 3, 1999 | (JP) | 11-056216 |
| Jun. 30, 1999 | (JP) | 11-185083 |
| Jul. 8, 1999 | (JP) | 11-194761 |
| Jul. 8, 1999 | (JP) | 11-194762 |
| Jul. 8, 1999 | (JP) | 11-194763 |
| Sep. 1, 1999 | (JP) | 11-247030 |
| Sep. 1, 1999 | (JP) | 11-247031 |
| Sep. 1, 1999 | (JP) | 11-247033 |
| Sep. 1, 1999 | (JP) | 11-247034 |
| Sep. 1, 1999 | (JP) | 11-247036 |
| Sep. 1, 1999 | (JP) | 11-247037 |

(51) Int. Cl.[7] ..... G03G 15/20

(52) U.S. Cl. ..... 399/329; 399/328; 399/122; 399/330; 399/331

(58) Field of Search ..... 219/216; 399/107, 399/122, 322, 328, 329, 330, 331, 332, 333

(56) References Cited

U.S. PATENT DOCUMENTS

| | | | | |
|---|---|---|---|---|
| 4,563,073 A | | 1/1986 | Reynolds | |
| 5,267,004 A | | 11/1993 | Mills | |
| 5,450,183 A | | 9/1995 | O'Leary | |
| 5,546,173 A | * | 8/1996 | Hinotani et al. | 399/328 |
| 5,666,623 A | | 9/1997 | Yamada et al. | 399/320 |

FOREIGN PATENT DOCUMENTS

| | | | |
|---|---|---|---|
| EP | 0375369 | 6/1990 | D03D/15/12 |
| GB | 2234939 | 2/1991 | G03G/15/20 |
| JP | 6-348156 | 12/1994 | |
| JP | 9-204111 | 8/1997 | |
| JP | 10-3227 | 1/1998 | |

OTHER PUBLICATIONS

Patent Abstracts of Japan 10171291 A Jun. 26, 1998.
European Search Report.

* cited by examiner

*Primary Examiner*—Hoang Ngo
(74) *Attorney, Agent, or Firm*—Sughrue Mion, PLLC

(57) ABSTRACT

A fixing device includes a pressure application roller 120 pressed against a fixing belt 110 (or fixing roller) to be heated. One of the them is driven while the other follows the one in rotation. A recording medium S having a toner image thereon is moved to pass through a central part N1 of a press contact portion N, whereby the toner image is fused and fixed on the recording medium. High grip portions G are provided on both side ends of the fixing belt or the pressure application roller.

36 Claims, 53 Drawing Sheets

G
1123b
1123

G
110
1123b
1133

G
1123
1153

G
1153
1123

110
G
G41
1133
b
1143a
1143b
C1

1133
1123a
1123
D1
t1
1143
1143a
1143b
G41
G
1123b
1163
t2
D2

IMAGE FORMING APPARATUS AND FIXING DEVICE FOR USE WITH THE SAME

BACKGROUND OF THE INVENTION

The present invention relates to an image forming apparatus, such as a printer, a facsimile machine or a copy machine, which is capable of forming a toner image on a recording medium, such as a paper sheet, by the electrophotography technique. More particularly, the invention relates to a fixing device for use with the image forming apparatus.

Generally, the image forming apparatus for forming a toner image on a recording medium by the electrophotography technique includes a photosensitive member to be driven to rotate, an exposure mechanism for forming an electrostatic latent image on the surface of the photosensitive member, a developing mechanism for developing the latent image into a toner image, a transfer mechanism for transferring the toner image onto a recording medium, and a fixing device for fusing and fixing the toner image on the recording medium in a manner that the recording medium having the toner image transferred thereto by the transfer mechanism is moved to pass therethrough.

The fixing device, usually, includes a first rotary member to be heated and a second rotary member pressed against the first rotary member. A recording medium having a toner image thereon is moved to pass through a press nip between the first and second rotary members. When passing through the press nip, the recording medium is compressed by those rotary members and heated, whereby the toner image is fused and permanently fixed onto the recording medium.

In the fixing device thus constructed, if a peripheral speed difference is present between the two rotary members, a toner image on the recording medium passing through the press nip (press contact portion) between the rotary members is blurred and the image is disturbed or disarranged. For this reason, the prior technique does not employ such a drive method as to drive and rotate both the rotary members, and instead, employs such a drive method that one of the rotary members is driven to rotate, while the other is rotated as a follower.

In a case where the rotary member to be heated consists of a roller, a long time is consumed for the initial heating of the roller. In connection with this, there is known a belt fixing device in which an endless belt is used for the rotary member to be heated, whereby the initial heating time is reduced.

FIG. 32 is a diagram showing an example of the belt fixing device (JP-A-9-138600).

The belt fixing device includes an endless heat-resistant belt endless heat-resistant belt 6, rollers 7*a* and 7*b* for supporting the belt 6 on the inner side thereof, a roller 8 for heating the belt endless heat-resistant belt 6, and an pressure application roller 9 in contact with the outer peripheral surface of the belt endless heat-resistant belt 6. The pressure application roller 9 is driven by a motor M to rotate in the direction of an arrow "a", while the belt 6 follows the pressure application roller 9 in rotation.

A recording medium having a toner image formed thereon is moved in the direction of an arrow "b" to pass through a press contact portion N between the belt 6 and the pressure application roller 9. When passing the press contact portion N, the toner image is heated and fused, and permanently fixed on the recording medium.

FIG. 58 is a diagram showing another example of the belt fixing device (JP-A-8-334997).

In the belt fixing device, a fixing belt 1 extends around a fixing roller 2 driven to rotate and a heating roller 3 containg a heater. An pressure application roller 4 is pressed against the fixing roller 2 with the fixing belt 1 being interposed therebetween. A recording medium S having a toner image T formed thereon is moved in the direction of an arrow to pass through a pressure contact portion N therebetween, whereby the toner image T is fused and permanently affixed onto the recording medium S.

The heating roller 3 includes guide rings 3*a* as restricting portions which come in contact with the side ends 1*b* of the fixing belt 1 to restrict such a behavior of the fixing belt 1 as to move aside.

To prevent such a phenomenon that toner is transferred from the recording medium onto the surface of the fixing belt 1 (called offset phenomenon), the fixing device includes an oil coating roller 5 for coating the surface of the fixing belt 1 with release oil, such as silicone oil, as release agent.

The conventional belt fixing device shown in FIG. 57 has the following problem. When a recording medium S that relatively easily slips, for example, a synthetic resin sheet, is supplied to the press contact portion N between the pressure application roller 9 to be driven to rotate and the belt 6 which follows the pressure application roller in rotation, a slip will occur between the pressure application roller 9 of the drive side and the recording medium and/or the recording medium and the belt 6 of the follower side because of the presence of the easily slidable recording medium. As a result, a peripheral speed of the belt 6 is different from that of the pressure application roller 9. Further, a stable operation of the fixing device will be lost.

The conventional belt fixing device shown in FIG. 58 has the following problem. When a recording medium S that relatively easily slips is supplied to the press contact portion N between the belt 1 to be driven and the pressure application roller 4 which follows the belt in rotation, and as a result, a slip will occur between the belt 1 of the drive side and the recording medium an/or the recording medium and the pressure application roller 4 of the follower side because of the presence of the easily slidable recording medium. As a result, a peripheral speed of the belt 1 is different from that of the pressure application roller 4. Further, a stable operation of the fixing device will be lost.

Particularly in the belt fixing device shown in FIG. 58, the surface of the belt 1 is coated with release oil. Because of the coating of the release oil, the above slip is more likely to occur. The release oil that has been applied to the surface of the belt 1 gradually moves to the ends N' of the press contact portion N to reduce a friction force acting between the a fixing roller 2 and the pressure application roller 4 at the ends N'. Further the release oil that will move the ends N' of the press contact portion N also moves to between the belt 1 and the fixing roller 2, to thereby reduce a friction force between the belt 1 and the fixing roller 2. As a result, there is a fear that the fixing operation of the fixing device will be more instable.

SUMMARY OF THE INVENTION

Accordingly, an object of the present invention is to solve the above-mentioned problems of the conventional fixing devices for use with an image forming apparatus and to provide a fixing device which stably operates.

According to the present invention, there is provided a first image forming apparatus having a fixing device constructed such that the fixing device includes an endless belt to be heated and a rotary member to be in pressing contact with the endless belt, wherein one of the endless belt and the rotary member is driven to rotate while the other rotates in a follower fashion, and a recording medium having a toner image formed thereon is moved to pass through a part of a press contact portion in the fixing device, whereby the toner image is fused and fixed on the recording medium, wherein a high grip portion is provided at a portion of the endless belt which is not pressed by the recording medium but pressed by the rotary member.

The present invention provides a second image forming apparatus having a fixing device constructed such that the fixing device includes an endless belt to be heated and a rotary member to be in pressing contact with the endless belt, wherein one of the endless belt and the rotary member is driven to rotate while the other rotates in a follower fashion, and a recording medium having a toner image formed thereon is moved to pass through a part of a press contact portion in the fixing device, whereby the toner image is fused and fixed on the recording medium, wherein a high grip portion is provided at a portion of the rotary member which is not pressed by the recording medium but pressed by the endless belt.

The invention provides a third image forming apparatus having a fixing device constructed such that the fixing device includes an endless belt to be heated, a rotary member which is in pressing contact with the endless belt and longer than the width of the endless belt, and a backup roller, longer than the width of the endless belt, for supporting the endless belt on the inner side thereof at a press nip between the endless belt and the rotary member, wherein one of the endless belt and the rotary member is driven to rotate while the other rotates in a follower fashion, and a recording medium having a toner image formed thereon is moved to pass through a press contact portion in the fixing device, whereby the toner image is fused and fixed on the recording medium, wherein a high grip portion is provided at a portion of the rotary member which is not pressed by the recording medium but pressed by the backup roller.

The invention provides a fourth image forming apparatus which corresponds to the third image forming apparatus specified such that a high grip portion, which will act on the backup roller, is provided on the rear side of a portion of the endless belt which is not pressed by the recording medium.

The invention provides a fifth image forming apparatus having a fixing device constructed such that the fixing device includes an endless belt to be heated, a rotary member which is in pressing contact with the endless belt and longer than the width of the endless belt, and a backup roller, longer than the width of the endless belt, for supporting the endless belt on the inner side thereof at a press nip between the endless belt and the rotary member, wherein one of the endless belt and the rotary member is driven to rotate while the other rotates in a follower fashion, and a recording medium having a toner image formed thereon is moved to pass through a press contact portion in the fixing device, whereby the toner image is fused and fixed on the recording medium, wherein a high grip portion is provided at a portion of the backup roller which is pressed by the rotary member.

The invention provides a sixth image forming apparatus which corresponds to the fifth image forming apparatus specified such that a high grip portion, which will act on the backup roller, is provided on the rear side of a portion of the endless belt which is not pressed by the recording medium.

The invention provides a seventh image forming apparatus having a fixing device constructed such that the fixing device includes an endless belt to be heated, a rotary member which is in pressing contact with the endless belt and longer than the width of the endless belt, and a backup roller, longer than the width of the endless belt, for supporting the endless belt on the inner side thereof at a press nip between the endless belt and the rotary member, wherein one of the endless belt and the rotary member is driven to rotate while the other rotates in a follower fashion, and a recording medium having a toner image formed thereon is moved to pass through a press contact portion in the fixing device, whereby the toner image is fused and fixed on the recording medium, wherein an oil coating mechanism is provided which applies release oil onto the surface of the endless belt, and an oil barrier is provided on the backup roller at a portion thereof between a contact portion of the backup roller where it is brought into contact with the endless belt and a portion of the backup roller where it is not brought into contact with the endless belt but is pressed by the rotary member.

The invention provides an eighth image forming apparatus which corresponds to the seventh image forming apparatus specified such that an oil barrier is further provided on the rotary member at a portion thereof between a contact portion of the rotary member where it is brought into contact with the endless belt and a portion of the rotary member where it is not brought into contact with the endless belt but is pressed by the backup roller.

The invention provides a ninth image forming apparatus which corresponds to the seventh image forming apparatus specified such that an oil barrier is provided at a portion of the backup roller which faces the side end of the endless belt.

The invention provides a 10th image forming apparatus which corresponds to the seventh image forming apparatus specified such that a high grip portion is provided at a portion of the rotary member which is not brought into contact with the endless belt but pressed by the backup roller.

The invention provides a 11th image forming apparatus which corresponds to the seventh image forming apparatus specified such that a high grip portion is provided at a portion of the backup roller which is not brought into contact with the endless belt but pressed by the rotary member.

The invention provides a 12th image forming apparatus having a fixing device constructed such that the fixing device includes a first rotary member to be heated and a second rotary member to be in pressing contact with the first rotary member, wherein one of the first and second rotary members is driven to rotate while the other rotates in a follower fashion, and a recording medium having a toner image formed thereon is moved to pass through a part of a press contact portion in the fixing device, whereby the toner image is fused and fixed on the recording medium, wherein a high grip portion is provided at a portion of one of the first and second rotary members which is not pressed by the recording medium but pressed by the other rotary members.

The invention provides a 13th image forming apparatus having a fixing device constructed such that the fixing device includes a first rotary member to be heated and a second rotary member to be in pressing contact with the first rotary member, wherein one of the first and second rotary members is driven to rotate while the other rotates in a follower fashion, and a recording medium having a toner image formed thereon is moved to pass through a part of a press contact portion in the fixing device, whereby the toner image is fused and fixed on the recording medium, wherein an oil coating mechanism for applying release oil onto a contact portion of at least one of the first and second rotary members where the one rotary member is brought into contact with the recording medium, is provided, and an oil barrier is provided at least between a contact portion of the rotary member to be coated with the release oil by the oil coating means and a portion of the rotary member where the rotary member is not in contact with the recording medium but is pressed by the other rotary member.

The invention provides a 14th image forming apparatus which corresponds to the 13th image forming apparatus specified such that an oil barrier is also provided between a contact portion of the other rotary member where the rotary member is brought into contact with the recording medium and a portion of the other rotary member where the other rotary member is not brought into contact with the recording medium but pressed by the one rotary member.

The invention provides a 15th image forming apparatus which corresponds to the 13th image forming apparatus specified such that a high grip portion is provided at a portion of one of the first and second rotary members which is not pressed by the recording medium but pressed by the other rotary member.

The invention provides a 16th image forming apparatus which corresponds to any of the first to 15th image forming apparatus, which is specified such that the image forming apparatus is capable of forming toner images on both sides of the recording medium.

The invention provides a 17th image forming apparatus which corresponds to any of the first to 15th image forming apparatus, which is specified such that the image forming apparatus is capable of forming a full color image by superimposing a plurality of different colors.

The invention provides a first belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein the fixing belt is formed with a belt base as a mesh-like member of which the meshes each have a length shorter than a length of the press contact portion as measured in the circumferential direction, and a surface belt layer made of high release material, which is applied to at least the surface side of a central portion of the fixing base when viewed in the widthwise direction of the fixing base, wherein the fixing base includes exposing portions which are located on both sides of the fixing belt base.

The invention provides a second belt fixing device which corresponds to the first belt fixing device specified such that an oil coating mechanism for coating the surface of the fixing belt with release oil is provided, and of the threads forming the mesh-like member, those threads extending in the widthwise direction of the fixing belt are each formed with an aggregation of a plural number of very fine threads.

The invention provides a third belt fixing device which corresponds to the second belt fixing device specified such that the high release material has preferably a permeability to the release oil.

The invention provides a fourth belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein a tape-like, high grip member is wound around each side end of the fixing belt and fastened thereto.

The invention provides a fifth belt fixing device which corresponds to the fourth belt fixing device specified such that a winding start end at which the winding of the tape-like, high grip member starts is not lapped on a winding terminating end at which the winding of the tape-like, high grip member terminates.

The invention provides a sixth belt fixing device which corresponds to the fourth belt fixing device specified such that the winding start end of the high grip member is confronted with the winding terminating end in a state that a gap slanted to the axial direction of the pressure application roller is interposed therebetween.

The invention provides a seventh belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively provided around both side ends of the fixing belt, and each the high grip member is formed with an expandable endless belt having an inside diameter smaller than an outside diameter of each the side end of the fixing belt when the endless belt is in a free state.

The invention provides an eighth belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members made of cloth are respectively provided around both side ends of the fixing belt.

The invention provides a ninth belt fixing device which includes a fixing belt which is to be heated and formed with an endless belt base and a surface belt layer layered over the belt base, and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively provided around both side ends of the fixing belt, and an outside diameter of each the high grip member is larger than that of the surface belt layer.

The invention provides a 10th belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively provided around both side ends of the fixing belt, and each side edge of a high grip member is not linear in the circumferential direction.

The invention provides an 11th belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively provided around both side ends of the fixing belt, and an uneven pattern on a surface of a high grip member is slanted with respect to the width direction.

The invention provides a 12th belt fixing device which corresponds to the 11th belt fixing device specified such that the uneven patterns on the surface of the high grip member are axially symmetry with respect to the center line as view in the width direction of the fixing belt.

The invention provides a 13th belt fixing device which includes a fixing belt to be heated, a rotary member to be in pressing contact with the fixing belt, and a restricting member which comes in contact with the side end of the fixing belt to restrict such a behavior of the fixing belt as to move aside, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively fastened around both side ends of the fixing belt, and the high grip member comes in contact with the restricting member.

The invention provides a 14th belt fixing device which corresponds to the 13th belt fixing device specified such that a rigidity of the high grip member in the belt width direction is larger than that in the belt circumferential direction.

The invention provides a 15th belt fixing device which includes a fixing belt to be heated and a rotary member to be in pressing contact with the fixing belt, wherein one of the fixing belt and the rotary member is driven to rotate while. the other rotates in a follower fashion, and a recording medium having a toner image formed thereon is moved to pass through a central part of a press contact portion in the fixing belt and the rotary member, whereby the toner image is fused and fixed on the recording medium, wherein high grip members each having a thermal expansion coefficient substantially equal to that of the fixing belt are respectively fastened around both side ends of the fixing belt.

The invention provides a 16th belt fixing device which includes a fixing belt to be heated and a rotary member to be in pressing contact with the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively fastened around both side ends of the fixing belt with a flexible adhesive layer being interposed therebetween.

The invention provides a 17th belt fixing device which includes a fixing belt to be heated, a rotary member to be in pressing contact with the fixing belt, and an oil coating mechanism for applying release oil to a surface of the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively provided around both side ends of the fixing belt, and the high grip member has an oil absorption capability.

The invention provides a belt fixing device which corresponds to the 17th belt fixing device specified such that the high grip member allows the release oil to flow in the belt circumferential direction.

The invention provides a 19th belt fixing device which includes a fixing belt to be heated, a rotary member to be in pressing contact with the fixing belt, and an oil coating mechanism for applying release oil to a surface of the fixing belt, wherein one of the fixing belt and the rotary member is driven to rotate while the other rotates in a follower fashion, and a recording medium having a toner image formed thereon is moved to pass through a central part of a press contact portion in the fixing belt and the rotary member, whereby the toner image is fused and fixed on the recording medium, wherein high grip members are respectively provided around both side ends of the fixing belt, and the high grip member is made of a mixture of a high friction material and a material having an oil absorption capability.

The invention provides a 20th belt fixing device which corresponds to any of the 8th to 18th belt fixing devices, which is specified such that the high grip member is an expandable endless belt having an inside diameter smaller than an outside diameter of each side end of the fixing belt when the endless belt is in a free state.

The invention provides a 21st belt fixing device which corresponds to any of the 8th to 18th belt fixing devices, which is specified such that the high grip member is a tape-like member, and wound around and fastened to both side ends of the fixing belt.

The invention provides a 22nd belt fixing device which corresponds to the 21st belt fixing device specified such that a winding start end of the tape-like, high grip member is not lapped on a winding terminating end thereof.

The invention provides a 23rd belt fixing device which corresponds to the 21st belt fixing device specified such that the winding start end of the high grip member is confronted with the winding terminating end in a state that a gap slanted to the axial direction of the pressure application roller is interposed therebetween.

The invention provides a 24th belt fixing device which corresponds to the ninth to 18th belt fixing devices, which is specified such that the high grip member is cloth.

The invention provides a 25th belt fixing device which corresponds to any of the 4th to ninth, and 11th to 19th belt fixing devices, which is specified such that each side edge of the high grip member is not linear in the circumferential direction.

The invention provides a 26th belt fixing device which corresponds to any of the 4th to 8th, and 10th to 19th belt fixing devices, which is specified such that the fixing belt is formed with an endless belt base and a surface belt layer formed on a central portion of a surface of the belt base layer, and an outside diameter of the high grip member is larger than an outside diameter of the surface belt layer.

The invention provides a 27th belt fixing device which corresponds to any of the 4th to 19th belt fixing devices, which is specified such that the side ends of the high grip member are beveled.

The invention provides a 28th belt fixing device which corresponds to the 27th belt fixing device specified such that the beveled face is smoothed.

The invention provides a 29th belt fixing device which corresponds to any of the 4th to 14th, 17th and 18th belt fixing devices, which is specified such that the high grip member is made of a material having a thermal expansion coefficient substantially equal to that of the fixing belt.

The invention provides a 30th belt fixing device which corresponds to any of the 4th to 14th, 17th and 18th belt fixing devices, which is specified such that the high grip member is fastened with a flexible adhesive layer being interposed therebetween.

The invention provides a 31st belt fixing device which corresponds to any of the 21st to 16th belt fixing devices, which is specified such that an oil coating mechanism for coating the surface of the fixing belt with release oil is provided, and the high grip member has an oil absorbing capability.

The invention provides a 32nd belt fixing device which corresponds to the 31st belt fixing device specified such that the high grip member allows the release oil to flow in the belt circumferential direction.

The invention provides a 33rd belt fixing device which corresponds to the 31st belt fixing device specified such that the release oil applied by the oil coating mechanism is applied to only a press contact portion on the fixing belt with the recording medium.

The invention provides a 34th belt fixing device which corresponds to any of the 4th to 16th belt fixing devices, which is specified such that an oil coating mechanism for coating the surface of the fixing belt with release oil is provided, the high grip member is permeable to the release oil, and is fastened to each of both the side ends of the fixing belt with an adhesive layer capable of absorbing the oil.

The invention provides a belt fixing device which corresponds to the 34th belt fixing device specified such that the release oil applied by the oil coating mechanism is applied to only a press contact portion on the fixing belt with the recording medium.

The invention provides a 18th image forming apparatus which corresponds to the 1st to 10th, and 13th to 15th image forming apparatus, and the second belt fixing device, which are specified such that second belt fixing device specified such that the release oil applied by the oil coating mechanism is applied to only a press contact portion on the fixing belt with the recording medium.

The invention provides a 36th belt fixing device which corresponds to any of the 17th to 19th belt fixing devices, which is specified such that the release oil applied by the oil coating mechanism is applied to only a press contact portion on the fixing belt with the recording medium.

The invention provides a 37th belt fixing device which corresponds to any of the first to 19th belt fixing devices, which is specified such that toner images may be fixed on both sides of the recording medium.

The invention provides a 38th belt fixing device which corresponds to any of the first to 19th belt fixing devices, which is specified such that a full color images formed by superimposing a plurality of different colors may be formed on the recording medium.

Operations and Effects

In the first image forming apparatus, a recording medium having a toner image formed thereon is moved to pass through a part of a press contact portion in the fixing device, whereby the toner image is fused and fixed on the recording medium. The fixing device includes an endless belt to be heated and a rotary member to be in pressing contact with the endless belt, wherein one of the endless belt and the rotary member is driven while the other rotates in a follower fashion.

In the belt fixing device, a high grip portion is provided at a portion of the endless belt which is not pressed by the recording medium but pressed by the rotary member. Therefore, when a recording medium, which relatively easily slips, is supplied to the part of the press contact portion between the endless belt and the rotary member, and as a result, when a slip will occur between the endless belt (or the rotary member) of the drive side and the recording medium and/or the recording medium and the rotary member (or the endless belt) of the follower side, the endless belt and the rotary member rotate at substantially equal peripheral speeds since the follower action of the endless belt (or the rotary member) of the follower side for the rotary member (or the endless belt) of the drive side is enhanced through the action of the high grip portion. Therefore, the slip is prevented (at least its occurrence is extremely infrequent). As a result, the fixing operation of the fixing device is stable. Accordingly, the toner image on the recording medium is little blurred, so that the resultant image is little disarranged.

In the second image forming apparatus, a recording medium having a toner image formed thereon is moved to pass through a part of a press contact portion in the fixing device, whereby the toner image is fused and fixed on the recording medium. The fixing device includes an endless belt to be heated and a rotary member to be in pressing contact with the endless belt, wherein one of the endless belt and the rotary member is driven while the other rotates in a follower fashion.

In the second image forming apparatus, a high grip portion is provided at a portion of the endless belt which is not pressed by the recording medium but pressed by the endless belt. Therefore, when a recording medium, which relatively easily slips, is supplied to the part of the press contact portion between the endless belt and the rotary member, and as a result, when a slip will occur between the endless belt (or the rotary member) of the drive side and the recording medium and/or the recording medium and the rotary member (or the endless belt) of the follower side, the endless belt and the rotary member rotate at substantially equal peripheral speeds since the follower action of the endless belt (or the rotary member) of the follower side for the rotary member (or the endless belt) of the drive side is enhanced through the action of the high grip portion. Therefore, the slip is prevented (at least its occurrence is extremely less frequent). As a result, the fixing operation of the fixing device is stable. Accordingly, the toner image on the recording medium is little blurred, so that the resultant image is little disarranged.

In third image forming apparatus, a recording medium having a toner image formed thereon is moved to pass through a press contact portion in the fixing device, whereby the toner image is fused and fixed on the recording medium. The fixing device includes an endless belt to be heated, a rotary member which is in pressing contact with the endless belt and longer than the width of the endless belt, and a backup roller, longer than the width of the endless belt, for supporting the endless belt on the inner side thereof at a press nip between the endless belt and the rotary member, wherein one of the endless belt and the rotary member is driven to rotate while the other rotates in a follower fashion.

In the belt fixing device, a high grip portion is provided at a portion of the rotary member which is not pressed by the recording medium but pressed by the backup roller. Therefore, when a recording medium, which relatively easily slips, is supplied to the press contact portion between the endless belt and the rotary member, and as a result, when a slip will occur between the endless belt (or the rotary member) of the drive side and the recording medium and/or the recording medium and the rotary member (or the endless belt) of the follower side, the endless belt and the rotary member rotate at substantially equal peripheral speeds since the follower action of the endless belt (or the rotary member) of the follower side for the rotary member (or the endless belt) of the drive side is enhanced through the action of the high grip portion.

This will be described in detail hereunder.

When the endless belt is driven, its drive force is transmitted to the rotary member which is pressed against the endless belt, and also is transmitted to the backup roller which follows the endless belt in rotation. Thus, the drive force from the endless belt is transmitted to the rotary member by way of two routes.

When the rotary member is driven, its drive force is transmitted to the endless belt pressed against the rotary member, and is also transmitted to the backup roller through the high grip portion. Also in this case, the drive force derived from the rotary member is transmitted tot he endless belt by way of two routes.

Accordingly, in a case where the rotary member is driven and also in a case where the endless belt is driven, the follower action of the rotary member (or the endless belt) of the follower side for the endless belt (or the rotary member) of the drive side is enhanced through the action of the high grip portion. Therefore, even when the recording medium, which relatively easily slips, is fed to the press contact portion, the endless belt and the rotary member rotate at substantially equal peripheral speeds.

The slip is prevented (at least its occurrence is extremely infrequent). As a result, the fixing operation of the fixing device is stable. Accordingly, the toner image on the recording medium is little blurred, so that the resultant image is little disarranged.

The fourth image forming apparatus corresponds to the third image forming apparatus specified such that a high grip portion, which will act on the backup roller, is provided on the rear side of a portion of the endless belt which is not pressed by the recording medium.

With the operation of the high grip portion, the follower action of the endless belt (or the rotary member) of the follower side for the rotary member (or the endless belt) of the drive side is further enhanced. As a result, the fixing device operates more stably. Accordingly, a chance of the blurring of the toner image on the recording medium is more lessened, and as a result, the resultant image is further improved in its quality.

In the fifth image forming apparatus, a recording medium having a toner image formed thereon is moved to pass through the press contact portion in the fixing device, whereby the toner image is fused and fixed on the recording medium. The fixing device includes an endless belt to be heated, a rotary member which is in pressing contact with the endless belt and longer than the width of the endless belt, and a backup roller, longer than the width of the endless belt, for supporting the endless belt on the inner side thereof at a press nip between the endless belt and the rotary member, wherein one of the endless belt and the rotary member is driven to rotate while the other rotates in a follower fashion.

In the belt fixing device, a high grip portion is provided at a portion of the backup roller which is pressed by the rotary member. Therefore, when a recording medium, which relatively easily slips, is supplied to the press contact portion between the endless belt and the rotary member, and as a result, when a slip will occur between the endless belt (or the rotary member) of the drive side and the recording medium and/or the recording medium and the rotary member (or the endless belt) of the follower side, the endless belt and the rotary member rotate at substantially equal peripheral speeds since the follower action of the endless belt (or the rotary member) of the follower side for the rotary member (or the endless belt) of the drive side is enhanced through the action of the high grip portion.

This will be described again detail hereunder for ease of understanding, while it was discussed in the operation description of the third image forming apparatus.

When the endless belt is driven, its drive force is transmitted to the rotary member which is pressed against the endless belt, and also is transmitted to the backup roller which follows the endless belt in rotation. When the rotary member is driven, its drive force is transmitted to the endless belt pressed against the rotary member, and is also transmitted to the backup roller through the high grip portion. Accordingly, in a case where the rotary member is driven and also in a case where the endless belt is driven, the follower action of the rotary member (or the endless belt) of the follower side for the endless belt (or the rotary member) of the drive side is enhanced through the action of the high grip portion. Therefore, even when the recording medium, which relatively easily slips, is fed to the press contact portion, the endless belt and the rotary member rotate at substantially equal peripheral speeds.

The slip is prevented (at least its occurrence is extremely infrequent). As a result, the fixing operation of the fixing device is stable. Accordingly, the toner image on the recording medium is little blurred, so that the resultant image is little disarranged.

The sixth image forming apparatus corresponds to the fifth image forming apparatus specified such that a high grip portion, which will act on the backup roller, is provided on the rear side of a portion of the endless belt which is not pressed by the recording medium.

Accordingly, the follower action of the rotary member (or the endless belt) of the follower side for the endless belt (or the rotary member) of the drive side is enhanced through the action of the high grip portion in the fifth image forming apparatus. Therefore, the slip is prevented (at least its occurrence is extremely infrequent). As a result, the fixing operation of the fixing device is stable. Accordingly, the toner image on the recording medium is little blurred, so that the resultant image is little disarranged.

In the seventh image forming apparatus, a recording medium having a toner image formed thereon is moved to pass through a press contact portion in the fixing device, whereby the toner image is fused and fixed on the recording medium. The fixing device includes an endless belt to be heated, a rotary member which is in pressing contact with the endless belt and longer than the width of the endless belt, and a backup roller, longer than the width of the endless belt, for supporting the endless belt on the inner side thereof at a press nip between the endless belt and the rotary member, wherein one of the endless belt and the rotary member is driven to rotate while the other rotates in a follower fashion. In the belt fixing device, an offset phenomenon is unlike to to occur since an oil coating mechanism for applying release oil onto the surface of the endless belt.

Further, an oil barrier is provided on the backup roller at a portion thereof between a contact portion (corresponding to each end N' of a press contact portion N described in connection with FIG. 58) of the backup roller where it is brought into contact with the endless belt and a portion of the backup roller where it is not brought into contact with the endless belt but is pressed by the rotary member. Therefore, when the release oil having been applied to the surface of the endless belt will flow into the "portion of the backup roller where it is not brought into contact with the endless belt but is pressed by the rotary member", its flow is blocked by the oil barrier (at least little flow is allowed.).

For this reason, a gripping force is sufficiently secured between the backup roller and the rotary member at the "portion of the backup roller where it is not brought into contact with the endless belt but is pressed by the rotary member", so that the endless belt and the rotary member turn at substantially the equal peripheral speeds (The reason why the endless belt and the rotary member turn at substantially the equal peripheral speeds when a gripping force is sufficiently secured between the backup roller and the rotary member as stated in the operation description of the third image forming apparatus.).

In the seventh image forming apparatus, when a slip will occur between the rotary member of the drive side (or the endless belt) and the recording medium and/or the recording medium and the endless belt of the follower side (or the rotary member), the slip is prevented (at least its occurrence is extremely infrequent.) although such a construction is employed that the release oil is applied to the endless belt, and as a result, a stable fixing operation of the fixing device is performed. Accordingly, the toner on the recording medium is little blurred, and hence the resultant image is little disarranged.

The eighth image forming apparatus corresponds to the seventh image forming apparatus specified such that an oil barrier is further provided on the rotary member at a portion thereof between a contact portion of the rotary member where it is brought into contact with the endless belt and a portion of the rotary member where it is not brought into contact with the endless belt but is pressed by the backup roller. Therefore, when the release oil having been applied to the endless belt and transferred to the contact portion of the rotary member where it is brought into contact with the endless belt will flow into the "portion of the rotary member where it is not brought into contact with the endless belt but is pressed by the backup roller", its flow is blocked by the oil barrier (at least little flow of it is allowed.).

Accordingly, a gripping force is more satisfactorily secured between the rotary member and the backup roller in the "portion of the rotary member where it is not brought into contact with the endless belt but is pressed by the backup roller". As a result, a stable fixing operation of the fixing device is performed. Accordingly, the toner on the recording medium is little blurred, and hence the resultant image is little disarranged.

The ninth image forming apparatus corresponds to the seventh image forming apparatus specified such that an oil barrier is provided at a portion of the backup roller which faces the side end of the endless belt. Therefore, when the release oil having been applied to the surface of the endless belt will flow into between the endless belt and the backup roller, its flow is blocked by the oil barrier at the portion of the backup roller which faces the side end of the endless belt (at least little flow of it is allowed.).

Accordingly, a necessary friction force between the endless belt and the backup roller is secured, and the follower action of the endless belt and the rotary member is also enhanced. And the endless belt and the rotary member turn at substantially equal periphery speeds. (The reason why the endless belt and the backup roller turn at substantially the equal peripheral speeds when a gripping force is sufficiently secured between endless belt and the backup roller is as stated in the operation description of the third and fourth embodiments.).

Thus, in the ninth image forming apparatus, a more stable fixing operation of the fixing device is performed although the endless belt is coated with the release oil.

The 10th image forming apparatus corresponds to the seventh image forming apparatus specified such that a high grip portion is provided at a portion of the rotary member which is not brought into contact with the endless belt but pressed by the backup roller. With provision of the high grip portion, the follower action of the rotary member and the backup roller is further improved, and hence the follower action of the endless belt and the rotary member is also so done. This leads to a more stable fixing operation of the fixing device.

The 11th image forming apparatus corresponds to the seventh image forming apparatus specified such that a high grip portion is provided at a portion of the backup roller which is not brought into contact with the endless belt but pressed by the rotary member. Therefore, the follower action of the rotary member and the backup roller is further improved, and hence the follower action of the endless belt and the rotary member is also so done. This leads to a more stable fixing operation of the fixing device.

In the 12th image forming apparatus, a recording medium having a toner image formed thereon is moved to pass through a part of a press contact portion in the fixing device, whereby the toner image is fused and fixed on the recording medium. The fixing device includes a first rotary member to be heated and a second rotary member to be in pressing contact with the first rotary member, wherein one of the first and second rotary members is driven to rotate while the other rotates in a follower fashion.

In the belt fixing device, a high grip portion is provided at a portion of one of the first and second rotary members which is not pressed by the recording medium but pressed by the other rotary members. Therefore, when a recording medium, which relatively easily slips, is supplied to the part of the press contact portion between the two rotary members, and as a result, when a slip will occur between the heating roller as the rotary member of the drive side and the recording medium and/or the recording medium and the rotary member of the follower side, both the rotary members rotate at substantially equal peripheral speeds since the follower action of the rotary member of the follower side for the rotary member of the drive side is enhanced through the operation of the high grip portion. The slip is prevented (at least its occurrence is extremely infrequent). As a result, the fixing operation of the fixing device is stable. Accordingly, the toner image on the recording medium is little blurred, so that the resultant image is little disarranged.

In the 13th image forming apparatus, a recording medium having a toner image formed thereon is moved to pass through a part of a press contact portion in the fixing device, whereby the toner image is fused and fixed on the recording medium. The fixing device includes a first rotary member to be heated and a second rotary member to be in pressing contact with the first rotary member, wherein one of the first and second rotary members is driven to rotate while the other rotates in a follower fashion.

In the belt fixing device, an oil coating mechanism for applying release oil onto a contact portion of at least one of the first and second rotary members where the one rotary member is brought into contact with the recording medium, is provided. Therefore, an offset phenomenon is unlikely to occur.

Further, an oil barrier is provided at least between a contact portion of the rotary member to be coated with the release oil by the oil coating means and a portion of the rotary member where the rotary member is not in contact with the recording medium but is pressed by the other rotary member. The presence of the oil barrier prevents such a situation that the release oil having been applied to the heating roller 1101 flows from its contact portion with the recording medium to the "portion of the rotary member where the rotary member is not in contact with the recording medium but is pressed by the other rotary member" (at least its occurrence is extremely infrequent.).

For this reason, a gripping force is satisfactorily secured between both the rotary members at the "portion of the rotary member where the rotary member is not in contact with the recording medium but is pressed by the other rotary member".

Accordingly, both the rotary members rotate at substantially equal peripheral speeds although such a construction is employed that the release oil is applied to the contact portion of one of the rotary members where it is brought into contact with the recording medium. Therefore, when a slip will occur between the rotary member of the drive side and the recording medium and/or the recording medium and the rotary member of the follower side, the slip is prevented (at least its occurrence is extremely infrequent). As a result, the fixing operation of the fixing device is stable. Accordingly, the toner image on the recording medium is little blurred, so that the resultant image is little disarranged.

To be more specific, in a case where no measure is taken in the construction where the release oil is applied to the contact portion of at least one of both the rotary members with the recording medium, the release oil that has been applied to the rotary member moves from its contact portion with the recording medium to the "portion of the rotary member where the rotary member is not in contact with the recording medium but is pressed by the other rotary member", and a gripping force at the portion between both the rotary members is remarkably reduced. A slip will occur between the rotary member of the drive side and the recording medium and/or the recording medium and the rotary member of the follower side. A stable fixing operation of the fixing device will be lost. On the other hand, in the 13th image forming apparatus, presence of the oil barrier prevents such a situation that the release oil that has been applied to the rotary member moves from its contact portion with the recording medium to the "portion of the rotary member where the rotary member is not in contact with the recording medium but is pressed by the other rotary member" (at least a probability of occurrence of the situation is considerably reduced.). A gripping force is satisfactorily secured at the "portion of the rotary member where the rotary member is not in contact with the recording medium but is pressed by the other rotary member". Therefore, the slip is prevented (at least its occurrence is extremely infrequent.) although such a construction is employed that the release oil is applied to the contact portion of one of the rotary members where it is brought into contact with the recording medium. As a result, a stable fixing operation of the fixing device is secured. Accordingly, the toner image on the recording medium is little blurred, so that the resultant image is little disarranged.

The 14th image forming apparatus corresponds to the 13th image forming apparatus specified such that an oil barrier is also provided between a contact portion of the other rotary member where the rotary member is brought into contact with the recording medium and a portion of the other rotary member where the other rotary member is not brought into contact with the recording medium but pressed by the one rotary member. The presence of the oil barrier prevents such a situation that the release oil, which was applied to the contact portion of the rotary member where it is brought into contact with the recording medium and moved to the contact portion of the other rotary member where it is brought into contact with the recording medium, moves to the "portion of the other rotary member where the other rotary member is not brought into contact with the recording medium but pressed by the one rotary member" (at least a probability of occurrence of such a situation is considerably reduced.).

Accordingly, a gripping force is satisfactorily secured at the "portion of the other rotary member where the other rotary member is not brought into contact with the recording medium but pressed by the one rotary member". Therefore, a stable fixing operation of the fixing device is secured. Accordingly, there is less chance that the toner image on the recording medium is blurred, so that the resultant image is little disarranged.

The 15th image forming apparatus corresponds to the 13th image forming apparatus specified such that a high grip portion is provided at a portion of one of the first and second rotary members which is not pressed by the recording medium but pressed by the other rotary member. With presence of the high grip portion, a gripping force is more satisfactorily secured at the "portion of one of the first and second rotary members which is not pressed by the recording medium but pressed by the other rotary member". As a result, a stable fixing operation of the fixing device is secured. Accordingly, there is less chance that the toner image on the recording medium is blurred, so that the resultant image is little disarranged.

The 16th image forming apparatus corresponds to any of the first to 15th image forming apparatuses, which is specified such that the image forming apparatus is capable of forming toner images on both sides of the recording medium. Therefore, there is a case that a recording medium having toner images formed on both sides thereof passes through the part of the press contact portion in the fixing device.

Sometimes the toner on the recording medium reduces the friction coefficient between the recording medium and the rotary member. And it interrupts the oil absorbing by the recording medium. Therefore, in a case where the toner images are formed on both sides of the recording medium, the recording medium is more likely to slip when comparing with a case where the toner image is formed on one side of the recording medium.

In this connection, in the 16th image forming apparatus, the oil barrier is provided between the contact portion of one of the belt and the rotary member which is not pressed by the recording medium but pressed by the other rotary member (or belt), or it is provided between the portion of the belt (or the rotary member) which is coated with the release oil by the oil coating mechanism, which the portion is brought into contact with the recording medium, and the contact portion which is not brought into contact with the recording medium but is pressed by the other rotary member (or the belt). Therefore, even when the toner images are formed on both sides of the recording medium, the slip does not occur (at least its occurrence is extremely infrequent). As a result, a stable fixing operation of the fixing device is secured.

Thus, the 16th image forming apparatus is capable of forming images suffering from no (at least little) image disarrangement on both sides of the recording medium.

The 17th image forming apparatus corresponds to any of the first to 15th image forming apparatuses, which is specified such that the image forming apparatus is capable of forming a full color image by superimposing a plurality of different colors. Therefore, there is a case that a recording medium having a full color image formed on at least one side thereof passes through the part of the press contact portion in the fixing device.

As described above, sometimes the toner on the recording medium reduces the friction coefficient between the recording medium and the rotary member, and it interrupts the oil absorbing by the recording medium. Therefore, in a case where the full color image by superimposing a plurality of different colors is formed on the recording medium, the recording medium is more likely to slip when comparing with a case where the toner image of monochromatic color is formed on the recording medium.

In this connection, in the 17th image forming apparatus, the oil barrier is provided between the contact portion of one of the belt and the rotary member which is not pressed by the recording medium but pressed by the other rotary member (or belt), or it is provided between the portion of the belt (or the rotary member) which is coated with the release oil by the oil coating mechanism, which the portion is brought into contact with the recording medium, and the contact portion which is not brought into contact with the recording medium but is pressed by the other rotary member (or the belt). Therefore, even when the full color image by superimposing a plurality of different colors is formed on the recording medium, the slip does not occur (at least its occurrence is extremely infrequent). As a result, a stable fixing operation of the fixing device is secured.

Thus, the 17th image forming apparatus is capable of forming images suffering from no (at least little) image disarrangement. When combined with the 16th image forming apparatus, it is capable of forming images suffering from no (at least little) image disarrangement on both sides of the recording medium.

In the first belt fixing device of the invention, a recording medium having a toner image formed thereon is moved to pass through a central part of a press contact portion in the fixing device, whereby the toner image is fused and fixed on the recording medium. The first belt fixing device includes a fixing belt to be heated and a rotary member to be in pressing contact with the fixing belt, wherein one of the fixing belt and the rotary member is driven to rotate while the other rotates in a follower fashion.

The fixing belt is formed with a belt base as a mesh-like member of which the meshes each have a length shorter than a length of the press contact portion as measured in the circumferential direction, and a surface belt layer made of high release material, which is applied to at least the surface side of a central portion of the fixing base when viewed in the widthwise direction of the fixing base, wherein the fixing base includes exposing portions which are located on both sides of the fixing belt base. Therefore, the surface belt layer forms a fixing surface for the toner image and the exposing portions form high grip portions, which act on the rotary member.

Accordingly, when a recording medium, which relatively easily slips, is supplied to the central part of the press contact portion between the fixing belt and the rotary member, and as a result, when a slip will occur between the fixing belt (rotary member) of the drive side and the recording medium and/or the recording medium and the rotary member (fixing belt) of the follower side, the fixing belt and the rotary member rotate at substantially equal peripheral speeds since the follower action of the rotary member (fixing belt) of the follower side for the fixing belt (rotary member) of the drive side is enhanced through the action of the high grip portions. Therefore, the slip is prevented (at least its occurrence is extremely less frequent). As a result, the fixing operation of the fixing device is stable. Accordingly, the toner image on the recording medium is little blurred, so that the resultant image is little disarranged.

Further, the high grip portion is formed by merely forming the exposing portions at both ends of the belt base itself. Therefore, the high grip portion of the belt fixing device is superior in strength to a high grip portion additionally provided on the belt base. In this respect, a reliability of the fixing device is improved. Further, the high grip portion of the belt fixing device may be manufactured more easily manufactured than a high grip portion additionally provided or formed on the belt base.

The second belt fixing device corresponds to the first belt fixing device specified such that an oil coating mechanism for coating the surface of the fixing belt with release oil is provided. Therefore, an offset phenomenon will infrequently occur.

As already stated, where the surface of the fixing belt is coated with the release oil, the oil will gradually move to the ends of the press contact portion between the fixing belt and the rotary member. In this connection, in the second fixing device, the fixing base is exposed at both ends of the press contact portion, and the belt base is made of cloth or a mesh-like member of which the threads extending in the widthwise direction are formed with threads each consisting of an aggregation of a plural number of very fine threads. The oil having reached each end of the press contact portion penetrates into the threads each consisting of an aggregation of a plural number of very fine threads of the cloth or the mesh-like member.

Accordingly, a little amount of the release oil is present on the surface of both ends of the belt base. As a result, a gripping force is satisfactorily secured at the both ends of the press contact portion. The slip is prevented (at least its occurrence is extremely infrequent.). A stable fixing operation of the fixing device is performed.

Thus, the second belt fixing device stably operates for fixing the toner image although it employs such a construction that the surface of the fixing belt is coated with the release oil.

The third belt fixing device corresponds to the second belt fixing device specified such that the high release material has preferably a permeability to the release oil. Because of this nature, the oil having being applied to the surface of the surface belt layer penetrates into the surface belt layer, and then to the threads each consisting of an aggregation of a plural number of very fine threads in the cloth or the mesh-like member, and retained in the cloth or the mesh-like member. The retained oil oozes, by its pressure, out of the cloth or the threads at the press contact portion, and further reaches the surface, or the fixing surface, of the surface belt layer to form an oil thin film on the fixing surface. As a result, the oil film is uniformized on the fixing surface, so that a quality of a toner image fixed thereon is improved.

The release oil having permeated into the ends of the belt base moves back to the central portion of the belt base through the cloth or the mesh-like member which forms the belt base. This reduces consumption of the release oil.

Accordingly, in a case where the fixing operation is not performed for a certain time, and the surplus oil will stay at a region near the press contact portion, the oil permeates into the surface belt layer, and to the threads each of an aggregation of a plural number of very fine threads in the cloth or the mesh-like member of the belt base, and is retained in the cloth or the mesh-like member. And a part of the retained release oil flows back to the central portion of the surface belt layer. Therefore, when the fixing operation is not performed for a certain time and then it is operated again, there is less chance that a first recording medium will be soiled by the surplus oil.

In the 4th belt fixing device, (i) a recording medium having a toner image formed thereon is moved to pass through a central part of a press contact portion between the fixing belt and the rotary member in a belt roller arrangement in which the fixing belt is heated and the rotary member is pressed against the fixing belt, and one of the fixing belt and the rotary member is driven to rotate while the other follows the one in rotation. As a result, the toner image is fused and permanently fixed on the recording medium.

The high grip tape is wound around each side end of the fixing belt and fastened thereto. As a result, high grip portions which act on the rotary member, are formed at both side ends of the fixing belt.

Therefore, when a recording medium, which relatively easily slips, is supplied to the central part of the press contact portion between the fixing belt and the rotary member, and as a result, when a slip will occur between the a fixing belt (rotary member) of the drive side and the recording medium and/or the recording medium and the rotary member (fixing belt) of the follower side, the fixing belt and the rotary member rotate at substantially equal peripheral speeds since the follower action of the rotary member (fixing belt) of the follower side for the fixing belt (rotary member) of the drive side is enhanced through the operation of the high grip portions. Therefore, the slip is prevented (at least its occurrence is extremely infrequent). As a result, the fixing operation of the fixing device is stable. Accordingly, the toner image on the recording medium S is little blurred, so that the resultant image is little disarranged.

(ii) Further, the high grip portions may be formed in such a simple manner that the high grip tapes are wound around both the side ends of the fixing belt and are fastened to the side ends. Therefore, the manufacturing of the fixing belt is simpler than in the case where ring-like, high grip members are fit to both side ends of the belt or where the side ends themselves of the belt are worked to be high grip portions.

In the fifth belt fixing device based on the fourth fixing device, the winding start end 11 of the high grip tape is not lapped on the winding terminating end. Therefore, the following advantageous effects are produced.

If the winding start end 11 of the high grip tape is lapped on the winding terminating end, the lapping portion 31 is thick. Therefore, a speed of the turning fixing belt when the lapping portion is pressed on the rotary member will be different from that when the lapping portion is not pressed on the rotary member.

When the lapping portion is pressed against the rotary member, stress will concentrate at a portion of the rotary member where it is in contact with the lapping portion. As a result, an endurance of the rotary member will be reduced.

In this connection, in the 5th belt fixing device, the winding start end of the high grip portion is not lapped on the winding terminating end. Because of this, the speed of the turning belt fixing belt little varies. Additionally, little stress concentrates on the specific location of the rotary member, so that the endurance of the rotary member is little reduced.

In the sixth belt fixing device based on the fifth belt fixing device, the winding start end of the high grip member is confronted with the winding terminating end in a state that a gap slanted to the axial direction of the rotary member is interposed therebetween. Therefore, the follow advantageous effects are produced.

If the winding start end and the winding terminating end of the high grip member are not slanted (with respect to, for example, the axial direction of the rotary member), a traveling speed of the fixing belt when the gap between the winding start end and the winding terminating end is in contact with the rotary member will be different from that when it is not in contact with the rotary member. On the other hand, a probability of creating the above-mentioned speed difference of the fixing belt (or the rotary member) of the follower side is small in sixth belt fixing device since the winding start end of the high grip member is confronted with the winding terminating end in a state that the gap slanted to the axial direction of the rotary member is interposed therebetween.

The seventh fixing belt has the advantageous effects (i) of the 4th fixing device, and further the following advantageous effects.

In the 7th belt fixing device, the high grip portion is formed with an expandable endless belt having an inside diameter smaller than an outside diameter of each side end of the fixing belt when it is in a free state. Therefore, by the utilization of its expandability, the belt-like high grip member is expanded and fit to the side ends of the fixing belt to form a high grip portion well fit to and around the side ends of the fixing belt.

Where the high grip tape is wound around each side end of the fixing belt, there is a fear that high grip tape is easy to peel off the belt at its seam. In the fixing belt in this fixing device, such a fear is not present and the belt-like high grip member doubles as a reinforcing member for the side end of the fixing belt. In this respect, a reliability of the fixing belt is improved. As a result, the fixing belt may be thinned in structure. The fixing belt well follows an unevenness corresponding to the amounts of attached toner forming a toner image. This results in improvement of a fixing strength or a fixing uniformity. Further, a heat capacity of the fixing belt is small, so that it may be heated quickly.

The eighth fixing belt has the advantageous effects (i) of the fourth fixing device, and further the following advantageous effects.

Since the high grip portion is formed with the cloth a surface of the high grip portion is defined by a number of vertical and horizontal fine ridges of the threads (woven or knitted) running crosswise and lengthwise. The fine ridge crossing pattern spreads substantially uniformly over the surface.

A vibration and a speed variation, which are generated at both ends of the fixing belt by a drive force transmission, are extremely reduced, thereby ensuring a smooth drive force transmission.

Since the fine ridge crossing pattern are formed by the threads, each ridge is rounded in cross section. With this configuration of the ridges, the stress concentration is lessened, and hence the endurance of the rotary member will be increased.

Further, the high grip portion of this fixing device is superior to that formed with a rubber member of an uneven surface in the strength (particularly to shearing).

Accordingly, in the case of the high grip portion made of a film or a rubber member, for example, when a shearing force is applied to its edge, the edge first cracks, and then the crack rapidly propagates and the high grip portion is finally broken. In the case of the high grip portion made of the cloth, when the fiber at the edge of the cloth cracks to be broken, the breakage of the fiber does not propagates. That is, only one fiber at the edge is broken.

When the side edge of the belt is brought into contact with the inner surface of a flange (the guide ring) of the roller on which the fixing belt is put in order to restrict a zig-zag traveling of the fixing belt, a shearing force acting on the side edge of the belt is great in magnitude. In this fixing device, the high grip portions of cloth are provided on both side ends of the fixing belt. Therefore, the high grip portion is reluctant to its breakage and propagation of the breakage to the whole fixing belt 110 is also greatly impeded.

The high grip portions may be formed by merely fastening them on both side ends of the fixing belt. Therefore, the manufacturing of the fixing belt is simpler than in the case where the side ends themselves of the belt are worked to be high grip portions.

The ninth fixing belt has the advantageous effects (i) of the 4th fixing device, and further the following advantageous effects.

The outside diameter of the high grip member is larger than that of the surface belt layer. Therefore, at both the ends of the press contact portion between the fixing belt and the rotary member, the high grip members are pressed against the rotary member by a larger pressing force. Accordingly, a gripping force is satisfactorily secured between the fixing belt and the rotary member. And the slip is prevented with certainty (at least its occurrence is extremely infrequent.). As a result, a stable fixing operation of the fixing device is secured.

The 10th fixing belt has the advantageous effects (i) of the 4th fixing device, and further the following advantageous effects.

In this fixing device, each side edge of the high grip member is not linear in the circumferential direction, and therefore the following advantageous effects are produced.

If each side edge of the high grip member is linear in the circumferential direction, positions of the rotary member, which is to be in pressing contact with the fixing belt, at which it is pressed against the side edges of the high grip member are locally worn or deformed, to thereby possibly reduce the endurance of the rotary member.

In this connection, in this fixing device, each side edge of the high grip member is not linear in the circumferential direction. Because of this configuration, the local wearing or deformation of the rotary member are lessened. This results increase of the endurance of the rotary member.

The 11th fixing belt has the advantageous effects (i) of the 4th fixing device, and further the following advantageous effects.

The uneven pattern on the surface of the high grip member is slanted with respect to the width direction. This feature produces a called edge effect (edge effect in the rotational direction (power transmission direction)) by the uneven pattern at the press contact portion of it with the rotary member. As a result, the gripping force by the high grip portion is increased, and an uneven pattern on a surface of a high grip member is slanted with respect to the width direction. The slip is prevented (at least its occurrence is extremely infrequent), and a stable fixing operation of the fixing device is secured.

If the uneven pattern on the surface of the high grip member is not slanted with respect to the width direction (it is parallel to the axial direction of the rotary member), a vibration by the drive power transmission (vibration due to the uneven pattern) may increase. However, in this fixing device, such a vibration is remarkably reduced since the uneven pattern on the surface of the high grip member is slanted with respect to the width direction. Accordingly, a smooth drive power transmission is secured.

In the 12th belt fixing device based on the 28th belt fixing device, the uneven patterns on the surface of the high grip member are axially symmetry with respect to the center line as view in the width direction of the fixing belt. Therefore, thrust forces (acting in the belt width direction) caused by the inclination of the uneven pattern are cancelled, so that the fixing belt stably runs.

The 13th fixing belt has the advantageous effects (i) of the 4th fixing device, and further the following advantageous effects.

The side edges of the fixing belt is brought into contact with the restricting members, so that such a behavior of the traveling fixing belt as to move aside is restricted.

Since the side edges of the fixing belt is brought into contact with the restricting members, the following advantageous effects are produced additionally.

The high grip members are fastened to both side ends of the fixing belt, so that the both side ends of the fixing belt are reinforced. Further, the high grip member comes into contact with the restricting member. Therefore, the endurance of the fixing belt is increased although such a construction is employed that the side end of the fixing belt comes into contact with the restricting member.

Therefore, the fixing belt may be thinned in structure. The fixing belt well follows an unevenness corresponding to the amounts of attached toner forming a toner image. This results in improvement of a fixing strength or a fixing uniformity. Further, a heat capacity of the fixing belt is small, so that it may be heated quickly.

In the 14th fixing belt based on the 13th fixing device, a rigidity of the high grip member in the belt width direction is larger than that in the belt circumferential direction. Therefore, the following advantageous effects are produced.

Since the rigidity of the high grip member in the belt circumferential direction is relatively small, when the high grip member is fastened to the side end of the fixing belt, the high grip member is expanded, so that the fitting of the high grip member to the belt side end is easy. Further, the high grip member is well fit around the side end of the fixing belt. Since the rigidity of the high grip member in the belt width direction is relatively large, its buckling strength is increased when it is brought into contact with the restricting members. As a result, such a behavior of the traveling fixing belt as to move aside is restricted satisfactorily.

The 15th belt fixing device has the advantageous effects comparable with those (i) of the 4th fixing device.

In this belt fixing device, a thermal expansion coefficient of each high grip member is substantially equal to that of the fixing belt. Therefore, the belt fixing device will additionally produce the following advantageous effects.

In this type of the fixing device, when it is operated, the fixing belt is heated to high temperature (e.g., approximately 150° C. to 200° C.). If the thermal expansion coefficient of the high grip portion fastened to each side end of the fixing belt is greatly different from than that of the fixing belt, a stress is generated at both the fastening faces by the thermal expansion coefficient difference between the fixing belt and the high grip members fastened to the side ends thereof. As a result, the bent side ends are easy to be broken or the high grip portion is easy to strip off the belt.

In this connection, in the 15th fixing device, the thermal expansion coefficient of the high grip member is substantially equal to that of the fixing belt (viz., it is made of a material having a thermal expansion coefficient substantially equal to that of the fixing belt). Therefore, little or a little stress that is caused in both the fastening faces by the thermal expansion coefficient difference between them is present. As a result, the problem of damaging the side ends of the fixing belt and the stripping of the high grip portion is solved. Consequently, the fixing device is improved in its endurance.

The 16th belt fixing device will produce the advantageous effects comparable with those (i) of the fourth fixing device.

Further, in the 16th belt fixing device, a high grip member is fastened to the fixing belt with a flexible adhesive layer being interposed therebetween.

In this type of the fixing device, during its operation, the fixing belt is heated to be at high temperature (150° C. to 200° C., for example). If the adhesive layer which fastens the high grip member to each side end of the fixing belt is not flexible, a thermal expansion coefficient difference between the fixing belt and the high grip member will give rise to the following problem: the belt end is easy to be broken or the high grip member is easy to peel off the fixing belt.

In this connection, in the 16th fixing device of this embodiment, the adhesive layer which fastens the high grip member to each side end of the fixing belt is flexible, the thermal expansion coefficient difference between the fixing belt and the high grip member is soaked up by the adhesive layer. Therefore, there is no chance that the ends of the fixing belt are broken or the high grip member peels off the belt. As a result, the fixing belt is improved in its endurance.

The 17th belt fixing device produces advantageous effects comparable with those (i) by the 4th belt fixing device.

This belt fixing device includes an oil coating mechanism for applying release oil to the surface of the fixing belt. Therefore, an offset phenomenon is unlikely to occur.

The high grip portion is capable of absorbing the oil, and hence produces the following advantageous effects.

Where the surface of the fixing belt is coated with the release oil, the oil will gradually move to the ends of the press contact portion between the fixing belt and the rotary member. However, in the 17th fixing device, the oil having reached the ends of the press contact portion is absorbed by the high grip member since the high grip members are fastened around both the side ends of the fixing belt in the fixing device and the high grip members have oil absorbing capability.

Therefore, the amount of oil present on the surfaces of both the side ends of the fixing belt, viz., the surfaces of the cloth of the high grip members, is small. As a result, a gripping force is satisfactorily secured at both the ends of the press contact portion. The slip is prevented (at least its occurrence is extremely infrequent), and a stable fixing operation of the fixing device is secured.

Thus, the 17th fixing device of this embodiment is able to stably fix the toner image although the surface of the fixing belt is coated with the release oil.

In the 18th belt fixing device based on the 17th belt fixing device, the high grip member allows the oil to flow in the belt circumferential direction. Therefore, if the high grip member is saturated with the oil, the oil entering the high grip member is moved in the belt circumferential direction and excluded out of the press contact portion by the pressing force.

Therefore, if the high grip member is saturated with oil applied thereto. The amount of oil present on the surfaces of both the side ends of the fixing belt, is small at the press contact portion. As a result, a gripping force is satisfactorily secured at both the ends of the press contact portion. The slip is prevented (at least its occurrence is extremely infrequent), and a stable fixing operation of the fixing device is secured.

The 19th belt fixing device produces the advantageous effects comparable with those (i) by the fourth fixing device.

In the belt fixing device, an offset phenomenon is unlikely to occur since an oil coating mechanism for applying release oil onto the surface of the endless belt.

Since the high grip portion is made of a composite material of high friction material and material having an oil absorbing capability, the following advantageous effects are produced.

Where the surface of the fixing belt is coated with the release oil, the oil will gradually move to the ends of the press contact portion. However, in the 19th fixing device, the oil having reached the ends of the press contact portion is absorbed by the material having an oil absorbing capability since the high grip portion is made of a composite material of high friction material and material having an oil absorbing capability.

Therefore, the amount of oil present on the surfaces of the high grip portions where the high friction material are exposed, is small. As a result, a gripping force is satisfactorily secured at both the ends of the press contact portion. The slip is prevented (at least its occurrence is extremely infrequent), and a stable fixing operation of the fixing device is secured.

Thus, the 19th belt fixing device is able to stably fix the toner image although the surface of the fixing belt is coated with the release oil.

Further, since the high grip member is made of a composite material of high friction material and material having an oil absorbing capability, its strength is also increased.

In the 20th belt fixing device based on any of the 8th to 18th fixing devices, the high grip portion is formed with an expandable endless belt having an inside diameter smaller than an outside diameter of each side end of the fixing belt when it is in a free state. Therefore, by the utilization of its expandability, the belt-like high grip member is expanded and fit to the side ends of the fixing belt to form a high grip portion well fit to and around the side ends of the fixing belt.

Where the high grip tape is wound around each side end of the fixing belt, there is a fear that high grip tape is easy to peel off the belt at its seam. In the 20th fixing belt, such a fear is not present and the belt-like high grip member doubles as a reinforcing member for the side end of the fixing belt. In this respect, a reliability of the fixing belt is improved. As a result, the fixing belt may be thinned in structure. The fixing belt well follows an unevenness corresponding to the amounts of attached toner forming a toner image. This results in improvement of a fixing strength or a fixing uniformity. Further, a heat capacity of the fixing belt is small, so that it may be heated quickly.

In the 21st belt fixing device based on any of the 8th to 18th fixing devices, the high grip tape is wound around each side end of the fixing belt and fastened thereto. Therefore, the high grip portion is formed by merely forming the exposing portions at both ends of the belt base itself. Accordingly, a reliability of the fixing device is improved. Further, the high grip portion of the belt fixing device may be manufactured more easily manufactured than a high grip portion formed by fitting high grip members like endless belts to the side ends of the fixing belt and fixing them thereto or by working the side ends of the belt into high grip portions.

In the 22nd belt fixing device based on the 21st fixing device, the winding start end 11 of the high grip tape is not lapped on the winding terminating end. Therefore, the following advantageous effects produced are comparable with those by the 5th belt fixing device.

In the 23rd belt fixing device based on the 21st fixing device, the winding start end of the high grip member is confronted with the winding terminating end in a state that a gap slanted to the axial direction of the rotary member is interposed therebetween. Therefore, the follow advantageous effects produced are comparable with those by the 21st belt fixing device.

In the 24th belt fixing device based on any of the ninth to 18th belt fixing device, since the high grip portion is formed with the cloth a surface of the high grip portion is defined by a number of vertical and horizontal fine ridges of the threads (woven or knitted) running crosswise and lengthwise. The fine ridge crossing pattern spreads substantially uniformly over the surface.

Accordingly, a vibration and a speed variation, which are generated at both ends of the fixing belt by a drive force transmission, are extremely reduced, thereby ensuring a smooth drive force transmission.

Since the fine ridge crossing pattern are formed by the threads, each ridge is rounded in cross section. With this configuration of the ridges, the stress concentration is lessened, and hence the endurance of the rotary member is increased.

Further, the high grip portion of this fixing device is superior to that formed with a rubber member of an uneven surface in the strength (particularly to shearing).

In the case of the high grip portion made of a film or a rubber member, for example, when a shearing force is applied to its edge, the edge first cracks, and then the crack rapidly propagates and the high grip portion is finally broken. In the case of the high grip portion made of the cloth, when the fiber at the edge of the cloth cracks to be broken, the breakage of the fiber does not propagates. That is, only one fiber at the edge is broken.

When the side edge of the belt is brought into contact with the inner surface of a flange (the guide ring) of the roller on which the fixing belt is put in order to restrict a zig-zag traveling of the fixing belt, a shearing force acting on the side edge of the belt is great in magnitude. In this fixing device, the high grip portions of cloth are provided on both side ends of the fixing belt. Therefore, the high grip portion is reluctant to its breakage and propagation of the breakage to the whole fixing belt 110 is also greatly impeded.

In the 25th belt fixing device based on any of the 4th to 9th, and 11th to 19th belt fixing devices, each side edge of the high grip member is not linear in the circumferential direction, and therefore the following advantageous effects are produced.

If each side edge of the high grip member is linear in the circumferential direction, positions of the rotary member, which is to be in pressing contact with the fixing belt, at which it is pressed against the side edges of the high grip member are locally worn or deformed, to thereby possibly reduce the endurance of the rotary member.

In this connection, in the 25th belt fixing device, each side edge of the high grip member is not linear in the circumferential direction. Because of this configuration, the local wearing or deformation of the rotary member are lessened. This results increase of the endurance of the rotary member.

In the 26th belt fixing device based on any of the 4th to 9th, and 11th to 19th belt fixing devices, the fixing belt is formed with an endless belt base, and a surface belt layer which is applied to the surface side of a central portion of the fixing base when viewed in the widthwise direction of the fixing base, and an outside diameter of the high grip portion is larger than that of the surface belt layer. Therefore, the high grip portions are pressed against both ends of the press contact portion between the fixing belt and the rotary member by great pressing forces. Therefore, a gripping force between the fixing belt and the rotary member is increased, the slip is prevented more reliably (at least its occurrence is extremely less frequent). And a stable fixing operation of the fixing device is secured.

In the 27th belt fixing device based on any of the 9th to 19th belt fixing devices, each end of a high grip member as viewed in the width direction is beveled. Therefore, the stress concentration on the rotary member by the ends of the high grip member is lessened, and hence the endurance of the rotary member is further increased.

Accordingly, with the beveled end faces, the stress concentration on the rotary member by the ends of the high grip member is lessened, and hence the endurance of the rotary member is increased, although this embodiment has such a construction that the outside diameter of the high grip member is larger than that of the surface belt layer, and therefore, at the ends of the press contact portion between the fixing belt and the rotary member, the high grip members are pressed against the rotary member by a larger pressing force.

In the 28th belt fixing device based on the 27th belt fixing device, each beveled surface is smoothed. Accordingly, the endurance of the pressure application roller 120 is further increased.

In the 29th belt fixing device based on any of the 9th to 14th, 17th and 18th belt fixing devices, a thermal expansion coefficient of each high grip member is substantially equal to that of the fixing belt. Therefore, the belt fixing device will additionally produce the following advantageous effects.

As already described, in this type of the fixing device, when it is operated, the fixing belt is heated to high temperature (e.g., approximately 150° C. to 200° C.). If the thermal expansion coefficient of the high grip portion fastened to each side end of the fixing belt is greatly different from than that of the fixing belt, and if the adhesive layer is not flexible, a stress will be generated at both the fastening faces by the thermal expansion coefficient difference between the fixing belt and the high grip members fastened to the side ends thereof. As a result, the side ends are easy to be broken or the high grip portion is easy to strip off the belt.

In this connection, in the 29th belt fixing device, the thermal expansion coefficient of the high grip member is substantially equal to that of the fixing belt (viz., it is made of a material having a thermal expansion coefficient substantially equal to that of the fixing belt). Therefore, little or a little stress that is caused in both the fastening faces by the thermal expansion coefficient difference between them is present. As a result, the problem of damaging the side ends of the fixing belt and the stripping of the high grip portion is solved. Consequently, the endurance of the fixing device is increased.

In the 30th belt fixing device based on any of the 9th to 14th, 17th and 18th belt fixing devices, a high grip member is fastened to the fixing belt with a flexible adhesive layer being interposed therebetween. Therefore, the 30th belt fixing device will produces the advantageous effects comparable with those by the 16th belt fixing device.

In the 31st belt fixing device based on any of the 9th to 14th, 17th and 18th belt fixing devices, an oil coating mechanism for applying release oil to the surface of the fixing belt is provided. Therefore, an offset phenomenon is unlikely to occur.

As described above, where the surface of the fixing belt is coated with the release oil, the oil will gradually move to the ends of the press contact portion between the fixing belt and the rotary member. However, in the 31st fixing device, the oil having reached the ends of the press contact portion is absorbed by the high grip member since the high grip members are fastened around both the side ends of the fixing belt in the fixing device and the high grip members have oil absorbing capability.

Therefore, the amount of oil present on the surfaces of both the side ends of the fixing belt, viz., the surfaces of the cloth of the high grip members, is small. As a result, a gripping force is satisfactorily secured at both the ends of the press contact portion. The slip is prevented (at least its occurrence is extremely infrequent), and a stable fixing operation of the fixing device is secured.

Thus, the 31st fixing device of this embodiment is able to stably fix the toner image although the surface of the fixing belt is coated with the release oil.

In the 32nd belt fixing device based on the 31st belt fixing device, the high grip member allows the oil to flow in the belt circumferential direction. Therefore, if the high grip member is saturated with the oil, the oil entering the high grip member is moved in the belt circumferential direction and excluded out of the press contact portion by the pressing force.

Therefore, if the high grip member is saturated with oil applied thereto. The amount of oil present on the surfaces of both the side ends of the fixing belt, is small at the press contact portion. As a result, a gripping force is satisfactorily secured at both the ends of the press contact portion. The slip is prevented (at least its occurrence is extremely infrequent), and a stable fixing operation of the fixing device is secured.

In the 33rd belt fixing device based on the 31st belt fixing device, the release oil, which is applied by the oil coating mechanism, is applied to within only the contact portion of the fixing belt where it is brought into contact with the recording medium. Therefore, the applied oil is almost all absorbed by or transferred to the recording medium when the recording medium passes therethrough.

Accordingly, there is little chance that the release oil flows to the non-contact portions not in contact with the recording medium, i.e., the high grip portion. As a result, a more stable fixing operation of the fixing device is performed.

In the 34th belt fixing device based on the 4th to 16th belt fixing devices, an oil coating mechanism for applying release oil to the surface of the fixing belt is provided. Therefore, an offset phenomenon is unlikely to occur.

The high grip member is provided at both the side ends of the fixing belt, and is permeable to the oil, and is fastened to both the side ends of the fixing belt with an adhesive layer having an absorbing capability being interposed therebetween. Accordingly, the oil having entered the ends of the press contact portion is absorbed by the adhesive layer through the high grip members.

Therefore, the amount of oil present on the surfaces of both the side ends of the fixing belt, is small. As a result, a gripping force is satisfactorily secured at both the ends of the press contact portion. The slip is prevented (at least its occurrence is extremely infrequent), and a stable fixing operation of the fixing device is secured.

Thus, the 34th fixing device of this embodiment is able to stably fix the toner image although the surface of the fixing belt is coated with the release oil.

In the 35th belt fixing device based on the 34th belt fixing device, the release oil, which is applied by the oil coating mechanism, is applied to within only the contact portion of the fixing belt where it is brought into contact with the recording medium. Therefore, the applied oil is almost all absorbed by or transferred to the recording medium when the recording medium passes therethrough.

Accordingly, there is little chance that the release oil flows to the non-contact portions not in contact with the recording medium, i.e., the high grip portion. As a result, a more stable fixing operation of the fixing device is performed.

In the 18th image forming apparatus based on any of the 7th to 10th, and 13th to 15th image forming apparatuses, the release oil, which is applied by the oil coating mechanism, is applied to within only the contact portion of the fixing belt where it is brought into contact with the recording medium. Therefore, the applied oil is almost all absorbed by or transferred to the recording medium when the recording medium passes therethrough.

Accordingly, there is little chance that the release oil flows to the non-contact portions not in contact with the recording medium, i.e., (1) the contact portion between the rotary member and the backup roller in the non-contact portion not in contact with the fixing belt and (2) the nip between the endless belt and the backup roller. As a result, a more stable fixing operation of the fixing device is performed.

In the 36th belt fixing device based on any of the 17th to 29th belt fixing devices, the release oil, which is applied by the oil coating mechanism, is applied to within only the contact portion of the fixing belt where it is brought into contact with the recording medium. Therefore, the applied oil is almost all absorbed by or transferred to the recording medium when the recording medium passes therethrough.

Accordingly, there is little chance that the release oil flows to the non-contact portions not in contact with the recording medium, i.e., the high grip portion. As a result, a more stable fixing operation of the fixing device is performed.

The 37th belt fixing device, which is based on any of the first to 19th belt fixing devices, is capable of fixing toner images on both sides of the recording medium. Therefore, there is a case that a recording medium having toner images formed on both sides thereof passes through the press contact portion in the fixing device.

Sometimes the toner on the recording medium reduces the friction coefficient between the recording medium and the rotary member. And it interrupts the oil absorbing by the recording medium. Therefore, in a case where the toner images are formed on both sides of the recording medium, the recording medium is more likely to slip when comparing with a case where the toner image is formed on one side of the recording medium.

In this connection, in the 37th belt fixing device, the high grip portions are provided at both side ends of the fixing belt. Therefore, even when toner images are formed on both sides of the recording medium, the slip does not occur (at least its occurrence is extremely infrequent). As a result, a stable fixing operation of the fixing device is secured.

Thus, the 37the belt fixing device is capable of fixing toner images suffering from no (at least little) image disarrangement on both sides of the recording medium.

The 38th belt fixing device, which is based on any of the first to 19th belt fixing devices, is capable of fixing a full color image by superimposing a plurality of different colors. Therefore, there is a case that a recording medium having a full color image formed on at least one side thereof passes through the press contact portion in the fixing device.

As described above, sometimes the toner on the recording medium reduces the friction coefficient between the recording medium and the rotary member, and it interrupts the oil absorbing by the recording medium. Therefore, in a case where the full color image by superimposing a plurality of different colors is formed on the recording medium, the recording medium is more likely to slip when comparing with a case where the toner image of monochromatic color is formed on the recording medium.

In this connection, in the 38th belt fixing device, the high grip portions are provided at both side ends of the fixing belt. Therefore, even when the full color image by superimposing a plurality of different colors is formed on the recording medium, the slip does not occur (at least its occurrence is extremely infrequent). As a result, a stable fixing operation of the fixing device is secured.

Thus, the 38the belt fixing device is capable of fixing a full color image suffering from no (at least little) image disarrangement. When combined with the 37th belt fixing device, it is capable of fixing full color toner images no (at least little) suffering from image disarrangement on both sides of the recording medium.

The present invention further provides the following fixing devices:

(1) A fixing device comprising:

a first rotary member;

a second rotary member contacting the first rotary member and forming a nip in corporation with the first rotary member;

the first and second rotary members having mutually contacting surfaces that are maintained in contact with each other regardless of whether or not a sheet is passed through the nip;

at least one of first and second rotary members having a first surface and a second surface that is higher in at least one of frictional characteristic, oil absorbing characteristic, oil permeable characteristic and oil-flow permitting characteristic than the first surface and that forms at least a part of a corresponding one of the mutually contacting surfaces.

(2) A fixing device according to (1), wherein the first rotary member has the first and second surfaces.

(3) A fixing device according to claim (1), wherein the second rotary member has the first and second surfaces.

(4) A fixing device according to (1), wherein each of the second rotary member has the first and second surfaces.

(5) A fixing device comprising:

a laterally elongating rotary member;

an endless belt contacting the first rotary member and forming a nip in corporation with the first rotary member;

a backup member keeping the endless belt in contact with the first rotary member;

at least one of the first rotary member, the endless belt and the backup member having a first surface and a second surface that is higher in at least one of frictional characteristic, oil absorbing characteristic, oil permeable characteristic and oil-flow permitting characteristic than the first surface;

the first surface being laterally corresponding in location to a region of the nip wherein the region is contactable with a sheet passed through the nip;

the second surface being situated laterally outside the region, and maintained in contact with another one of the rotary member, the endless belt and the backup member.

(6) A fixing device of (5), wherein the rotary member has the first and second surfaces.

(7) A fixing device of (5), wherein the endless belt has the first and second surfaces.

(8) A fixing device of (5), wherein the backup member has the first and second surfaces.

(9) A fixing device of (5), wherein each of the rotary member and the endless belt has the first and second surfaces.

(10) A fixing device of (5), wherein each of the rotary member and the backup member has the first and second surfaces.

(11) A fixing device of (5), wherein each of the endless belt and the backup member has the first and second surfaces.

(12) A fixing device of (5), wherein each of the rotary member and the backup member has the first and second surfaces, and the endless belt has the first surface on each of opposite surfaces of the endless belt, and the second surface on each of the opposite surfaces of the endless belt.

(13) A fixing device of any one of (1) to (12), wherein the second surface is defined by a perforated surface having a large number of holes.

(14) A fixing device of any one of (1) to (12), wherein the second surface is defined by a mesh material.

(15) A fixing device of any one of (1) to (12), wherein the second surface is defined by a rubber having a large number of laterally elongating ribs.

(16) A fixing device of any one of (1) to (12), wherein the second surface is defined by a heat-resistant tape having a large number of laterally elongating ribs.

(17) A fixing device of any one of (1) to (12), wherein the second surface is defined by a silicone rubber sponge.

(18) A fixing device of any one of (1) to (12), wherein the second surface is defined by a combination of a large number of particles and adhesive.

(19) A fixing device of any one of (1) to (12), wherein the second surface is defined by a high friction material having protruded and recessed portions.

(20) A fixing device of any one of (1) to (12), wherein the second surface is defined by an expandable endless belt, and an inner circumferential length of the expandable endless belt is normally smaller than an outer circumferential length of the first surface before the expandable belt is installed in place to define the second surface.

(21) A fixing device of any one of (1) to (12), wherein the second surface is defined by a cloth.

(22) A fixing device of any one of (1) to (12), wherein the second surface is protruded relative to the first surface.

(23) A fixing device of any one of (1) to (12), wherein the second surface is defined by an open-cell porous material.

(24) A fixing device of any one of (1) to (12), wherein the second surface is defined by a synthetic-resin-made, heat-resistant sheet having a large number of cavities.

(25) A fixing device of any one of (1) to (12), wherein the second surface is defined by a synthetic-resin-made, heat-resistant sheet having a large number of through-holes.

(26) A fixing device of any one of (1) to (12), wherein the second surface has a beveled surface as a lateral boundary.

(27) A fixing device of any one of (1) to (12), wherein the second surface has a laterally offsetting edge.

(28) A fixing device of any one of (1) to (12), wherein the second surface has a varying, lateral length.

(29) A fixing device of any one of (1) to (12), wherein the second surface is defined by repeating patterns each slanted with respect to a lateral direction.

(30) A fixing device of any one of (1) to (12), wherein the second surface is defined by a member supported on a base, and the high grip member is laterally protruded beyond a lateral end of the base.

(31) A fixing device of any one of (1) to (12), wherein the second surface is defined by a member having a larger rigidity in a lateral direction than in a circumferential direction.

(32) A fixing device of any one of (1) to (12), wherein the second surface is defined by a member supported on a base, and the member is substantially equal in a thermal expansion coefficient to the base.

(33) A fixing device of any one of (1) to (12), wherein the second surface is defined by a combination of a high friction material and an oil absorbing material.

(34) A fixing device of any one of (1) to (4), further comprising:

an annular groove provided on at least one of the first and second rotary members, the annular groove being laterally situated between a region of the nip and the mutually contacting surfaces wherein the region is contactable with a sheet passed through the nip.

(35) A fixing device of any one of (5) to (12), further comprising:

an annular groove provided on at least one of the rotary member and the backup member, the annular groove being laterally situated between the region of the nip and mutually contacting surfaces of the rotary member and the backup member, wherein the mutually contacting surfaces are maintained in contact with each other regardless of whether or not a sheet is passed through the nip.

(36) A fixing device comprising:

a first rotary member;

a second rotary member contacting the first rotary member and forming a nip in corporation with the first rotary member;

the first and second rotary members having mutually contacting surfaces that are maintained in contact with each other regardless of whether or not a sheet is passed through the nip;

an annular groove provided on at least one of the first and second rotary members, the annular groove being laterally situated between a region of the nip and the mutually contacting surfaces wherein the region is contactable with a sheet passed through the nip.

(37) A fixing device comprising:

a laterally elongating rotary member;

an endless belt contacting the first rotary member and forming a nip in corporation with the first rotary member;

a backup member keeping the endless belt in contact with the first rotary member;

an annular groove provided on at least one of the rotary member and the backup member, the annular groove being laterally situated between a region of the nip and mutually contacting surfaces of the rotary member and the backup member, wherein the region is contactable with a sheet passed through the nip, and wherein the mutually contacting surfaces are maintained in contact with each other regardless of whether or not a sheet is passed through the nip.

The present disclosure relates to the subject matter contained in Japanese patent application Nos.:

1) Hei. 11-56215 (filed on Mar. 3, 1999);

2) Hei. 11-56216 (filed on Mar. 3, 1999);

3) Hei. 11-185083 (filed on Jun. 30, 1999);

4) Hei. 11-194761 (filed on Jul. 8, 1999);

5) Hei. 11-194762 (filed on Jul. 8, 1999);

6) Hei. 11-194763 (filed on Jul. 8, 1999);

7) Hei. 11-247031 (filed on Sep. 1, 1999);

8) Hei. 11-247030 (filed on Sep. 1, 1999);

9) Hei. 11-247034 (filed on Sep. 1, 1999);

10) Hei. 11-247033 (filed on Sep. 1, 1999);

11) Hei. 11-247037 (filed on Sep. 1, 1999); and

12) Hei. 11-247036 (filed on Sep. 1, 1999), all of which are expressly incorporated herein by reference in their entireties.

BRIEF DESCRIPTION OF THE DRAWINGS

FIG. 4 is a diagram showing another example of a high grip portion 110G.

FIGS. 5A1 and 5A2 show a first example of a high grip portion G; and FIG. 5A1 is a fragmentary perspective view showing the high grip portion and FIG. 5A2 is a fragmentary sectional view of the same. FIGS. 5B1 and 5B2 show a second example of the high grip portion G; and FIG. 5B1 is a fragmentary perspective view showing the high grip portion and FIG. 5B2 is a fragmentary sectional view of the same.

FIGS. 6A1 and 6A2 show a third example of the high grip portion G; and FIG. 6A1 is a fragmentary perspective view showing of the high grip portion G, FIG. 6A2 is a cross sectional view taken on line a2—a2, and FIG. 6A3 is a diagram for explaing an action of the high grip portion.

FIG. 17 shows an fixing belt 110 in the ninth embodiment.

FIG. 22 is a diagram showing a tenth embodiment of the present invention.

FIG. 24 is a diagram showing a major portion of an eleventh embodiment of a belt fixing device according to the present invention.

FIG. 25 is a diagram showing a major portion of a twelfth embodiment of a belt fixing belt according to the present invention.

FIG. 26A shows a case where threads 1143 are made of single threads, and FIG. 26B shows a case where the threads 1143 are each made of an aggregation of a plural number of very fine threads.

FIG. 27 shows a modification of the fixing belt.

FIG. 27B is a cross sectional view taken on line b—b in FIG. 28A.

FIG. 31A is a plan view showing a part of a fixing belt 110; and FIG. 31B is a cross sectional view taken on line b—b in FIG. 31A. FIG. 31C is a plan view showing a part of a fixing belt 110; and FIG. 31D is a cross sectional view taken on line d—d in FIG. 31C.

FIG. 38 shows another modification of the fixing belt 110.

FIG. 42 diagrammatically shows one end of a fixing belt 110 employed in this embodiment.

FIG. 43 is a diagram showing one end of a fixing belt 110 extending around the backup roller 130 and heating roller 140 in a 22nd embodiment of a belt fixing belt according to the present invention.

FIG. 46 shows a modification of the fixing belt.

FIG. 47 shows one end of a modification of the fixing belt 110.

FIG. 48A is a plan view showing a part of the fixing belt 110, and FIG. 48B is a cross sectional view taken on line b—b in FIG. 48A. FIG. 48C is a plan view showing a part of the fixing belt 110, and FIG. 48D is a cross sectional view taken on line d—d in FIG. 48C.

FIG. 49 is a diagram showing one end of a fixing belt 110 in a 23rd embodiment of the present invention.

FIG. 53 is a diagrammatic view showing a major portion of a 26th embodiment of the present invention.

FIG. 54 is a diagrammatic view showing a major portion of a 27th embodiment of the present invention.

DESCRIPTION OF THE PREFERRED EMBODIMENT

The preferred embodiments of the present invention will be described with reference to the accompanying drawings.

First Embodiment

Figure 1:
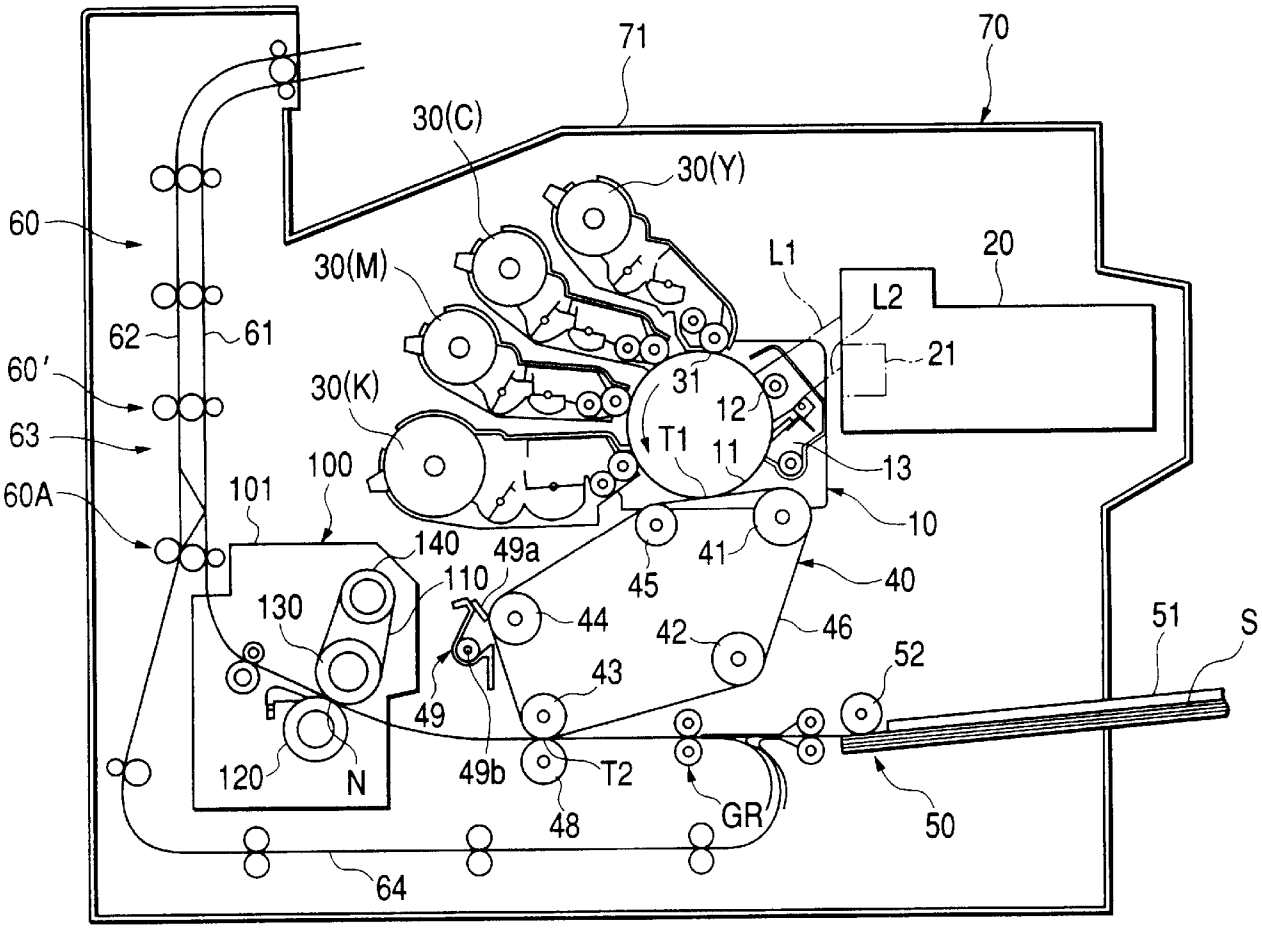
FIG. 1 is a view schematically showing a first embodiment of the present invention.

FIG. 1 is a side view schematically showing an image forming apparatus which is a first embodiment of the present invention.

The image forming apparatus will first be described, and then a fixing device will be described in detail.

The image forming apparatus is designed to be capable of forming a monochromatic color image and a full color image by use of a development unit of four colors, Y (yellow), C(cyan), M (magenta) and K (black).

In FIG. 1, reference numeral 10 designates a photosensitive member unit, and its photosensitive member 11 is driven by an appropriate drive mechanism, not shown, to rotate in a direction of an arrow in the figure.

The photosensitive member 11 includes an electrically conductive substrate and a photosensitive layer formed over the surface of the conductive substrate.

A charging roller 12 as a charging mechanism, an exposure unit 20 as an exposing mechanism, a development unit 30 (Y, C, M and K) as a developing mechanism, an intermediate transfer unit 40 as a transfer mechanism, and a cleaning mechanism 13 are disposed along the circumference of the photosensitive member 11 in its rotation direction. The photosensitive member 11, the charging roller 12 and the cleaning mechanism 13 are assembled into the photosensitive member unit 10.

The charging roller 12 comes in contact with the outer peripheral surface of the photosensitive member 11 to uniformly charge the outer peripheral surface. The exposure unit 20 selectively radiates exposing light L1 onto the uniformly charged outer peripheral surface of the photosensitive member 11 in accordance with desired image information, whereby an electrostatic latent image is formed on the photosensitive member 11 with the exposing light L1.

The development unit 30 applies toner to the electrostatic latent image to develop the latent image.

The development unit includes a yellow development sub-unit 30Y, a cyan development sub-unit 30C, a magenta development sub-unit 30M, and a black development sub-unit 30K. Those development sub-units 30Y, 30C, 30M, 30K are movable such that a development roller 31 of one of those development sub-units may selectively be brought into contact with the photosensitive member 11. The development unit 30 thus arranged is capable of selectively applying each of color toner of yellow, cyan, magenta and black onto the surface of the photosensitive member 11 to develop the electrostatic latent image on the photosensitive member 11 and to form a toner image.

The toner image thus formed is transferred onto an intermediate transfer belt 46, which forms an intermediate transfer member of the intermediate transfer unit 40.

The cleaning mechanism 13 includes a cleaner blade for scraping off toner left on the outer peripheral surface of the photosensitive member 11 and a toner receiving portion for receiving the toner thus scraped off by the cleaner blade.

The intermediate transfer unit 40 includes a drive roller 41, four roller followers 42 to 45, and an endless intermediate transfer belt 46 as intermediate transfer member wound on those rollers.

A gear (not shown) fastened to an end of the drive roller 41 is in mesh with a drive gear (not shown) provided at an end of the photosensitive member 11. Accordingly, the drive roller 41 is rotated at a peripheral speed substantially equal to that of the photosensitive member 11, and it is circulated in a direction of an arrow in the figure at a peripheral speed substantially equal to that of the photosensitive member 11.

The roller follower 45 is located at such a position between it and the drive roller 41 where the intermediate transfer belt 46 is pressed against the photosensitive member 11 by a tension of the intermediate transfer belt 46 itself. The pressing portion between the photosensitive member 11 and the intermediate transfer belt 46 forms a primary transfer portion T1.

An electrode roller, not shown, is provided in association with the drive roller 41 in a state that the intermediate transfer belt 46 intervenes therebetween. A primary transfer voltage is applied to the intermediate transfer belt 46 by way of the electrode roller.

The roller follower 42 is a tension roller, and urges the intermediate transfer belt 46 in its straing directions with the aid of urging mechanism (not shown).

The roller follower 43 is a backup roller forming a secondary transfer portion T2. A secondary transfer roller 48 as a secondary transfer mechanism is opposed to the backup roller 43 with respect to the intermediate transfer belt 46. The secondary transfer roller 48 may be brought into contact with the intermediate transfer belt 46 and separated from the same, by a contact/separation mechanism (not shown). A secondary transfer voltage is applied to the secondary transfer roller 48.

The roller follower 44 is a backup roller for a belt cleaner 49. The belt cleaner 49 includes a cleaner blade 49*a*, which is brought into contact with the intermediate transfer belt 46 to scrape off toner left on the outer peripheral surface thereof, and a receiving portion 49*b* for receiving toner scraped off by the cleaner blade 49*a*. The belt cleaner 49 may be brought into contact with and separated from the intermediate transfer belt 46 by a contact/separation mechanism (not shown).

The intermediate transfer belt 46 consists of a multi-layer belt including a conductive layer and a resistive layer, which is formed on the conductive layer and is to be brought into pressing contact with the photosensitive member 11. The conductive layer is formed on an insulating substrate made of synthetic resin. A primary transfer voltage is applied to the conductive layer by way of the electrode roller.

During a circulation of the intermediate transfer belt 46, a toner image is transferred from the photosensitive member 11 onto the intermediate transfer belt 46 at the primary transfer portion T1. The toner image transferred onto the intermediate transfer belt 46 is transferred, at the secondary transfer portion T2, onto a sheet (recording medium) S, such as a sheet of paper, which is fed to between it and the secondary transfer roller 48.

The electrode roller, the urging mechanism for the tension roller 42, the secondary transfer roller 48 and the belt cleaner 49 are also assembled into the intermediate transfer unit 40.

The recording medium S is fed to the secondary transfer a portion T2 at a predetermined timing by a gate roller pair GRR, from a sheet supplying unit 50 a sheet supplying mechanism. Reference numeral 51 designates a paper supply cassette 51 which holds a stack of recording media S, and numeral 52 represents a pickup roller 52.

A recording medium S to which a toner image has been transferred at the secondary transfer portion T2 passes through a fixing device 100 as a fixing mechanism, and as a result, the toner image is fixed on the recording medium S.

As will subsequently be described in detail with reference to FIG. 2, the fixing device 100 includes an endless belt 110 to be heated and an pressure application roller 120 as a rotary member to be in pressing contact with the endless belt 110. At a part (as viewed in the axial direction) of a press contact portion (or a nip) N between the endless belt 110 and the pressure application roller 120, the belt and roller compress the recording medium S while at the same time heating the latter, whereby the toner image is fused and permanently fixed on the recording medium S.

After passing the fixing device 100, the recording medium S is finally transported through a sheet discharge path 60, and discharged to a sheet receiving portion 71, which is formed on a case 70 of the apparatus body. The image forming apparatus includes an inverting/returning path 60' which inverts the recording medium S having passed through the fixing device 100, and returns the inverted one to the secondary transfer portion T2. Specifically, a mechanism for transporting the recording medium S in the embodiment includes the sheet discharge path 60 and the inverting/returning path 60', and the sheet discharge path 60 forms a part of the inverting/returning path 60'.

The inverting/returning path 60' includes a switch-back path 63, and a return path 64. The switch-back path 63 has two separate sheet discharge paths 61 and 62, each of which is capable of transporting a recording medium S having passed through the fixing device 100 into the path per se, and transporting the recording medium S having been once transported therein to in the reverse direction. The return path 64 returns the recording medium S, which is reversely transported from the switch-back path 63, to the secondary transfer portion T2, again. Accordingly, a recording medium S which is to be returned again to the secondary transfer portion T2 by the inverting/returning path 60' will be returned to the secondary transfer portion T2 in a state that the top and back surfaces or sides are inverted.

The image forming apparatus thus constructed is capable of forming a toner image on only the top surface (first surface) of the recording medium S and also both the top and back surfaces (first and second surfaces) of the same.

An operation of the overall image forming apparatus thus constructed will briefly be described.

(i) When a print command signal (image forming signal) that is transferred from a host computer or the like (personal computer or the like) to a control unit (not shown) of the image forming apparatus, the photosensitive member 11, and the respective rollers 31 of the development unit 30, and the intermediate transfer belt 46 are driven to turn.

(ii) The outer peripheral surface of the photosensitive member 11 is uniformly charged by the charging roller 12.

(iii) The exposure unit 60 selectively exposes the uniformly charged outer peripheral surface of the photosensitive member in accordance with image information of a first color (for example, yellow), to thereby form an electrostatic latent image for yellow.

(iv) Only the development roller of the development subunit 30Y of the first color (for example, yellow) is brought into contact with the photosensitive member 11. The electrostatic latent image is developed and a toner image of the first color (for example, yellow) is formed on the photosensitive member 11.

(v) A primary transfer voltage the polarity of which is Opposite to the charging polarity of the toner is applied to the intermediate transfer belt 46. As a result, the toner image is transferred from the photosensitive member 11 to the intermediate transfer belt 46 at the primary transfer portion T1. At this time, the secondary transfer roller 48 and the belt cleaner 49 are separated from the intermediate transfer belt 46.

(vi) Toner left on the photosensitive member 11 is removed by the cleaning mechanism 13, and the charge of the photosensitive member 11 is then removed by charge removal light L2 emitted from a charge removal mechanism 21.

(vii) A sequence of operation steps (ii) to (vi) is repeated as required. Specifically, toner images of second to fourth colors are transferred and formed onto the intermediate transfer belt 46 in a superimposing manner in accordance with print command signals.

(viii) Just before or after the leading edge of a recording medium S, which is supplied at a predetermined timing from the sheet supplying unit 50, reaches the secondary transfer portion T2 (viz., at a timing that a toner image is transferred from the intermediate transfer belt 46 onto a desired location on the recording medium S), the secondary transfer roller 48 is pressed against the intermediate transfer belt 46, while at the same time, a secondary transfer voltage is applied to the same, and the toner image (basically, a full color image formed by superimposing four color toner images) is transferred from the intermediate transfer belt 46 to the recording medium S. The belt cleaner 49 is brought into contact with the intermediate transfer belt 46 to remove toner still left on the intermediate transfer belt 46 after the secondary transfer.

(ix) The recording medium S passes through the fixing device 100, so that the toner image is fixed thereon. Thereafter, the recording medium S is directed to a predetermined position (the sheet receiving portion 71 when the print mode is not the both-side print mode, and the switch-back path 63 and then the return path 64 when it is the both-side print mode).

To be more specific, when the image is formed on only the top side or surface (first surface) of the recording medium, the toner image is transferred onto the first surface of the recording medium S that is supplied from the sheet supplying unit 50 at the secondary transfer portion T2. After fixed by the fixing device 100, it is discharged into the sheet receiving portion 71 by way of the sheet discharge path 61 or 62. A path select mechanism (not shown) is provided at an entrance 60A of those paths 61 and 62. The path select mechanism selects the sheet discharge path (61 or 62) to which the recording medium S is to be transported.

When the image is formed on both sides (first and second sides or surfaces) of the recording medium, the toner image is transferred, at the secondary transfer portion T2, onto the first surface of the recording medium S which fed from the sheet supplying unit 50. And it is fixed by the fixing device 100. After the fixing, the recording medium enters the sheet discharge path 61 or 62 (switch-back path 63), and transported in the reverse direction through the return path 64, and transported back to the secondary transfer portion T2 by means of the gate roller pair GRR at a predetermined timing, and the toner image is transferred also onto the second surface of the recording medium. Thereafter, the fixing device 100 fixes the toner image also onto the second surface, and the resultant recording medium is discharged onto the sheet receiving portion 71 by way of the sheet discharge path 61 or 62.

The image forming apparatus of the present embodiment is constructed and operated as described above, and the fixing device 100 assembled therein to will now be described.

Figure 2:
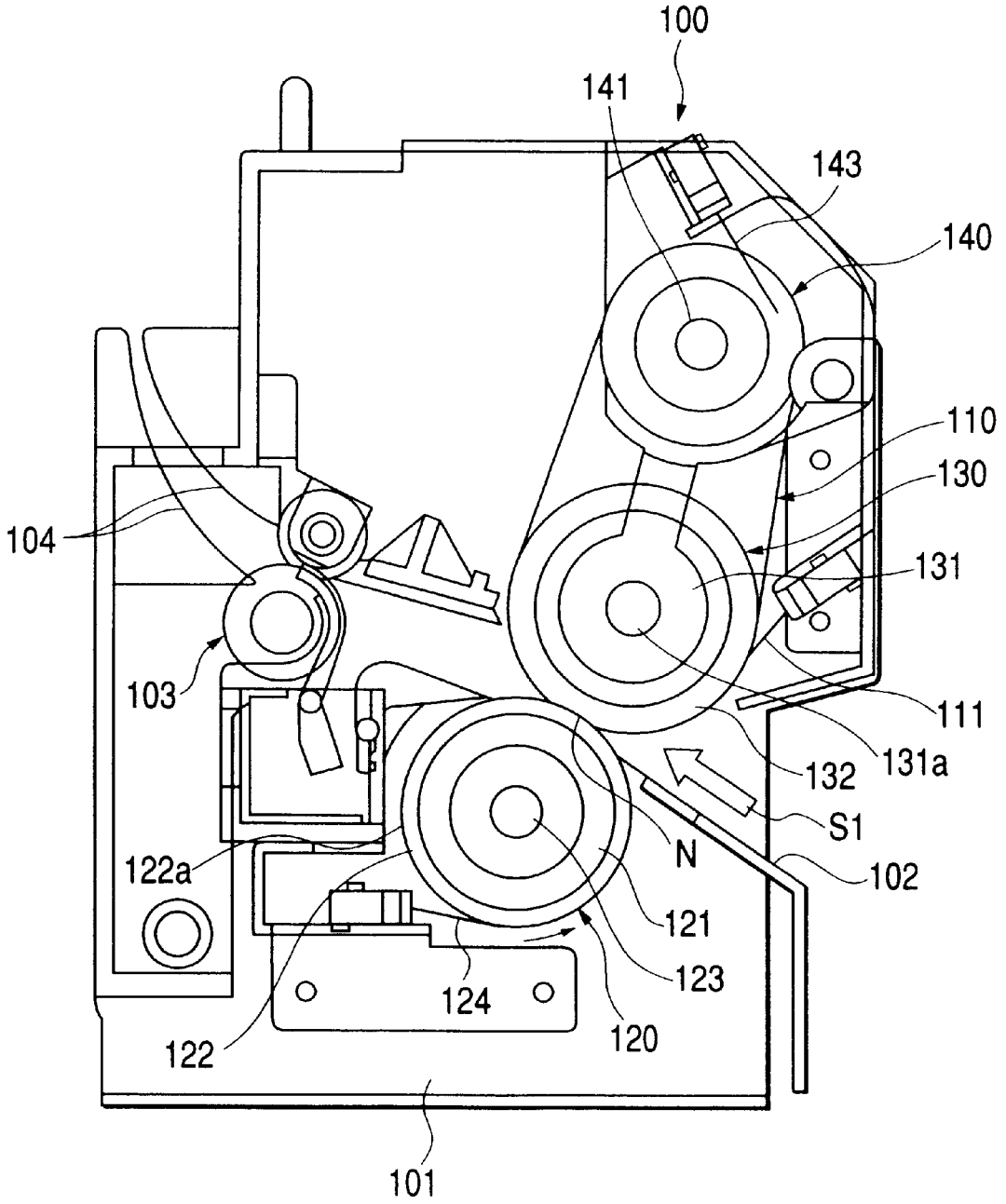
FIG. 2 is a view schematically showing a major portion of a fixing device 100 in the first embodiment.
Figure 3:
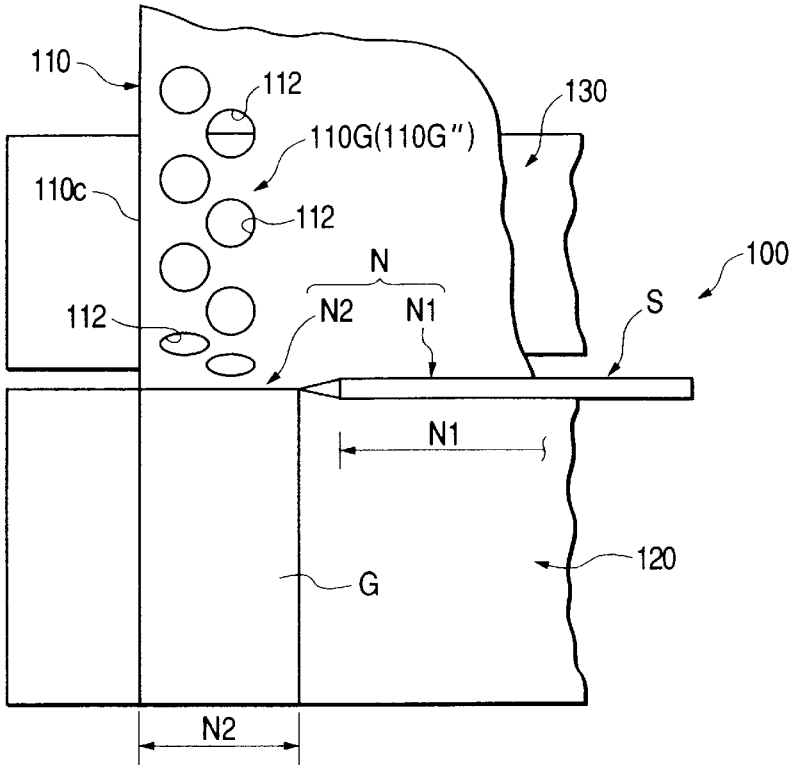
FIG. 3 is a fragmentary view showing a major portion of the fixing device.

FIG. 2 is a view schematically showing a major portion of the fixing device 100. FIG. 3 is a side view showing a major portion of the fixing device.

As described above, the fixing device 100 includes the endless belt 110 to be heated and an pressure application roller 120 as a rotary member to be in pressing contact with the endless belt 110. At a part N1 (usually a central part as viewed in the axial direction) of a press contact portion N between the endless belt 110 and the pressure application roller 120, the belt and roller compress a recording medium S traveling in a direction S1 of an arrow while at the same time heating the latter, whereby the toner image is fused and permanently fixed on the recording medium S. The fixing device 100 further includes a backup roller 130 as a backup member for supporting the endless belt 110 on the inner side thereof at the press contact portion, and a heating roller 140 as a heating mechanism for heating the endless belt 110. The endless belt 110 is suspended between the backup roller 130 and the heating roller 140.

The drive roller for rotating the endless belt 110 and the respective rollers may be any of the rollers. In the embodiment, the pressure application roller 120 is used as the drive roller.

The pressure application roller 120 is driven to rotate in the direction (in the counterclockwise direction) of an arrow in FIG. 2 by a drive mechanism, not shown, provided in the main body of the image forming apparatus, and the endless belt 110, the backup roller 130, and the heating roller 140 rotate in a follower manner. Specifically, the endless belt 110 follows in rotation the pressure application roller 120 by being pressure-contacted with the pressure application roller 120. The endless belt 110 is wound on the backup roller 130 and the heating roller 140, and the backup roller 130 and the heating roller 140 follow in rotation the endless belt 110.

The endless belt 110 is formed with a belt base 110*a* (see FIG. 4) of a thin member of metal (such as nickel) and a surface belt layer 110*b* (for example, a silicone rubber layer), which exhibits good release characteristics for recording material and toner, formed over a surface of the belt base layer.

One of the features of the present embodiment resides in that a high grip portion 110G is provided at a portion N2 of the endless belt 110 which is not pressed by the recording medium S but pressed by the pressure application roller 120 (usually, the portion N2 is provided at each of both side ends of the endless belt).

The high grip portion 110G shown in FIG. 3 is formed with a plurality of holes 112 equidistantly arrayed in a zig-zag fashion along each portion N2 or each side end 10*c* of the endless belt 110 (when viewed from side, the high grip portion having the thus arranged holes is shaped like a ring.).

Figure 4A:
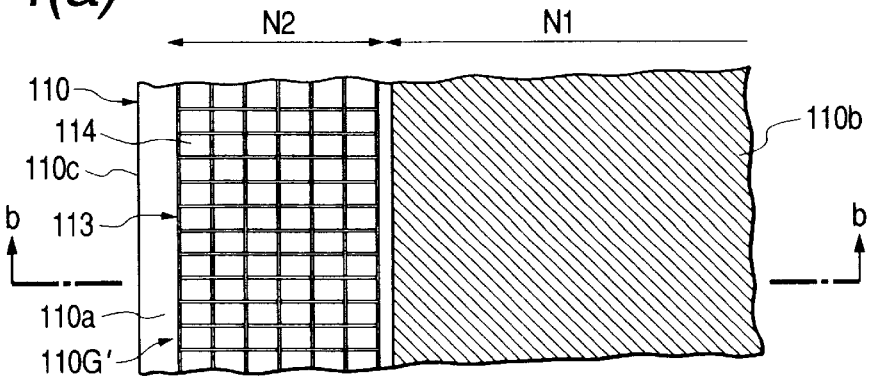
FIG. 4A is a plan view showing the same and FIG. 4B is a cross sectional view taken on line b—b in FIG. 4A.
Figure 4B:
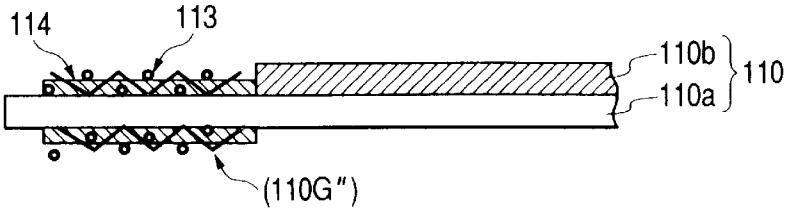

FIG. 4 is a view showing another instance of the high grip portion 110G; FIG. 4A is a plan view showing a part of the high grip portion 110G, and FIG. 4B is a cross sectional view taken on line b—b in FIG. 4A.

A high grip portion 110G' shown in FIG. 4 is constructed such that meshes 113 made of glass fiber are bonded, by adhesive 114, to and along a side end 110*c* of the endless belt 110 at the portion N2 thereof, more exactly, both surfaces of the belt base 110*a* of the endless belt at the portion N2.

The high grip portions 110G are preferably provided on both the side ends of the endless belt 110, although only one side end of the endless belt 110 is illustrated in FIGS. 3 and 4. In the present embodiment, the high grip portions 110G are provided on both the side ends of the endless belt.

In FIG. 2, reference numeral 111 is a thermistor for sensing a temperature on a surface portion of the endless belt 110 where the belt is put on the backup roller 130. The thermistor 111 is located upstream of a press contact portion N between it and the pressure application roller 120.

The backup roller 130 is formed with a core member 131 of metal and a relatively thick, elastic layer 132 layered over the surface of the core member 131. The backup roller 130 is supported by a shaft 131*a* of the core member 131 while being rotatable with respect to a side plate 101 of the frame of the fixing device 100.

The heating roller 140, shaped like a pipe, is made of a material having a good thermal conductivity (for example, aluminum). It contains a halogen lamp 141 as a heat source disposed therein. The heating roller 140 is capable of rapidly heating the endless belt 110 at a position where it is put on the endless belt 110. In the embodiment, the heating roller 140 is constructed as a tension roller, and is urged in a straing direction of the endless belt 110 by an appropriate urging mechanism. In FIG. 2, reference numeral 143 represents a thermistor for sensing a temperature of the heating roller 140.

The pressure application roller 120 is formed with a pipe-like core member 121 having a good thermal conductivity, a relatively thin, elastic layer 122 which is formed on the surface of the core member 121 and is harder than the elastic layer 132 of the backup roller 130, and a surface belt layer 122*a* which is formed on a surface of the elastic layer 122 and well separable from the recording member and toner. A halogen lamp 123 as a heat source is disposed within the core member 121.

The pressure application roller 120 is rotatably supported by a frame side plate 101 of the fixing device 100, and it is rotated in the direction of an arrow (counterclockwise) in FIG. 2 by means of a drive mechanism (not shown) provided on the main body of the image forming apparatus. The pressure application roller 120 is mounted immovable in the radial direction. It is pressed against the backup roller 130 by the utilization of elastic forces of the elastic layer 122 and the elastic layer 132 of the backup roller 130, with the endless belt 110 being interposed therebetween. The elastic layer 132 of the backup roller 130 is thicker and softer than the elastic layer 122 of the pressure application roller 120. Therefore, the fixing nip N is deflected toward the backup roller 130. In FIG. 2, reference numeral 124 designates a thermistor for sensing a surface temperature of the pressure application roller 120.

A frame 101 includes a guide 102 for guiding a recording medium S having a toner image formed (transferred) thereon at the secondary transfer portion T2 (see FIG. 1) into a press contact portion (nip) N between the endless belt 110 and the pressure application roller 120. A guide 104 and a sheet-discharge roller pair 103 are provided downstream of the press contact portion N. The guide 104 guides the recording medium S of which the toner image has been fixed to the sheet discharge path 60. The respective thermistors are connected to the control unit (not shown). The control unit controls a value of current fed to each of the heat sources 123 and 141 in accordance with a temperature sensed by the related thermistor.

In the image forming apparatus of the present embodiment, a toner image is formed on a recording medium S. The recording medium S having the toner image formed thereon is moved to pass through the part N1 of the press contact portion N in the fixing device 110, whereby the toner image is fused and permanently fixed on the recording medium S. As state above, the fixing device 100 includes an endless belt 110 to be heated and an pressure application roller 120 as a rotary member to be in pressing contact with the endless belt 110. Of the endless belt 110 and the pressure application roller 120, the pressure application roller 120 is driven to rotate while the endless belt 110 follows the pressure application roller in its circulation.

Further, the high grip portion 110G is provided at a portion N2 of the endless belt 110 which is not pressed by the recording medium S but pressed by the pressure application roller 120. Therefore, when a recording medium S, which relatively easily slips, is supplied to the part N1 of the press contact portion N between the endless belt 110 and the pressure application roller 120, and as a result, when a slip will occur between the pressure application roller 120 of the drive side (the endless belt 110 when the endless belt 110 is driven by the backup roller 130; The same shall apply hereinafter.) and the recording medium S and/or the recording medium S and the endless belt 110 of the follower side (the pressure application roller 120 when the backup roller 130 drives the endless belt 110; The same shall apply hereinafter.), the endless belt 110 and the pressure application roller 120 rotate at substantially equal peripheral speeds since the follower action of the endless belt 110 of the follower side for the pressure application roller 120 of the drive side is enhanced through the action of the high grip portion 110G.

Therefore, the slip is prevented (at least its occurrence is extremely infrequent). As a result, the fixing operation of the fixing device is stable. Accordingly, the toner image on the recording medium S is little blurred, so that the resultant image is little disarranged.

The image forming apparatus is designed so as to be capable of forming toner images on both sides of the recording medium S. Therefore, there is a case that a recording medium S having toner images formed on both sides thereof passes through the part N1 of the press contact portion N in the fixing device 100.

The toner on the recording medium S sometimes reduces a frictional coefficient between the recording medium S and the belt. Therefore, in a case where the toner images are formed on both sides of the recording medium S, the recording medium is more likely to slip when comparing with a case where the toner image is formed on one side of the recording medium S.

In this connection, in the image forming apparatus of the embodiment, the high grip portion 110G is provided on the endless belt 110. Because of this, even when the toner images are formed on both sides of the recording medium S, the slip does not occur (at least its occurrence is extremely infrequent), and as a result, a fixing operation of the fixing device is stable.

Thus, the image forming apparatus of the embodiment can form images not disarranged (at least little disarranged) on both sides of the recording medium S.

The image forming apparatus is also designed to be capable of forming a full color image, which is formed by superimposing a plurality of different colors. Therefore, there is a case where a recording medium S having a full color image formed on at least one side thereof passes through the part N1 of the press contact portion N in the fixing device 100.

As described above, the toner on the recording medium S sometimes reduces a frictional coefficient between the recording medium S and the belt. Therefore, in a case where a full color image by superimposing a plurality of different colors is formed on the recording medium S, the recording medium is more likely to slip when comparing with a case where the monochromatic color image is formed on the recording medium S.

In connection with this, in the image forming apparatus of the embodiment, the high grip portion 110G is provided on the endless belt 110. Because of this, even when the full color image, which is formed by superimposing the plurality of different colors, is formed on the recording medium S, the slip does not occur (at least its occurrence is extremely infrequent), and as a result, a fixing operation of the fixing device is stable.

Thus, the image forming apparatus of the embodiment can form a full color image suffering from no (at least little)

disarrangement of the image, and can form full color images, which suffering no (at least little) image disarrangement on both sides of the recording medium S.

The high grip portions 110G are each provided at the portion of the endless belt which is not in pressing contact with the recording medium S. Therefore, the high grip portions 110G do not have any adverse effect on the recording medium S and the image on the recording medium S.

Second Embodiment

A difference of a second embodiment of the present invention from the first embodiment resides in that as shown in FIG. 3, instead of providing a high grip portion 110G on the endless belt 110 (or in addition to providing it on the endless belt), a high grip portion G is provided on a portion N2 of the pressure application roller 120 which is not pressed by the recording medium S but pressed by the endless belt 110. The remaing construction of the second embodiment is substantially the same as of the first embodiment. The high grip portions G are preferably provided on both the side ends of the pressure application roller 120, although only one side end of the pressure application roller 120 is illustrated in FIG. 3. In the present embodiment, the high grip portions G are provided on both the side ends of the pressure application roller.

The high grip portion 110G may take a proper construction, and may take the following constructions, for example.

FIGS. 5A1 and 5A2 show a first example of the high grip portion 110G. FIG. 5A1 is a perspective view showing a part of the first example, and FIG. 5A2 is a side view showing a part of the same.

In the first example, an endless rubber belt G1*b* with a number of axially elongated, narrow strips (ribs) G1*a* rectangular in cross section is secured to or formed integrally on a portion N2 of the pressure application roller 120 which is not pressed by the recording medium S but pressed by the endless belt 110. A height of each narrow strip G1*a* is within a range of 100 $\mu$m to 500 $\mu$m.

FIGS. 5B1 and 5B2 show a second example of the high grip portion 110G. FIG. 5B1 is a perspective view showing a part of the first example, and FIG. 5B2 is a side view showing a part of the same.

In the second example, a heat-resistance tape G2*b* with a number of axially elongated, narrow strips (or ribs) G2*a* semicircular in cross section or a wavy tape G2*b* is bonded around a portion N2 of the pressure application roller 120 which is not pressed by the recording medium S but pressed by the endless belt 110. A height of each narrow strip G2*a* is within a range of 100 $\mu$m to 500 $\mu$m, more preferably approximately 200 $\mu$m.

FIGS. 6A1 and 6A2 show a third example of the high grip portion 110G. FIG. 6A1 is a perspective view showing a part of the first example, and FIG. 6A2 is a cross sectional view taken on line a2—a2 in FIG. 6A1.

A thick, band-like silicone rubber sponge G3*a* is wound around and secured to a portion N2 of the pressure application roller 120 which is not pressed by the recording medium S but pressed by the endless belt 110 or a thick, ring-like silicone rubber sponge G3*a* is secured to the portion N2.

The silicone rubber sponge. G3*a*, as shown in FIG. 6A3, is compressed when the endless belt 110 and the pressure application roller 120 are pressed one against the other, to form a high grip portion G.

Figure 6:
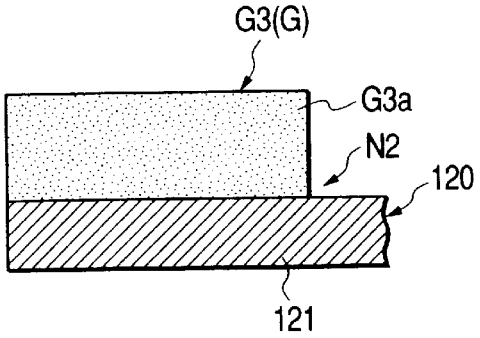
Figure 6:
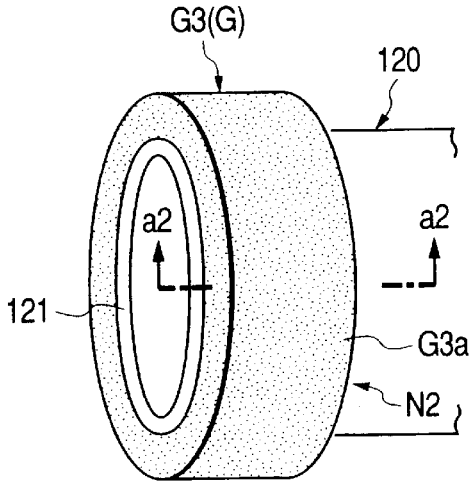
Figure 6:
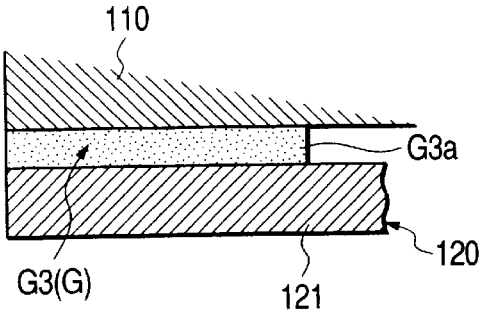
Figure 6B:
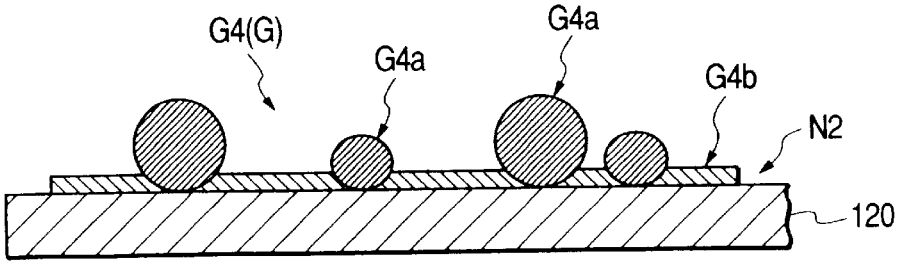
FIG. 6B is a cross sectional view showing a fourth example of the high grip portion G (corresponding to the cross sectional view taken on line a2—a2 in FIG. 6A1).

FIG. 6B is a cross sectional view showing a fourth example of the high grip portion G (corresponds to the cross sectional view taken on line a2—a2 in FIG. 6A1).

The fourth example of the high grip portion G is formed by securing particles (e.g., glass beads) G4*a*, by epoxy adhesive G4*b*, onto a portion N2 of the pressure application roller 120 which is not pressed by the recording medium S but pressed by the endless belt 110. A preferable particle diameter of a particle G4*a* is within a range of 200 $\mu$m to 500 $\mu$m.

Also in this embodiment of the image forming apparatus, as in the first embodiment, a toner image is formed on a recording medium S, the recording medium S having the toner image formed thereon passes through the part N1 of the press contact portion N in the fixing device 100, whereby the toner image is fused and fixed on the recording medium S.

The high grip portion G is provided at a portion N2 of the pressure application roller 120 which is not pressed by the recording medium S but pressed by the endless belt 110. Therefore, when a recording medium S, which relatively easily slips, is supplied to the part N1 of the press contact portion between the endless belt 110 and the pressure application roller 120, and as a result, when a slip will occur between the pressure application roller 120 of the drive side and the recording medium S and/or the recording medium S and the endless belt 110 of the follower side, the endless belt 110 and the pressure application roller 120 rotate at substantially equal peripheral speeds since the follower action of the endless belt 110 of the follower side for the pressure application roller 120 of the drive side is enhanced through the action of the high grip portion 110G.

The slip is prevented (at least its occurrence is extremely infrequent). As a result, the fixing operation of the fixing device is stable. Accordingly, the toner image on the recording medium S is little blurred, so that the resultant image is little disarranged.

In the image forming apparatus of the embodiment, at least the high grip portion G is provided on the pressure application roller 120. Because of this, even when the toner images are formed on both sides of the recording medium S or the full color image, which is formed by superimposing the plurality of different colors, is formed on the recording medium S, the slip does not occur (at least its occurrence is extremely infrequent), and as a result, a fixing operation of the fixing device is stable.

Thus, also in the image forming apparatus of the embodiment, it is possible to form a full color image suffering from no (at least little) image disarrangement, and to form full color images, which suffering no (at least little) image disarrangement, on both sides of the recording medium S.

The high grip portions G are each provided at the portion of the endless belt which is not in pressing contact with the recording medium S. Therefore, the high grip portions do not have any adverse effect on the recording medium S and the image on the recording medium S.

Third Embodiment

Figure 7:
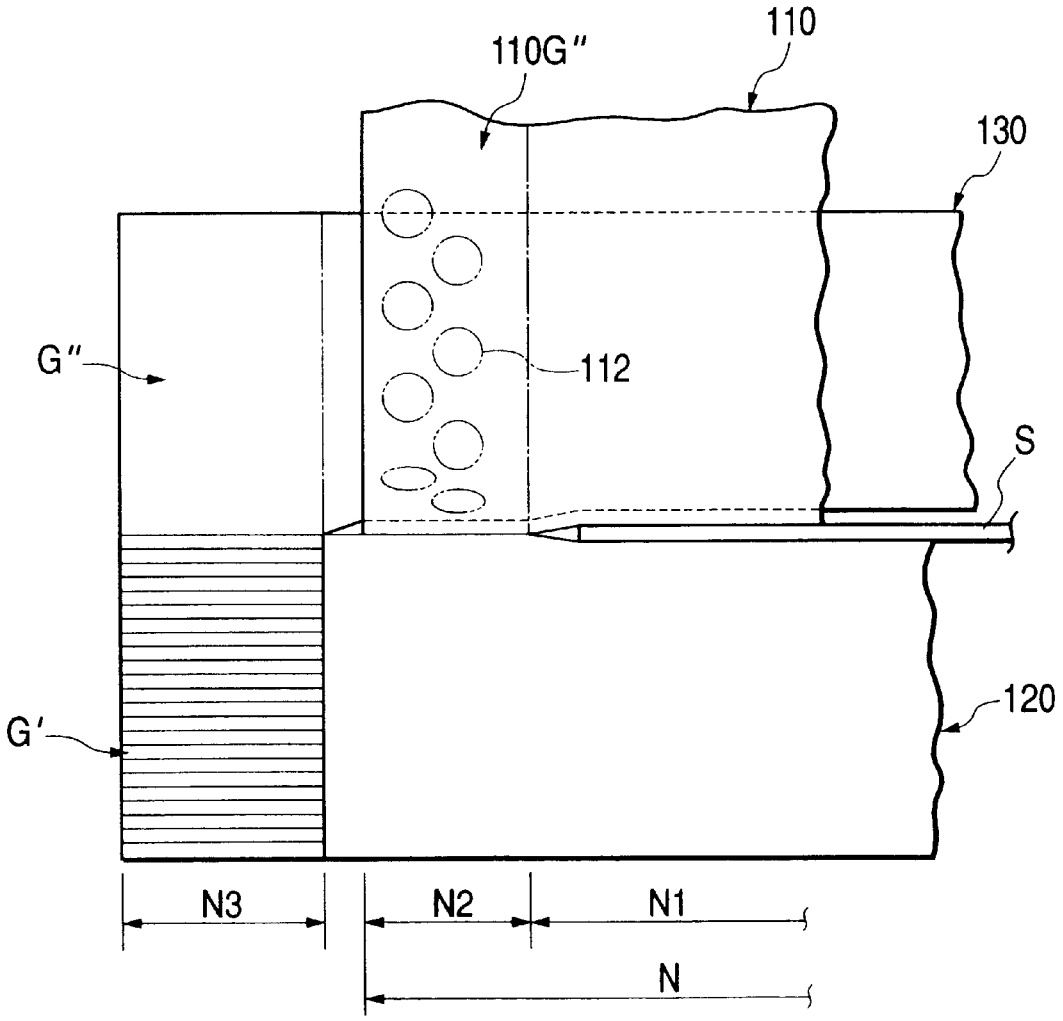
FIG. 7 is a fragmentary side view showing a major portion of a fixing device 100 which is a third embodiment of the present invention.

FIG. 7 is a side view schematically showing a major portion of a fixing device 100 in a third embodiment of an image forming apparatus according to the present invention. In the figure, like or equivalent portions are designated by like reference numerals used in the first embodiment.

A major feature of the third embodiment resides in that the pressure application roller 120 and the backup roller 130 are each wider than the endless belt 110, and that a high grip portion G' is formed at a portion N3 of the pressure application roller 120 which is not pressed by the recording medium S but pressed by the backup roller 130. A basic construction of the fixing device 100 and a construction of the image forming apparatus in the third embodiment are substantially the same as in the first embodiment. The high grip portions G' are preferably provided on both the side ends of the pressure application roller 120, although only one side end of the pressure application roller 120 is illustrated in FIG. 7. In the present embodiment, the high grip portions G' are provided on both the side ends of the pressure application roller.

Figure 5:
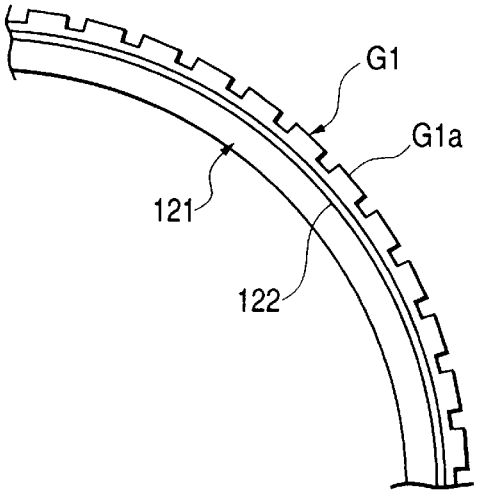
Figure 5:
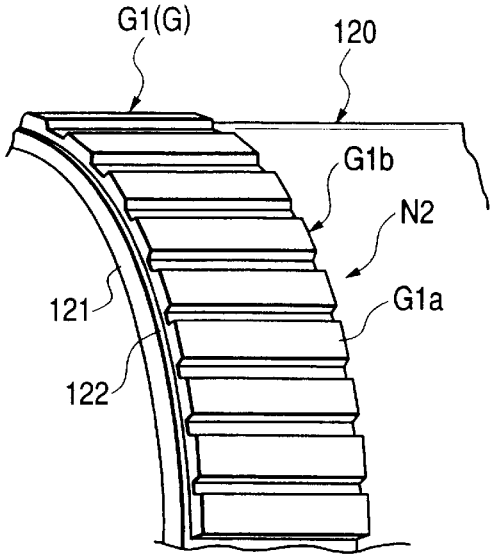
Figure 5:
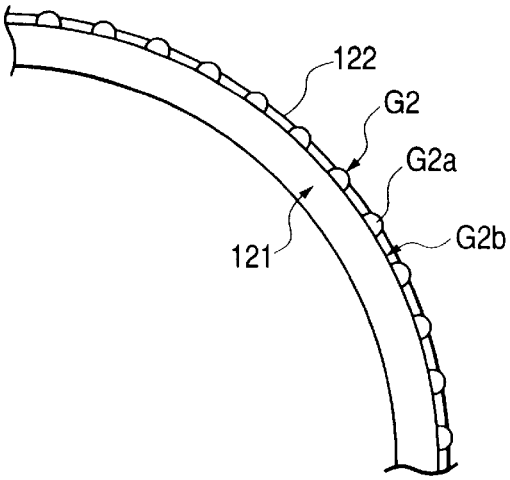
Figure 5:
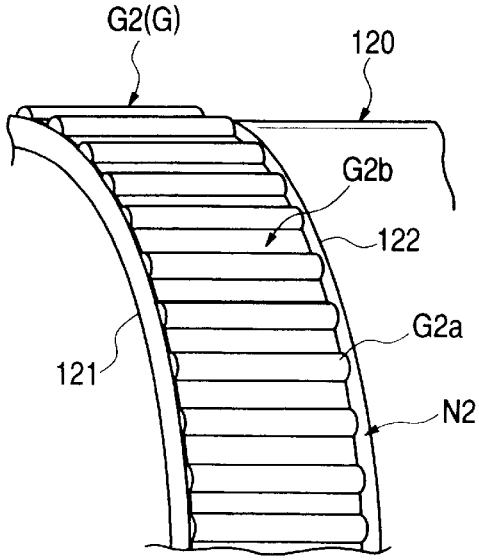

The high grip portion G' may take a proper construction, and may take, for example, any of the high grip portions described in connection with FIGS. 5 and 6.

Also in this embodiment of the image forming apparatus, as in the first embodiment, a toner image is formed on a recording medium S, the recording medium S having the toner image formed thereon passes through the press contact portion N (a part N1 of the press contact portion N in this embodiment) in the fixing device 100, whereby the toner image is fused and fixed on the recording medium S.

The high grip portion G' is provided at a portion N3 of the pressure application roller 120 which is not pressed by the recording medium S but pressed by the backup roller 130. Therefore, when a recording medium S, which relatively easily slips, is supplied to the press contact portion N1 between the endless belt 110 and the pressure application roller 120, and as a result, when a slip will occur between the pressure application roller 120 of the drive side and the recording medium S and/or the recording medium S and the endless belt 110 of the follower side, the endless belt 110 and the pressure application roller 120 rotate at substantially equal peripheral speeds since the follower action of the endless belt 110 of the follower side for the pressure application roller 120 of the drive side is enhanced through the action of the high grip portion G'.

This will be described in detail hereunder.

When the pressure application roller 120 is driven, its drive force is transmitted to the endless belt 110 pressed against the pressure application roller 120, and is also transmitted to the backup roller 130 through the high grip portion G'. Further, the drive force is transmitted from the backup roller 130 to the endless belt 110 at a position on the endless belt 110 where it is put on the backup roller 130. That is, the drive force derived from the pressure application roller 120 is transmitted tot he endless belt 110 by way of two routes. When the endless belt 110 is driven (the endless belt 110 is driven by the backup roller 130 or the heating roller 140), its drive force is transmitted to the pressure application roller 120 which is pressed against the endless belt 110, and also is transmitted to the backup roller 130 which follows the endless belt 110 in rotation. And it is transmitted to the pressure application roller 120 through the high grip portion G'. Also in this case, the drive force from the endless belt 110 is transmitted to the pressure application roller 120 by way of two routes.

In a case where the pressure application roller 120 is driven and also in a case where the endless belt 110 is driven, the follower action of the endless belt 110 (pressure application roller 120) of the follower side for the pressure application roller 120 (or the endless belt 110) of the drive side is enhanced through the action of the high grip portion G'. Therefore, even when the recording medium S, which relatively easily slips, is fed to the press contact portion N, the endless belt 110 and the pressure application roller 120 rotate at substantially equal peripheral speeds.

The slip is prevented (at least its occurrence is extremely less frequent). As a result, the fixing operation of the fixing device is stable. Accordingly, the toner image on the recording medium S is little blurred, so that the resultant image is little disarranged.

In the image forming apparatus of the embodiment, the high grip portion G' is provided on the pressure application roller 120. Because of this, even when the toner images are formed on both sides of the recording medium S or the full color image, which is formed by superimposing the plurality of different colors, is formed on the recording medium S, the slip does not occur (at least its occurrence is extremely infrequent), and as a result, a fixing operation of the fixing device is stable.

Thus, also in the image forming apparatus of the embodiment, it is possible to form a full color image suffering from no (at least little) image disarrangement, which suffering no (at least little) image disarrangement, on both sides of the recording medium S.

The high grip portions G' are each provided at the portion of the endless belt which is not in pressing contact with the recording medium S. Therefore, the high grip portions do not have any adverse effect on the recording medium S and the image on the recording medium S.

Fourth Embodiment

A difference of a fourth embodiment of the present invention from the third embodiment resides in that as shown in FIG. 7, instead of providing a high grip portion G' on the pressure application roller 120 (or in addition to providing it on the endless belt), a high grip portion G" is provided on a portion (N3) of the backup roller 130 which is pressed by the pressure application roller. The remaing construction of the fourth embodiment is substantially the same as of the third embodiment. The high grip portions G" are preferably provided on both the side ends of the backup roller 130, although only one side end of the backup roller 130 is illustrated in FIG. 7. In this embodiment, the high grip portions G" are provided on both the side ends of the backup roller.

The high grip portion G" may take a proper construction, and may take, for example, any of the high grip portions described in connection with FIGS. 5 and 6.

The operation of and the advantageous effects produced by the image forming apparatus of this embodiment are similar to and comparable with those in the third embodiment.

Fifth Embodiment

A difference of a fifth embodiment of the present invention from the third or fourth embodiment resides in that, as shown in FIG. 7, the high grip portions G' and/or G" are provided on the pressure application roller 120 and/or the backup roller 130, and that a high grip portion 110G", which acts on the backup roller 130, is provided at the reverse side of a portion N2 of the endless belt 110 which is not pressed by the recording medium S. The remaing construction of the fifth embodiment is substantially the same as of the third or fourth embodiment. Although only one side end of the endless belt 110 is illustrated in FIG. 7, the high grip portions 110G" are provided on both the side ends of the endless belt.

The high grip portion 110G may take a proper construction, and may take, for example, any of the constructions of the high grip portion 110G or 110G' which were described in connection with FIGS. 3 and 4.

The operation of and the advantageous effects produced by the image forming apparatus of this embodiment are similar to and comparable with those in the third embodiment.

Further, in the embodiment, power transmission between the endless belt 110 and the backup roller 130 is further improved since the high grip portion 110G", which acts on the backup roller 130, is provided at the reverse side of a portion N2 of the endless belt 110 which is not pressed by the recording medium S.

With the operation of the high grip portion G' and/or G", the follower action of the endless belt 110 (or the pressure application roller 120) of the follower side for the pressure application roller 120 (or the endless belt 110) of the drive side is further enhanced. As a result, the fixing device operates more stably. Accordingly, a chance of the blurring of the toner image on the recording medium S is more lessened, and as a result, the resultant image is further improved in its quality.

Sixth Embodiment

Figure 8:
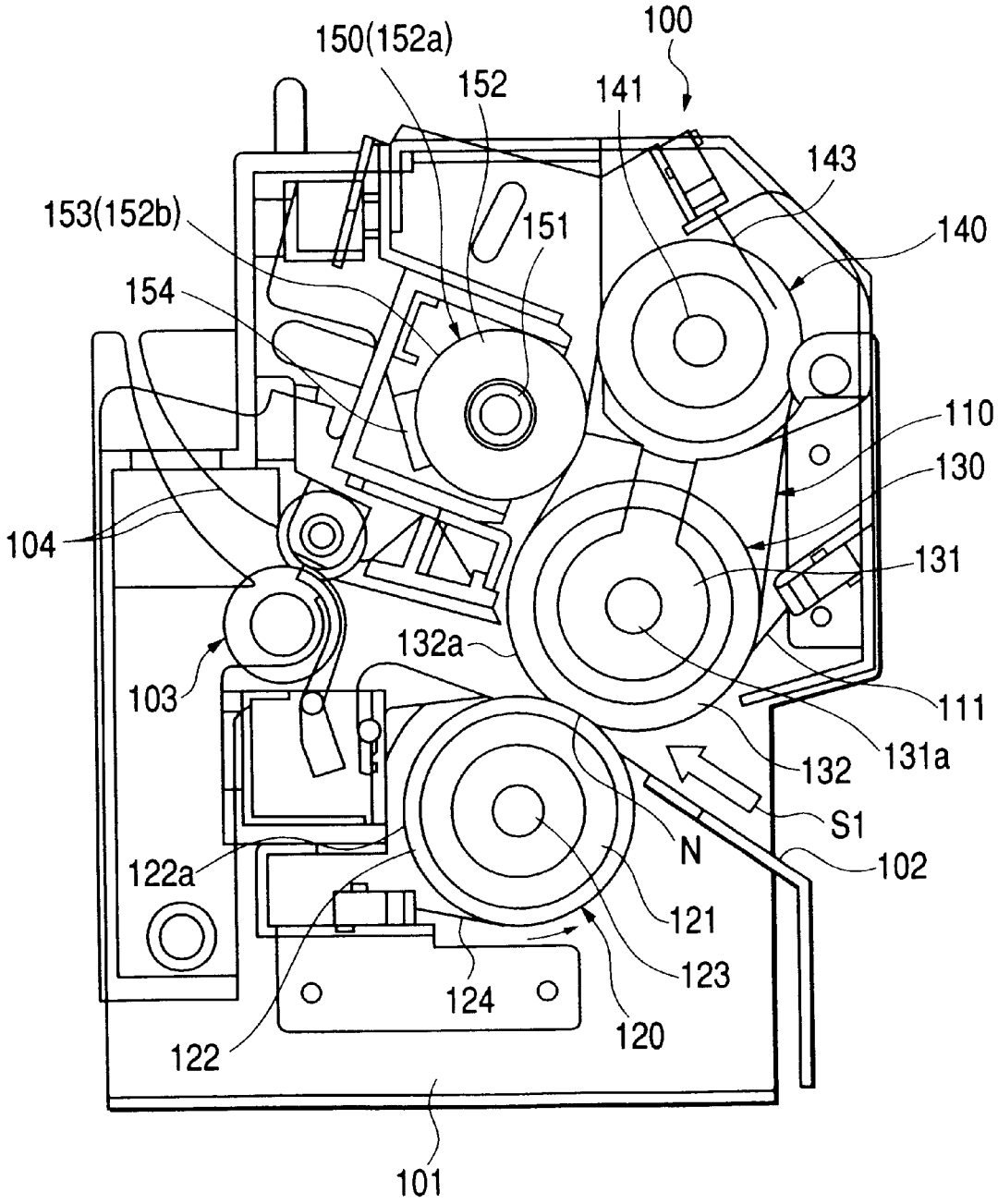
FIG. 8 is a view showing a fixing device 100 which is a sixth embodiment of the present invention.
Figure 9:
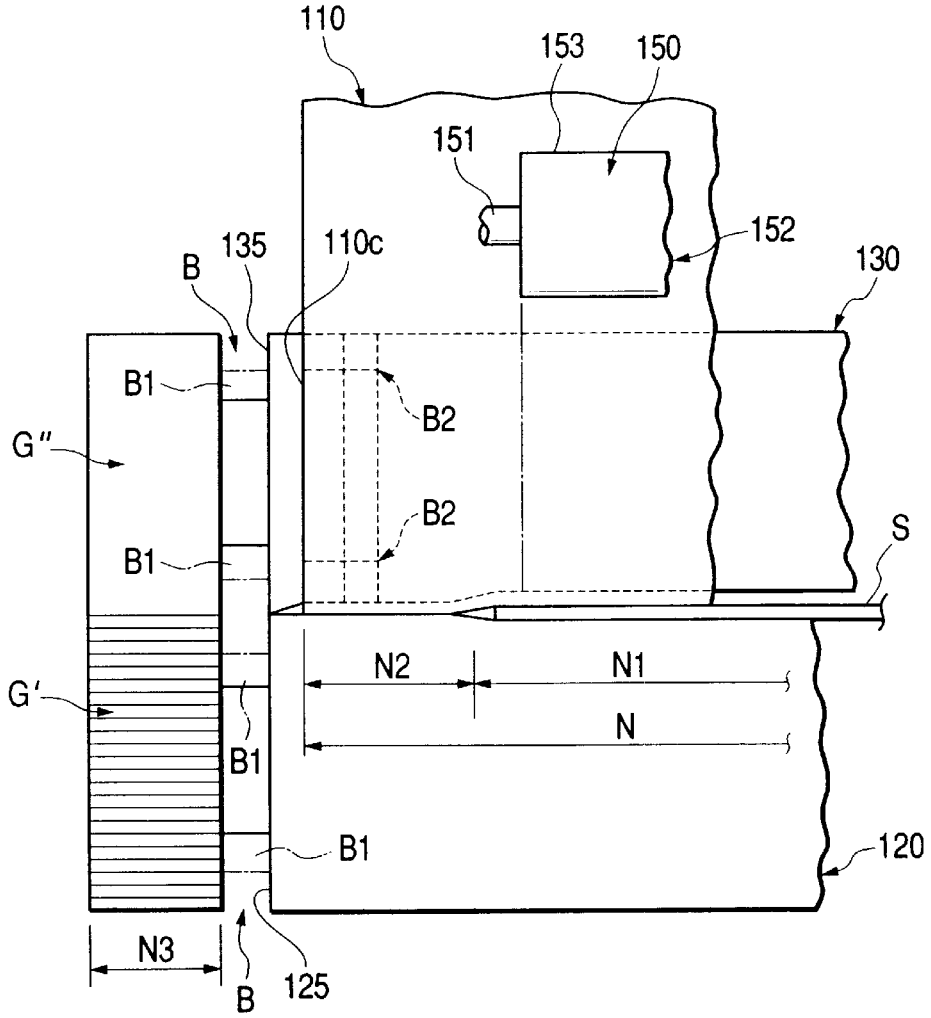
FIG. 9 is a fragmentary side view showing a major portion of the fixing device 100.

FIG. 8 is a view schematically showing a fixing device 100 in a sixth embodiment of an image forming apparatus according to the present invention. FIG. 9 is a side view showing a major portion of the fixing device. In those figures, like or equivalent portions are designated by like reference numerals in the first embodiment.

This embodiment is different from the above-mentioned embodiments in that an oil roller 150 as oil coating mechanism for applying release oil onto the surface of the endless belt 110, and that an oil barrier B is provided on the backup roller 130 at a portion thereof between a contact portion N of the backup roller where it is brought into contact with the endless belt 110 and a portion N3 of the backup roller where it is not brought into contact with the endless belt 110 but is pressed by the pressure application roller 120. The remaing construction of the embodiment is substantially the same as the above-mentioned embodiment.

The oil roller 150 includes a shaft 151 and a thick, oil holder layer 152 fastened around the shaft 151. The oil holder layer 152 is made of porous material or fibrous material. The oil holder layer 152 is impregnated with release oil. In order to secure a uniform coating of oil, the surface of the oil holder layer 152 is coated with a thin film sheet having an oil permeability, such as a porous PTFE sheet 153.

The oil roller 150 is pressed against the endless belt 110 by an appropriate urging mechanism (not shown), and it is rotated in a follower manner to apply release oil, such as silicone oil, onto the surface of the endless belt 110. In FIG. 8, reference numeral 154 designates a cleaning member made of felt or the like, for cleaning the surface of the oil roller 150. The cleaning member 154 is pressed against the surface of the oil roller 150.

In this embodiment, as shown in FIG. 9, the oil roller 150 is shorter width than the endless belt 110, and the release oil is applied to within only the press contact portion N1 of the endless belt 110 where it is brought into contact with the recording medium S. The width of the press contact portion N3 of the endless belt 110, which is coated with the release oil by the oil roller 150, is longer than the width of the maximum image forming area on the recording medium S.

The oil barrier B may appropriately be constructed. In the embodiment, it takes the form of a ring-like groove 135 formed around the backup roller 130. A ring-like groove 125, which is formed around the pressure application roller 120, also constitutes the oil barrier B. The ring-like groove 125 forms an oil barrier provided between the press contact portion N of the pressure application roller 120 where it is pressed against the endless belt 110 and the portion N3 of the pressure application roller 120 which is not brought into contact with the endless belt 110 but pressed by the backup roller 130. An oil absorbing member (e.g., a ring-like member made of felt) is preferably provided within each of the ring-like grooves 135 and 125 in order to absorb the oil having flowed into the groove.

In the present embodiment, an oil barrier B2 is provided at a portion of the backup roller 130 which faces the side end 110*c* of the endless belt 110.

Figure 10:
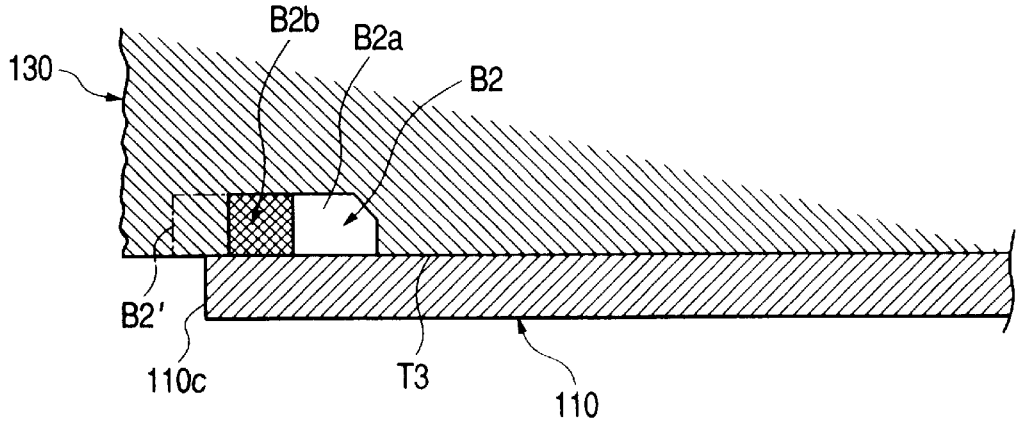
FIG. 10 is a fragmentary, enlarged view showing an oil barrier B2.

FIG. 10 is an enlarged cross sectional view showing the oil barrier B2.

The oil barrier B2 includes a ring-like groove B2*a* formed at a portion of the backup roller 130 which faces the side end 110*c* of the endless belt 110, and an oil absorbing member B2*b* (e.g., a ring-like member made of felt) located within the groove B2*a*. The groove B2*a* is also provided preferably at each of both side ends of the backup roller 130.

The width of the oil barrier B2 may be widened outside beyond the side end 110*c* of the endless belt 110 as indicated by a phantom line B2' in FIG. 10. In this case, the widened has a function equivalent to that of the oil barrier B, which is provided on the backup roller 130 at a portion thereof between the contact portion N of the backup roller where it is brought into contact with the endless belt 110 and the portion N3 of the backup roller where it is not brought into contact with the endless belt 110 but is pressed by the pressure application roller 120.

A high grip portion G' and/or a high grip portion G" are preferably provided at the press contact portion N3 of at least one of the pressure application roller 120 and the backup roller 130. In this embodiment, the high grip portion G' (G1) shown in FIG. 5A1 is provided on the pressure application roller 120, and the high grip portion G" (G2) shown in FIG. 6A1 is provided on the backup roller 130. In FIG. 9. The high grip portions G' and G" are preferably provided on both the side ends of the rollers, although only one end of each of the rollers including the pressure application roller 120 is illustrated.

The image forming apparatus of the sixth embodiment of the invention operates in the following ways and produces the following useful effects.

(a) A toner image is formed on the recording medium S. The recording medium S having the toner image formed thereon passes through the press contact portion N of the fixing device 100 having the following construction. The toner image on the recording medium is fused and fixed on the recording medium S. The fixing device 100 includes the endless belt 110 to be heated, the pressure application roller 120 as a rotary member to be in pressing contact with the endless belt 110, the width of the pressure application roller 120 being longer than that of the endless belt 110, and the backup roller 130 for supporting the endless belt 110 on the inner side thereof at its press contact portion N, the width of the backup roller being longer than that of the endless belt 110, wherein the pressure application roller 120 is driven and the endless belt 110 circulates in a follower fashion.

In the embodiment, an offset phenomenon is unlikely to occur since the oil roller 150 as the oil coating mechanism for applying the release oil onto the surface of the endless belt 110 is provided.

Further, it is noted that the oil barrier B is provided on the backup roller 130 at a portion thereof between a contact portion N of the backup roller where it is brought into contact with the endless belt 110 and a portion N3 of the backup roller where it is not brought into contact with the endless belt 110 but is pressed by the pressure application roller 120 (N3: corresponds to the end N' of the press contact portion N described in connection with FIG. 12). When the release oil having been applied to the surface of the endless belt 110 will flow into the "portion N3 of the backup roller where it is not brought into contact with the endless belt 110 but is pressed by the pressure application roller 120", its flow is blocked by the oil barrier B (at least its little flow into the portion is permitted.).

For this reason, a gripping force is sufficiently secured between the backup roller 130 and the pressure application roller 120 at the portion N3, so that the endless belt 110 and the pressure application roller 120 turn at substantially the equal peripheral speeds (The reason why the endless belt 110 and the pressure application roller 120 turn at substantially the equal peripheral speeds when a gripping force is sufficiently secured between the backup roller 130 and the pressure application roller 120 is as stated in the operation description of the third embodiment.).

In the image forming apparatus of this embodiment, when a slip will occur between the pressure application roller 120 of the drive side (or the endless belt 110) and the recording medium S and/or the recording medium S and the endless belt 110 of the follower side (or the pressure application roller 120), the slip is prevented (at least its occurrence is extremely infrequent.) although such a construction is employed that the release oil is applied to the endless belt 110, and as a result, a stable fixing operation of the fixing device is performed. Accordingly, the toner on the recording medium is little blurred, and hence the resultant image is little disarranged.

(b) The oil barrier B is also provided between the press contact portion N of the pressure application roller 120 where it is pressed against the endless belt 110 and the portion N3 of the pressure application roller 120 which is not brought into contact with the endless belt 110 but pressed by the backup roller 130. The presence of the oil barrier B prevents such a situation that the release oil is applied to the endless belt 110, and the oil that has been transferred to the contact portion N of the pressure application roller 120 where it is brought into contact with the endless belt 110 moves to the portion N3 of the pressure application roller 120 (at least occurrence of such a situation is extremely infrequent.).

Accordingly, a gripping force is more sufficiently secured between the backup roller 130 and the pressure application roller 120 at the portion N3, so that a more stable fixing operation of the fixing device is performed. Accordingly, the toner on the recording medium is little blurred, and hence the resultant image is little disarranged. Accordingly, the toner image on the recording medium S is little blurred, so that the resultant image is little disarranged.

(c) The oil barrier B2 is provided at a portion of the Backup roller 130, which faces the side end 110*c* of the endless belt 110. Therefore, if the release oil that has applied to the surface of the endless belt 110 will move from the side end 110*c* of the endless belt 110 to a nip T3 between the endless belt 110 and the backup roller 130, movement of the release oil to the nip is blocked by the oil barrier B2 that is located at the portion of the backup roller, which faces the side end 110*c* of the endless belt 110 (at least the movement of the release oil to the nip is extremely impeded.).

Accordingly, a necessary friction force between the endless belt 110 and the backup roller 130 is secured, and hence a power transmission from the pressure application roller 120 to the backup roller 130 and then the endless belt 110 is also secured. Consequently, the follower action of the endless belt 110 and the pressure application roller 120 is also enhanced. And the endless belt 110 and the pressure application roller 120 turn at substantially equal periphery speeds.

Thus, in the image forming apparatus of this embodiment, a more stable fixing operation of the fixing device is performed although the endless belt 110 is coated with the release oil.

(d) The high grip portion G' is provided at the portion N3 of the pressure application roller 120. Provision of the high grip portion G' improves the follower action of the pressure application roller 120 and the backup roller 130, and hence the follower action of the endless belt 110 and the pressure application roller 120. As a result, a more stable fixing operation of the fixing device is performed.

(e) The high grip portion G' is provided at the portion N3 of the backup roller 130. With provision of the high grip portion G", the follower action of the pressure application roller 120 and the backup roller 130 is further improved, and hence the follower action of the endless belt 110 and the pressure application roller 120 is also so done. This leads to a more stable fixing operation of the fixing device.

(f) The release oil, which is applied by the oil roller 150, is applied to within only the contact portion N1 of the endless belt 110 where it is brought into contact with the recording medium S. Therefore, the applied oil is almost all absorbed by or transferred to the recording medium S when the recording medium S passes therethrough.

Accordingly, there is little chance that the release oil flows to the non-contact portions not in contact with the recording medium S, i.e., (1) the contact portion N3 between the pressure application roller 120 and the backup roller 130 in the non-contact portion not in contact with the endless belt 110 and (2) the nip T3 between the endless belt 110 and the backup roller 130. As a result, a more stable fixing operation of the fixing device is performed.

(g) The image forming apparatus of this embodiment, like the first embodiment, is designed to be capable of forming toner images on both sides of the recording medium S. Therefore, sometimes, the recording medium S having toner images T on both sides thereof passes through a part N1 of the press contact portion N in the fixing device 100.

As described, there is a case that the toner on the recording medium S reduces the friction coefficient between the recording medium S and the rotary member. Therefore, in a case where the toner images T are formed on both sides of the recording medium S, the recording medium is more likely to slip when comparing with a case where the toner image is formed on one side of the recording medium.

In this connection, it is noted that the oil barrier B is provided on the backup roller 130 in the image forming apparatus of this embodiment. Therefore, the recording medium S is unlikely to slip even when toner images are formed on both sides of the recording medium S (at least a chance of its slipping is remarkably reduced.). As a result, a stable fixing operation of the fixing device is ensured.

Thus, the image forming apparatus of the embodiment can form images free from (at least with little) image disarrangement on both sides of the recording medium S.

(h) The image forming apparatus of the embodiment, like That of the first embodiment, is capable of forming a full color image formed by superimposing a plurality of different colors. Therefore, there is a case that a recording medium S having a full color image formed on at least one side thereof passes through the part N1 of the press contact portion N in the fixing device 100.

As described above, there is a case that the toner on the recording medium S reduces the friction coefficient between the recording medium S and the rotary member. Therefore, in a case where the full color image by superimposing a plurality of different colors is formed on the recording medium S, the recording medium S is more likely to slip when comparing with a case where the toner image of monochromatic color is formed on the recording medium.

In this connection, it is noted that the oil barrier B is provided on the backup roller 130 in the image forming apparatus of this embodiment. Therefore, the recording medium S is unlikely to slip even when a full color image by superimposing a plurality of different colors is formed on the recording medium S (at least a chance of its slipping is remarkably reduced.). As a result, a stable fixing operation of the fixing device is ensured.

Thus, the image forming apparatus of the embodiment can form a full color image free from (at least with little) image disarrangement on the recording medium S.

Seventh Embodiment

Figure 11:
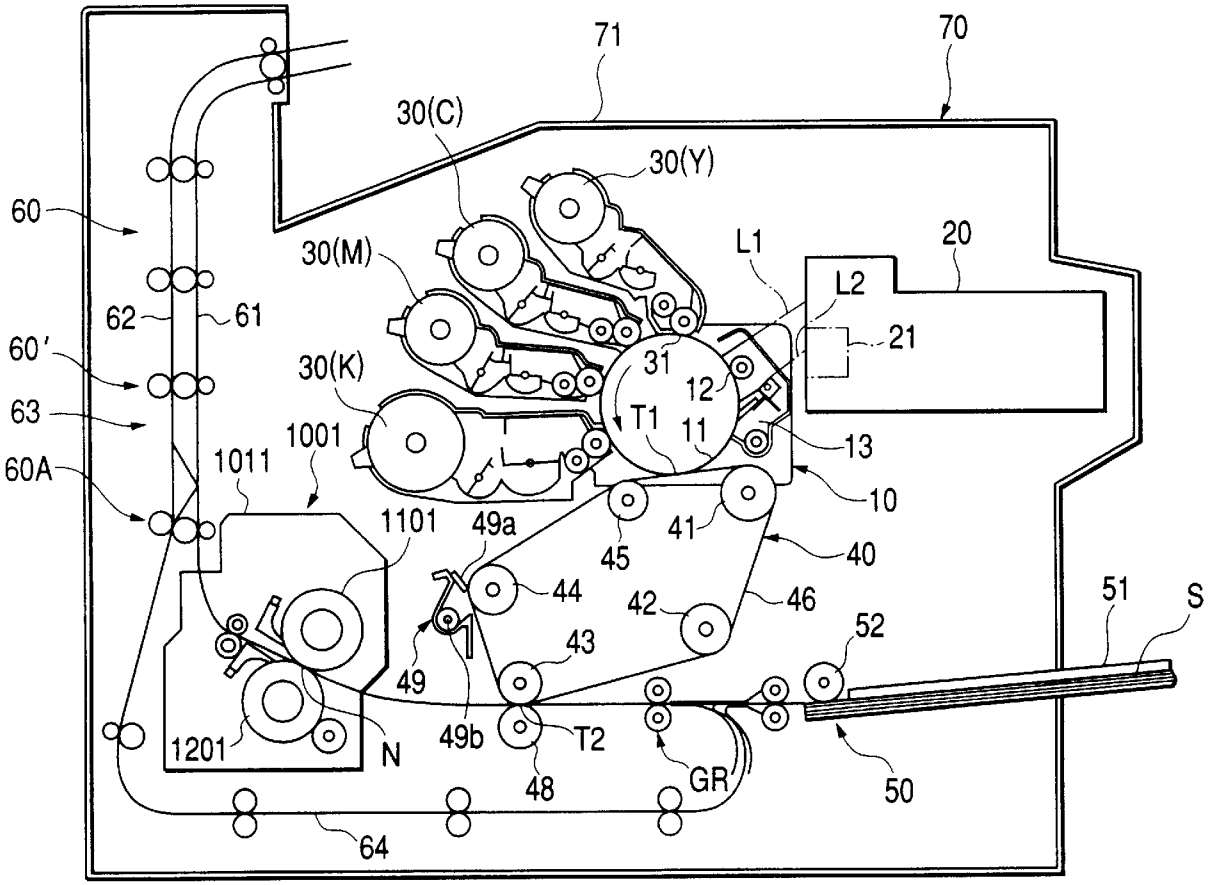
FIG. 11 is a view showing a seventh embodiment of the present invention.

FIG. 11 is a side view schematically showing an image forming apparatus which is a seventh embodiment of the present invention.

The image forming apparatus of this embodiment is different from that of the first embodiment in that the fixing device 100 (FIG. 1) is substituted by a fixing device 1001. The remaing construction of the seventh embodiment is substantially the same as of the first embodiment.

Figure 12:
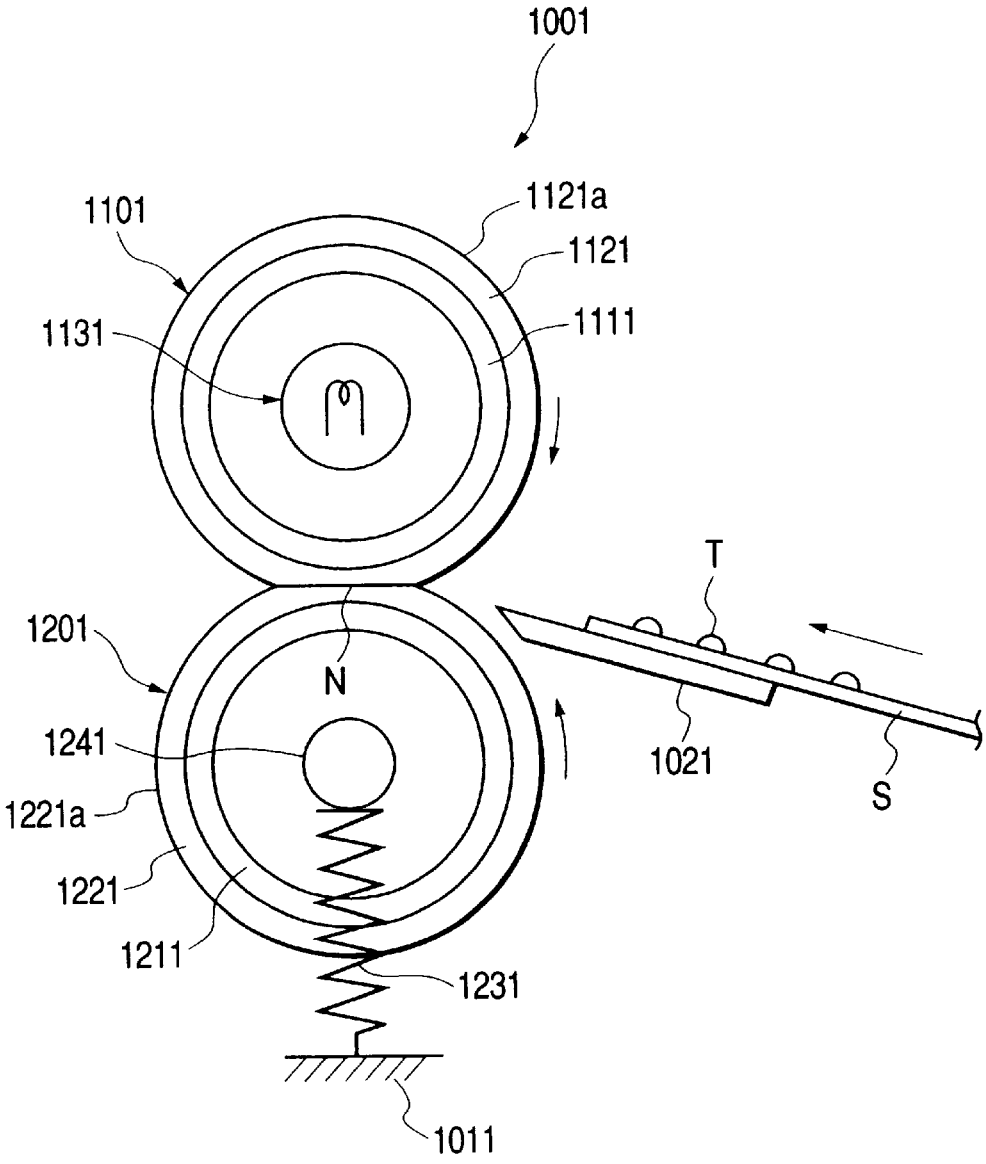
FIG. 12 is a diagram schematically showing a major portion of a fixing device 1001.
Figure 13:
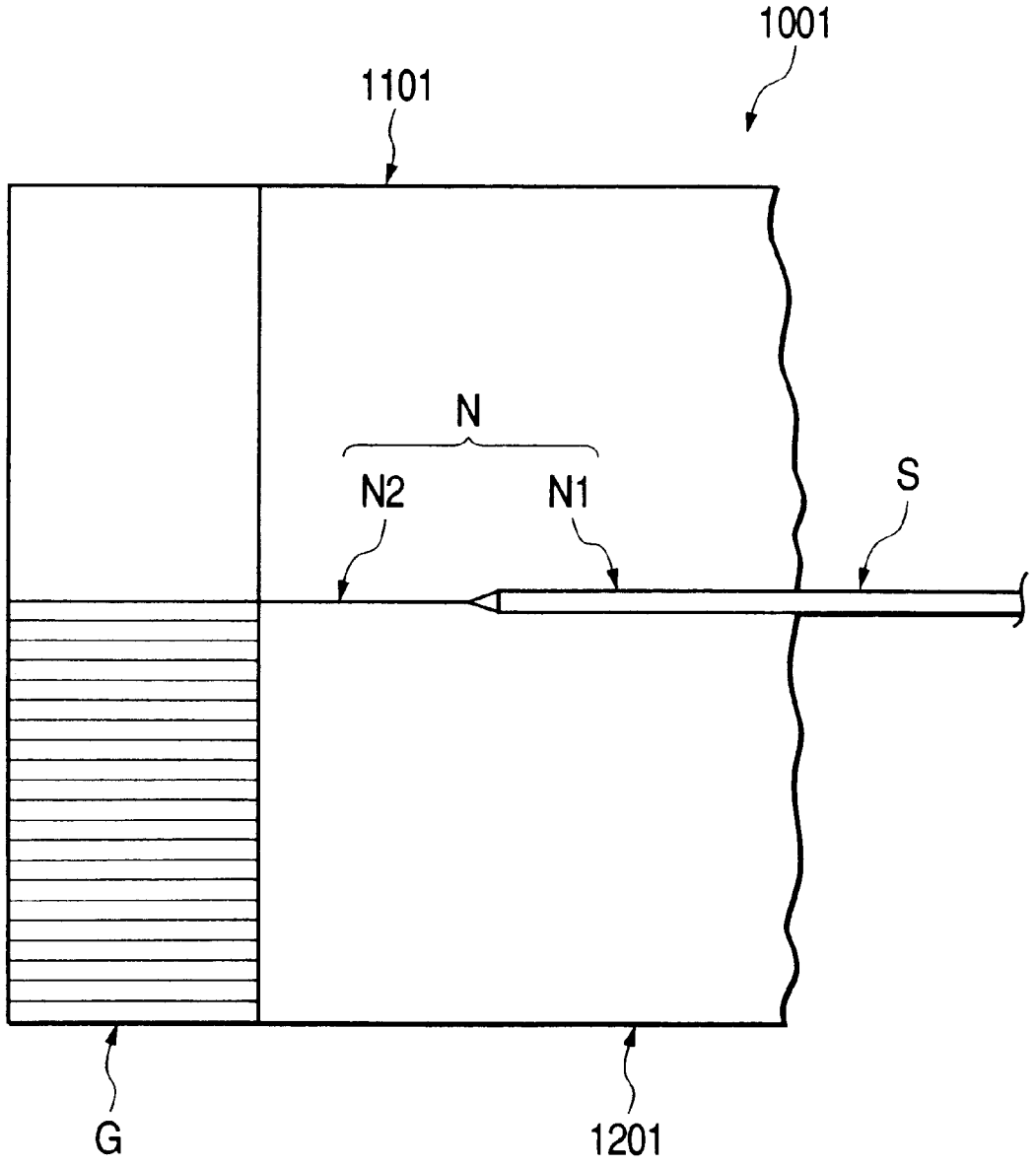
FIG. 13 is a side view showing the right side portion in FIG. 12.

FIG. 12 is a diagram schematically showing a major portion of the fixing device 1001, and FIG. 13 is a diagram showing a right side of a portion of the fixing device shown in FIG. 12.

The fixing device 1001 includes a heating roller (fixing roller) 1101 with a heat source as a first rotary member, and an pressure application roller 1201 as a second rotary member which is pressed against the heating roller 1101. A recording medium S passes through a part N1 (usually a central part as viewed in the axial direction) of a press contact portion N between the endless belt 110 and the pressure application roller 120. When passing therethrough, it is compressed by the belt and roller while being heated, whereby the toner image is fused and permanently fixed on the recording medium S.

The heating roller 1101 is formed with a pipe-like core member 1111 having a good thermal conductivity, an elastic layer 1121 which is formed on the surface of the core member 1111, and a surface belt layer 1121*a* which is formed on a surface of the elastic layer 1121 and well separable from the recording member and toner. A halogen lamp 1131 as a heat source is disposed within the core member 1111.

The pressure application roller 1201 is formed with a pipe-like core member 1211 having a good thermal conductivity, an elastic layer 1221 which is formed on the surface of the core member 1211, and a surface belt layer 1221*a* which is formed on a surface of the elastic layer 1221 and well separable from the recording member and toner.

The pressure application roller 1201 is pressed against the heating roller 1101 by an appropriate urging mechanism 1231 (see FIG. 1), and rotates in a follower fashion. Reference numeral 1241 designates a shaft 1241 of the pressure application roller 1201.

A frame 1011 is provided with a guide 1021 which guides a recording medium S with a toner image T formed transferred) thereon at a secondary transfer portion T2 to a press contact portion (nip) N between the heating roller 1101 and the pressure application roller 1201.

One of the features of the present embodiment resides in that a high grip portion G is provided at a portion N2 of one of both the rotary members, i.e., the heating roller 1101 and the pressure application roller 1201, which is not pressed by the recording medium S but pressed by the other rotary member.

In this embodiment, as shown in FIG. 13, the high grip portion G is provided at the side end of the pressure application roller 1201. The high grip portion G may be provided on the heating roller 1101 or both the heating roller 1101 and the pressure application roller 1201.

The high grip portion G is preferably provided on both the side ends of the rotary member, although only one side end of the rotary member is illustrated in FIG. 13. In the present embodiment, the high grip portions G are provided on both the side ends of the rotary member.

The high grip portion G may take a proper construction, and may take, for example, any of the high grip portions described in connection with FIGS. 5 and 6.

The image forming apparatus of the seventh embodiment of the invention operates in the following ways and produces the following useful effects.

(a) A toner image T is formed on a recording medium S. The recording medium S having the toner image T passes through a part N1 (see FIG. 3) of the press contact portion N in the fixing device 1001. As already stated, the fixing device 1001 is formed with the heating roller 1101 as a first rotary member to be heated and the pressure application roller 1201 as a second rotary member to be pressed against the heating roller 1101. Of those rollers, the heating roller 1101 is driven, and the pressure application roller 1201 follows the heating roller 1101 in rotation.

Further, in this embodiment, the high grip portion G is provided at the portion N2 of at least one of both the rotary members, which is the pressure application roller 1201 in this embodiment, which is not pressed by the recording medium S but pressed by the other rotary member (heating roller 1101). Therefore, when a recording medium S, which relatively easily slips, is supplied to the part N1 of the press contact portion N between the two rotary members, and as a result, when a slip will occur between the heating roller 1101 as the rotary member of the drive side and the recording medium S and/or the recording medium S and the pressure application roller 1201 as the rotary member of the follower side, both the rotary members 1101 and 1201 rotate at substantially equal peripheral speeds since the follower action of the pressure application roller 1201 of the follower side for the heating roller 1101 as the rotary member of the drive side is enhanced through the action of the high grip portion G. The slip is prevented (at least its occurrence is extremely infrequent). As a result, the fixing operation of the fixing device is stable. Accordingly, the toner image on the recording medium S is little blurred, so that the resultant image is little disarranged.

The high grip portions G are each provided at the portion which is not in pressing contact with the recording medium S. Therefore, the high grip portions do not have any adverse effect on the recording medium S and the image on the recording medium S.

(b) The image forming apparatus is designed so as to be capable of forming toner images on both sides of the recording medium S. Therefore, there is a case that a recording medium S having toner images on both sides thereof passes through the part N1 of the press contact portion N in the fixing device 1001.

As described, there is a case that the toner on the recording medium S reduces the friction coefficient between the recording medium S and the rotary member. Therefore, in a case where the toner images T are formed on both sides of the recording medium S, the recording medium is more likely to slip when comparing with a case where the toner image is formed on one side of the recording medium.

In this connection, it is noted that the high grip portion G is provided at the portion N2 of at least one of both the rotary members 1101 and 1201, which is not pressed by the recording medium but pressed by the other rotary member. Therefore, the recording medium S is unlikely to slip even when toner images T are formed on both sides of the recording medium S (at least a chance of its slipping is remarkably reduced.). As a result, a stable fixing operation of the fixing device is ensured.

Thus, the image forming apparatus of this embodiment is capable of forming images suffering from no (at least little) image disarrangement on both sides of the recording medium S.

(c) The image forming apparatus of the embodiment is capable of forming a full color image formed by superimposing a plurality of different colors. Therefore, there is a case that a recording medium S having a full color image formed on at least one side thereof passes through the part N1 of the press contact portion N in the fixing device 1001.

As described above, there is a case that the toner on the recording medium S reduces the friction coefficient between the recording medium S and the rotary member. Therefore, in a case where the full color image by superimposing a plurality of different colors is formed on the recording medium S, the recording medium S is more likely to slip when comparing with a case where the toner image of monochromatic color is formed on the recording medium.

In this connection, it is noted that the high grip portion G is provided at the portion N2 of at least one of both the rotary members 1101 and 1201, which is not pressed by the recording medium but pressed by the other rotary member. Therefore, the recording medium S is unlikely to slip even when a full color image by superimposing a plurality of different colors is formed on the recording medium S (at least a chance of its slipping is remarkably reduced.). As a result, a stable fixing operation of the fixing device is ensured.

Thus, the image forming apparatus of this embodiment is capable of forming a full color image suffering from no (at least little) image disarrangement, and full color images suffering from no (at least little) image disarrangement on both sides of the recording medium S.

Eighth Embodiment

Figure 14:
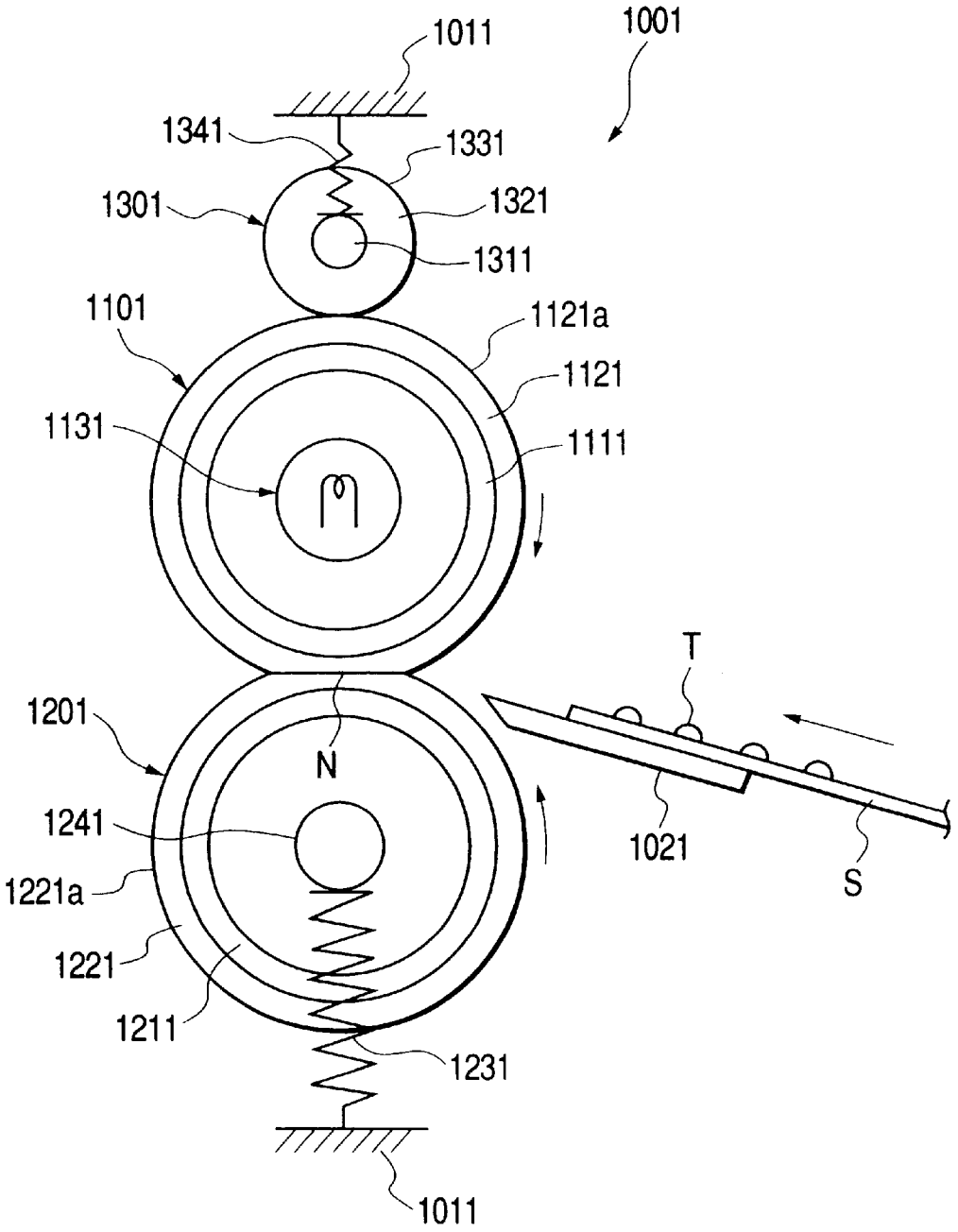
FIG. 14 is a diagrammatic view schematically showing a major portion of a fixing device 1001 which is an eighth embodiment of the present invention.
Figure 15:
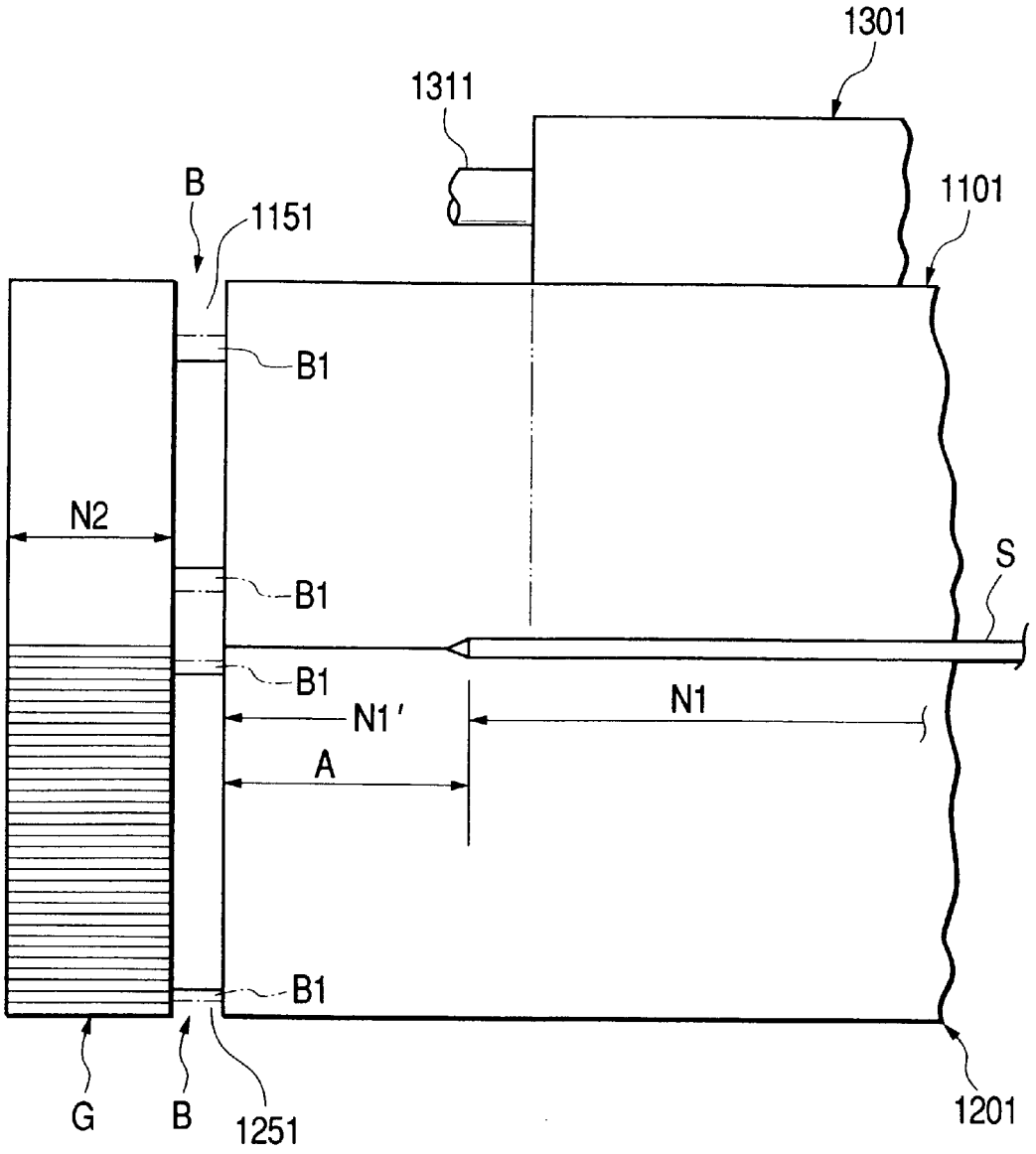
FIG. 15 is a side view showing the right side portion in FIG. 14.

FIG. 14 is a diagram schematically showing a major portion of the fixing device 1001 in the eighth embodiment of the present invention, and FIG. 15 is a diagram showing a right side of a portion of the fixing device shown in FIG. 14.

In those figures, like or equivalent portions are designated by like reference numerals used in the seventh embodiment.

The eighth embodiment of the present invention is different from the seventh embodiment in that an oil roller 1301 as an oil coating mechanism is provided which applies release oil to a contact portion N1 of the heating roller 1101 where it is brought into contact with the recording medium S, and an oil barrier B is provided between the contact portion N1 of the heating roller 1101 as a rotary member to be coated with the release oil by the oil roller 1301 and a portion N2 of it where it is not in contact with the recording medium S but is pressed by the pressure application roller 1201 as another rotary member. The remaing construction of the eighth embodiment is substantially the same as of the seventh embodiment.

In this embodiment, the contact portion N1 of the heating roller where it is in contact with the recording medium S is separated from the oil barrier B by a distance A. However, the separation of the distance A is not essential in this embodiment. If required, the contact portion N1 may be extended to a position near the oil barrier B, as indicated by N1' in FIG. 15.

The oil roller 1301, as shown in FIG. 14, includes a shaft 1311 and a thick, oil holder layer 1321 fastened around the shaft 1311. The oil holder layer 1321 is made of porous material or fibrous material. The oil holder layer 1321 is impregnated with release oil. In order to secure a uniform coating of oil, the surface of the oil holder layer 1321 is coated with a thin film sheet having an oil permeability, such as a porous PTFE sheet 1331.

The oil roller 1301 is pressed against the heating roller 1101 by an appropriate urging mechanism (not shown), and it is rotated in a follower manner to apply release oil, such as silicone oil, onto the surface of the heating roller 1101. In this embodiment, as shown in FIG. 15, the oil roller 1301 is shorter in width than the heating roller 1101, and the release oil is applied to only the contact portion N1 of the heating roller where it is brought into contact with the recording medium S. The width of the contact portion of it, which is coated with the release oil by the oil roller 1301, is longer than the width of the maximum image forming area on the recording medium S.

The oil barrier B may appropriately be constructed. In the embodiment, it takes the form of a ring-like groove 1151 formed around the heating roller 1101. A ring-like groove 1251, which is formed around the pressure application roller 1201, also constitutes the oil barrier B. An oil absorbing member (e.g., a ring-like member made of felt) is preferably provided within each of the ring-like grooves 1151 and 1251 in order to absorb the oil having flowed into the groove.

It is preferable that a high grip portion is provided at the portion N2 of one of the rotary members 1101 and 1201 which is not brought into contact with the recording medium S but is pressed against the other rotary member. In this embodiment, a high grip portion G, which is similar to that (either of those shown in FIGS. 5 and 6) of the seventh embodiment, is provided on the pressure application roller 1201. The high grip portion G is preferably provided on both the side ends of the rotary member, although only one side end of the rotary member is illustrated in FIG. 15. In the present embodiment, the high grip portions G are provided on both the side ends of the rotary member.

The image forming apparatus of the eighth embodiment of the invention operates in the following ways and produces the following useful effects.

(d) A toner image T is formed on a recording medium S. The recording medium S having the toner image T passes through a part N1 of the press contact portion N in the fixing device 1001. As already stated, the fixing device 1001 is formed with the heating roller 1101 as a first rotary member to be heated and the pressure application roller 1201 as a second rotary member to be pressed against the heating roller 1101. Of those rollers, the heating roller 1101 is driven, and the pressure application roller 1201 follows the heating roller 1101 in rotation.

The oil roller 1301 as the oil coating mechanism for applying the release oil is provided at the contact portion N1 of the heating roller 1101 where it is brought into contact with the recording medium S. Therefore, an offset phenomenon is unlikely to occur.

The oil barrier B is provided between the contact portion N1 of it where it is brought into contact with the recording medium S and a portion N2 of it where it is not in contact with the recording medium S but is pressed by the pressure application roller 1201. The presence of the oil barrier B prevents such a situation that the release oil having been applied to the heating roller 1101 flows its contact portion N1 with the recording medium S to the portion N2 (at least its occurrence is extremely infrequent.).

For this reason, a gripping force is satisfactorily secured between both the rotary members at the contact portion N2.

Accordingly, both the rotary members 1101 and 1201 rotate at substantially equal peripheral speeds although such a construction is employed that the release oil is applied to the contact portion N1 of one (heating roller 1101 in this case) of the rotary members where it is brought into contact with the recording medium S. Therefore, when a slip will occur between the heating roller 1101 as the rotary member of the drive side and the recording medium S and/or the recording medium S and the pressure application roller 1201 as the rotary member of the follower side, the slip is prevented (at least its occurrence is extremely infrequent). As a result, the fixing operation of the fixing device is stable. Accordingly, the toner image on the recording medium S is little blurred, so that the resultant image is little disarranged.

To be more specific, in a case where no measure is taken in the construction where the release oil is applied to the contact portion N1 of the heating roller 1101 where it is brought into contact with the recording medium S, the release oil that has been applied to the heating roller 1101 moves from its contact N1 with the recording medium S to "its portion N2 where is not brought into contact with the recording medium S but is pressed against the pressure application roller 1201". As a result, a gripping force at the portion N2 between the rotary members 1101 and 1201 is remarkably reduced, and the peripheral speeds of the rotary members 1101 and 1201 become different. A slip will occur between the heating roller 1101 of the drive side and the recording medium S and/or the recording medium S and the pressure application roller 1201 of the follower side. As a result, a stable fixing operation of the fixing device is lost.

On the other hand, in the image forming apparatus of this embodiment, presence of the oil barrier B prevents such a situation that the release oil that has been applied to the heating roller 1101 moves from its contact portion N1 with the recording medium S to "its portion N2 where is not brought into contact with the recording medium S but is pressed against the pressure application roller 1201" (at least a probability of occurrence of the situation is remarkably reduced.). A gripping force is satisfactorily secured at the contact portion N2 between the rotary members 1101 and 1201. Therefore, the slip is prevented (at least its occurrence is extremely infrequent.) although such a construction is employed that the release oil is applied to the contact portion N1 of one (the heating roller 1101 in this case) of the rotary members where it is brought into contact with the recording medium S. As a result, a stable fixing operation of the fixing device is secured. Accordingly, the toner image on the recording medium S is little blurred, so that the resultant image is little disarranged.

(e) The oil barrier B is provided between the contact portion N1 of the pressure application roller 1201 as the other rotary member it where it is brought into contact with the recording medium S and a portion N2 of it where it is not in contact with the recording medium S but is pressed by the heating roller 1101. The presence of the oil barrier B prevents such a situation that the release oil, which was applied to the contact portion N1 of the heating roller 1101 where it is brought into contact with the recording medium S and moved to the contact portion N1 of the pressure application roller 1201 where it is brought into contact with the recording medium S, moves to the contact portion N2 of the pressure application roller 1201 (at least a probability of occurrence of the situation is considerably reduced.).

Accordingly, a gripping force is satisfactorily secured at the contact portion N2 between the rotary members 1101 and 1201. Therefore, a stable fixing operation of the fixing device is secured. Accordingly, there is less chance that the toner image on the recording medium S is blurred, so that the resultant image is little disarranged.

(f) The high grip portion G is provided at the portion N2 of at least one (the pressure application roller 1201 in this case) of the rotary members 1101 and 1201, which is not pressed by the recording medium S but pressed by the other rotary member. With presence of the high grip portion, a gripping force is more satisfactorily secured at the contact portion N2 between the rotary members 1101 and 1201. As a result, a stable fixing operation of the fixing device is secured. Accordingly, there is less chance that the toner image on the recording medium S is blurred, so that the resultant image is little disarranged.

(g) The release oil, which is applied by the oil coating mechanism 1301, is applied to within only the contact portion N1 of it where it is brought into contact with the recording medium S. Therefore, the applied oil is almost all absorbed by or transferred to the recording medium S when the recording medium S passes through the contact portion N1.

Accordingly, a chance of moving of the release oil to the press contact portion N2 where the rotary members are pressed one upon the other and is not brought into contact with the recording medium S, is further lessened. Therefore, a gripping force is more satisfactorily secured at the contact portion N2 between the rotary members 1101 and 1201. As a result, a stable fixing operation of the fixing device is secured. Accordingly, there is less chance that the toner image on the recording medium S is blurred, so that the resultant image is little disarranged.

(h) The image forming apparatus, like that of the seventh embodiment, is capable of forming toner images on both sides of the recording medium S. Therefore, there is a case that a recording medium S having toner images formed on both sides thereof passes through the part N1 of the press contact portion N in the fixing device 1001.

As described above, sometimes the toner on the recording medium S reduces the friction coefficient between the recording medium S and the rotary member. Therefore, in a case where the toner images T are formed on both sides of the recording medium S, the recording medium is more likely to slip when comparing with a case where the toner image is formed on one side of the recording medium.

In this connection, in the image forming apparatus of this embodiment, the oil barrier B is provided at least between the contact portion N1 of the rotary member 1101 that is coated with the release oil by the oil coating mechanism 1301, which the portion is brought into contact with the recording medium S, and the contact portion N2 which is not brought into contact with the recording medium S but is pressed by the other rotary member 1201. Therefore, even when the toner images T are formed on both sides of the recording medium S, the slip does not occur (at least its occurrence is extremely infrequent). As a result, a stable fixing operation of the fixing device is secured.

Thus, the image forming apparatus of this embodiment is capable of forming images suffering from no (at least little) image disarrangement on both sides of the recording medium S.

(i) The image forming apparatus of the embodiment, like that of the seventh embodiment, is capable of forming a full color image formed by superimposing a plurality of different colors. Therefore, there is a case that a recording medium S having a full color image formed on at least one side thereof passes through the part N1 of the press contact portion N in the fixing device 1001.

As described above, there is a case that the toner on the recording medium S reduces the friction coefficient between the recording medium S and the rotary member. Therefore, in a case where the full color image by superimposing a plurality of different colors is formed on the recording medium S, the recording medium S is more likely to slip when comparing with a case where the toner image of monochromatic color is formed on the recording medium.

In this connection, the oil barrier B is provided at least between the contact portion N1 of the rotary member 1101 that is coated with the release oil by the oil coating mechanism 1301, which the portion is brought into contact with the recording medium S, and the contact portion N2 which is not brought into contact with the recording medium S but is pressed by the other rotary member 1201. Therefore, even when the full color image by superimposing a plurality of different colors is formed on the recording medium S, the slip does not occur (at least its occurrence is extremely infrequent). As a result, a stable fixing operation of the fixing device is secured.

Thus, the image forming apparatus of this embodiment is capable of forming images suffering from no (at least little) image disarrangement, and forming images suffering from no image (at least little) disarrangement on both sides of the recording medium S.

Ninth Embodiment

Figure 16:
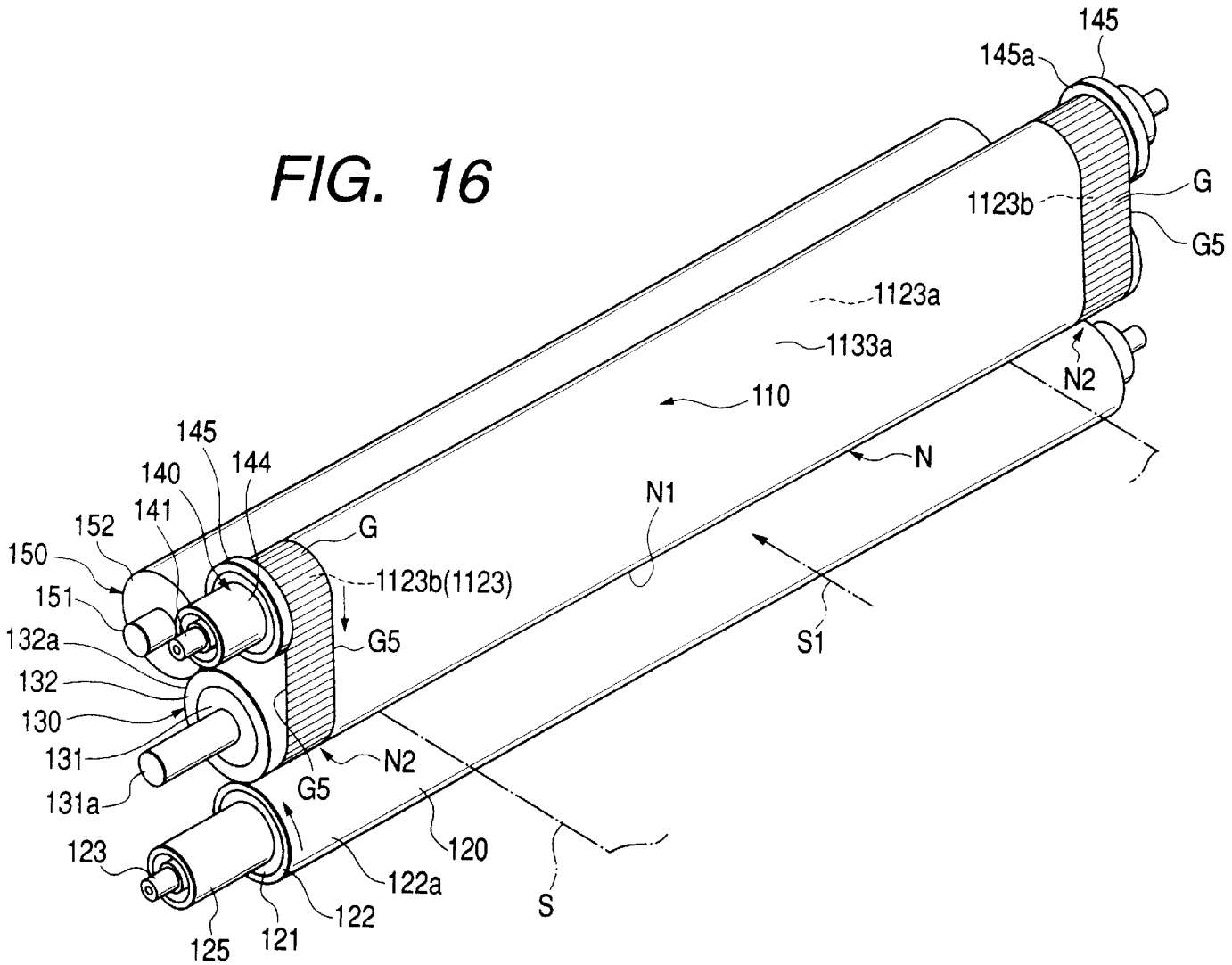
FIG. 16 is a perspective view schematically showing a ninth embodiment of the present invention.

FIG. 16 is a perspective view showing a major portion of a 9th embodiment of a belt fixing device (or image forming apparatus) according to the present invention. A basic construction of this fixing device 100 is similar to that shown in FIG. 8. Therefore, like or equivalent portions are designated by like reference numerals in FIG. 8.

The fixing device 100 also includes an endless belt 110 to be heated and an pressure application roller 120 as a rotary member to be in pressing contact with the endless belt 110. A recording medium S having a toner image (not shown) formed thereon is moved to pass, as indicated by an arrow S1, through a central part N1 of a press contact portion N between the endless belt 110 and the pressure application roller 120, whereby the toner image is fused and permanently fixed on the recording medium S.

The drive roller for rotating the endless belt 110 and the respective rollers may be any of other rollers than the oil roller 150. In the embodiment, the pressure application roller 120 is used as the drive roller. The pressure application roller 120 is driven to rotate in the direction of an arrow (counterclockwise) in FIG. 8 by a drive mechanism, not shown, and the backup roller 130, the endless belt 110, the heating roller 140 and the oil roller 150 rotate in a follower manner. Specifically, the endless belt 110 and the backup roller 130 are pressed against the pressure application roller 120, and the endless belt 110 and the backup roller 130 follow in rotation the pressure application roller 120. The endless belt 110 is wound on the heating roller 140, and the heating roller 140 follows in rotation the endless belt 110. The oil roller 150 is pressed against the endless belt 110, and the oil roller 150 follows in rotation the endless belt 110.

The heating roller 140 is provided with guide rings 145 as restricting members which come in contact with the side edges of the fixing belt 110 to restrict such a behavior of the traveling fixing belt 110 as to move aside.

A feature of this embodiment resides in a structure of the endless belt 110, and hence the structure of the endless belt will be described.

Figure 17A:
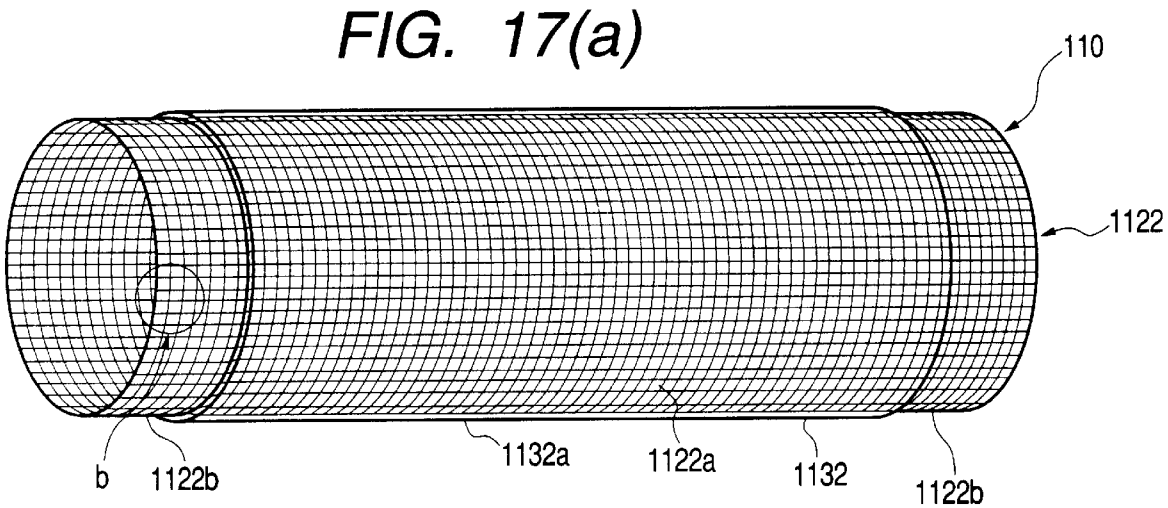
FIG. 17A is a perspective view showing the fixing belt.
Figure 17B:
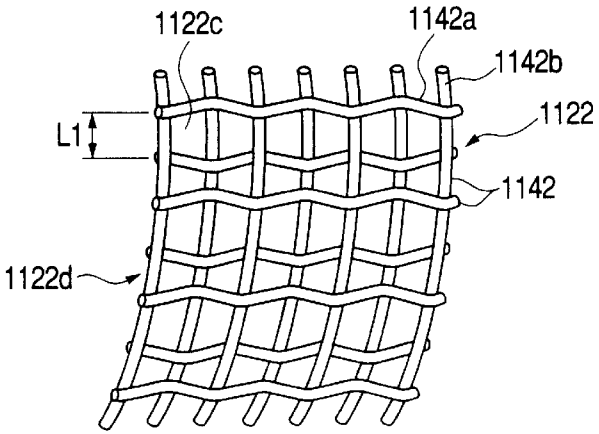
FIG. 17B is an enlarged view showing a portion "b" in the FIG. 17A.

FIG. 17 is a view showing the endless belt 110; FIG. 17A is a perspective view schematically showing the endless belt; and FIG. 17B is an enlarged view showing a portion (b) in FIG. 17A. The endless belt 110 illustrated in those figures is the one before it is extended around the backup roller 130 and the heating roller 140.

The endless belt 110 is formed with a belt base 1122 as a heat-resistance, mesh-like member and a surface belt layer 1132 made of high parting or release material. The surface belt layer 1132 is applied to at least the surface side (the right side in FIG. 4B) of a central portion 1122*a* of the belt base 1122 when viewed in th e widthwise direction (horizontal direction in FIG. 17, or the axial direction of each roller). Exposing portions 1122*b* are formed on both sides of the belt base 1122, respectively.

Figure 20A:
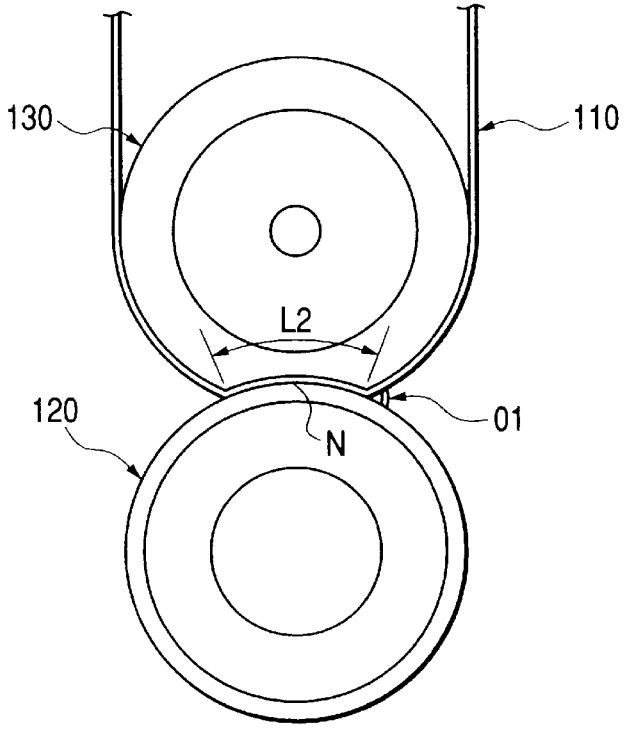
FIGS. 20A and 20B are explanatory diagrams useful in explaing the action of the mesh-like member.

As shown in FIG. 17B, in the mesh-like member that constitutes the belt base 1122, a length L1 of each mesh 1122*c* as measured along the circumferential direction is shorter than a length L2 of the press contact portion N as measured along the circumferential direction (see FIG. 20A). If the length L1 of the mesh 1122*c* is selected to be longer than the length L2 of the press contact portion N, a gripping action of a grip portion, which is to be described later, will be unsatisfactory. Accordingly, a heat-resistance cloth may be used for the belt base 1122.

The mesh-like member may be formed with threads 1142 made of alamide fiber, polyimide, glass fiber and the like. Of the threads 1142 forming the mesh-like member, those extending in the widthwise direction of the belt (horizontal direction in FIG. 17) are threads each consisting of an aggregation of a plural number of very fine threads (called multi-filaments, for example). In this embodiment, the just-mentioned threads 1142*a* and those 1142*b* extending in the circumferential direction of the belt are the threads each consisting of an aggregation of a plural number of very fine threads.

Figure 19A:
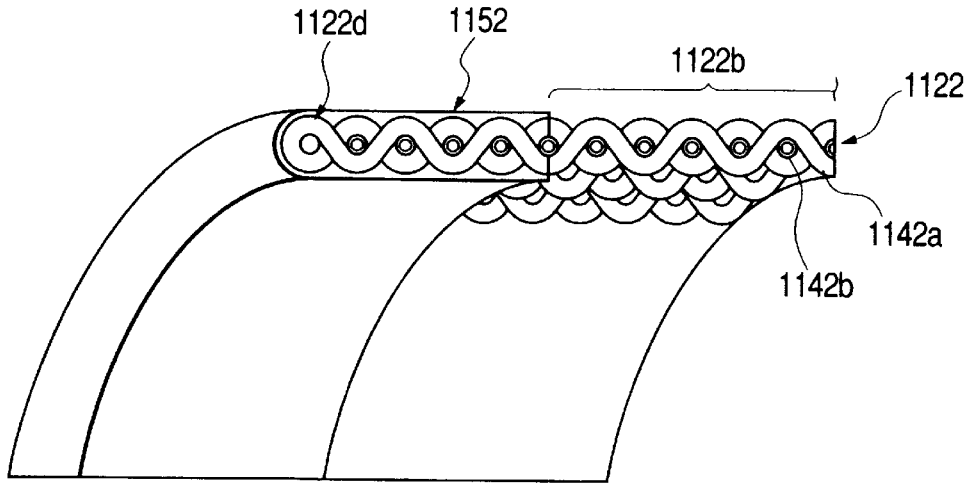
FIGS. 19A and 19B are partially cutaway, perspective views showing exemplar structures of the ends 1122*d* of a mesh-like member.

It is preferable that the ends 1122*d* of the mesh-like member are each reinforced by use of a structure as shown in FIG. 19A or 19C.

Figure 19B:
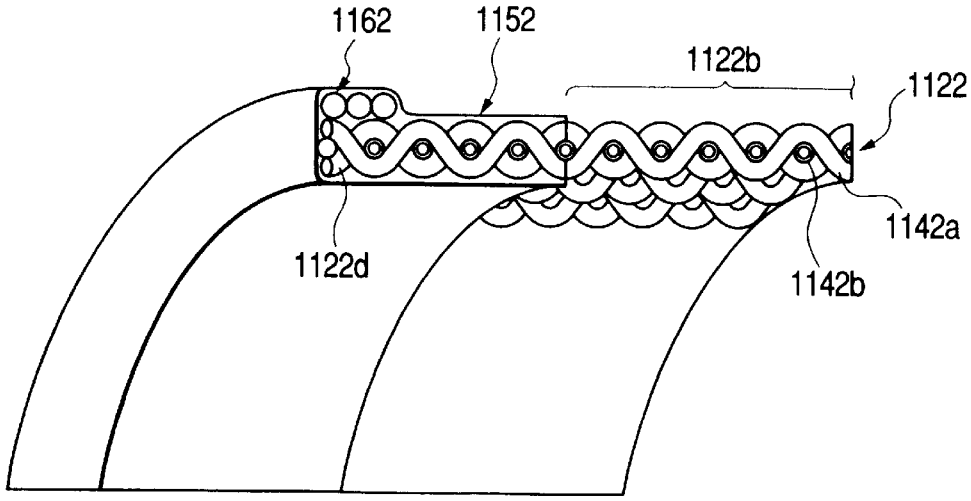

In the structure shown in FIG. 19A, to reinforce the end 1122*d* of the mesh-like member, it is covered with synthetic resin 1152 by dipping process. In the structure shown in FIG. 19B, to reinforce the end 1122*d* of the mesh-like member, a single thread (called mono-filaments) as a reinforcing member is wound around or attached to the end 1122*d* of the mesh-like member, and then the resultant is covered with synthetic resin 1152 by dipping process.

Figure 18B:
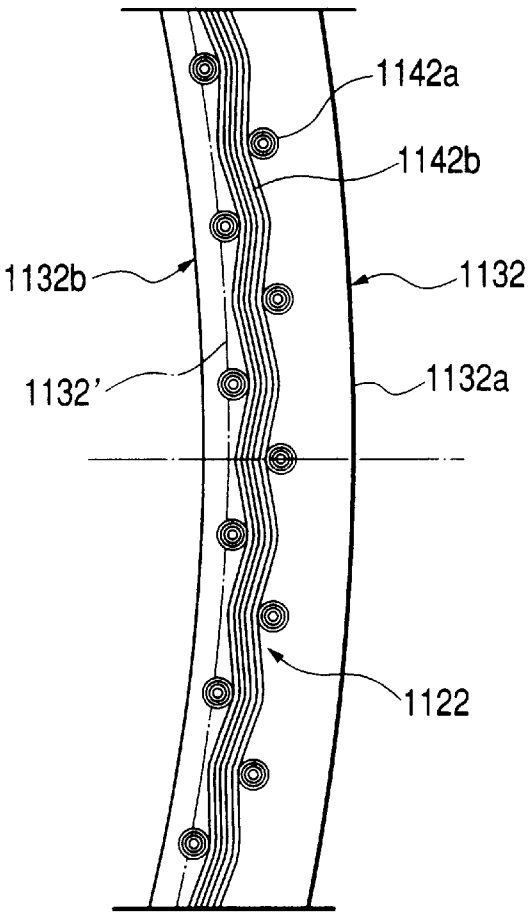
FIG. 18B is an enlarged view showing a portion "b" in the FIG. 18A.
Figure 18A:
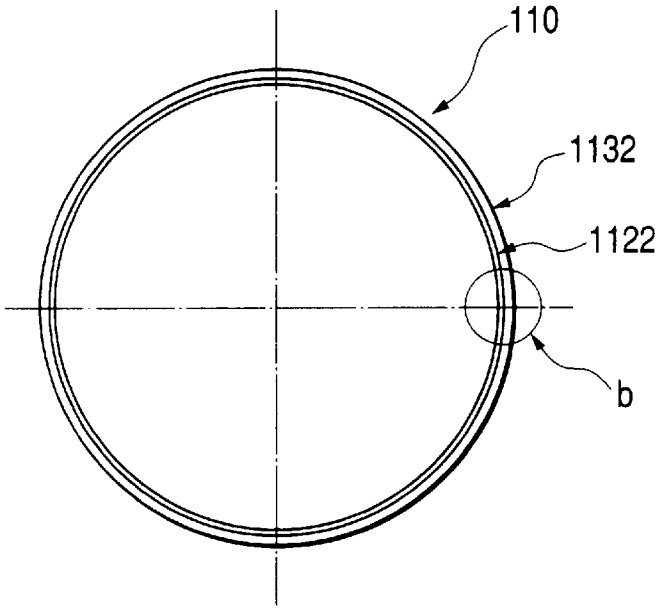
FIG. 18A is a side view showing the fixing belt 110.

The surface belt layer 1132 is formed in a manner that the central portion 1122*a* of the belt base 1122 as viewed in the widthwise direction is coated with high release material (material exhibiting good release characteristics for recording material and toner). In this embodiment, as shown in FIG. 18B, in the coating of the high release material, the high release layer is formed ranging up to the back side 1132*b* of the belt base 1122 as the mesh-like member. Filling the meshes 1122*c* (see FIG. 17B) of the belt base 1122 (the close meshes when the belt base 1122 is made of cloth) with the high release material to such an extent that the surface of the surface belt layer 1132 is smoothed, will do for the coating. Accordingly, in the coating, the belt base 1122 may be partially exposed on the back side 1132*b* thereof as indicated by a phantom line 1132' in FIG. 18B, for example. In a case where the belt base 1122 is made of cloth, the back side of the belt base 1122 is easy to be exposed.

A material having a permeability to the release oil (i.e., a material allowing the release oil to permeate therethrough) is preferable for the high release material. In this embodiment, such a material (as silicone rubber, fluorine rubber, fluorine plastic or the like) is used for the high release material.

The image forming apparatus of the sixth embodiment of the invention operates in the following ways and produces the following useful effects.

(a) A recording medium S having a toner image (not shown) formed thereon is moved to pass through a central part N1 of a press contact portion N between the endless belt 110 and the pressure application roller 120, whereby the toner image is fused and permanently fixed on the recording medium S. The endless belt 110 and the pressure application roller 120 are arranged such that one of them is driven while the other rotates following the one, and that the endless belt 110 is to be heated, and the pressure application roller 120 is pressed against the endless belt 110.

The endless belt 110 is formed with a belt base 1122 as cloth or a mesh-like member of which the meshes 1122*c* each have a length shorter than a length L2 of the press contact portion N as measured in the circumferential direction, and a surface belt layer 1132 made of high release material, which is applied to at least the surface side of a central portion 1122*a* of the belt base 1122 when viewed in the widthwise direction of the belt base, wherein the belt base 1122 includes exposing portions 1122*b* which are located at both side ends of the belt base 1122. Therefore, the surface belt layer 1132 forms a fixing surface 1132*a* for the toner image and the exposing portions 1122*b* form high grip portions, which act on the pressure application roller 120.

Accordingly, when a recording medium S, which relatively easily slips, is supplied to the central part N1 of the press contact portion N between the endless belt 110 and the pressure application roller 120, and as a result, when a slip will occur between the pressure application roller 120 of the drive side and the recording medium S and/or the recording medium S and the endless belt 110 of the follower side, the endless belt 110 and the pressure application roller 120 rotate at substantially equal peripheral speeds since the follower action of the endless belt 110 of the follower side for the pressure application roller 120 of the drive side is enhanced through the operation of the high grip portions, or the exposing portions 1122*b*. Therefore, the slip is prevented (at least its occurrence is extremely infrequent). As a result, the fixing operation of the fixing device is stable. Accordingly, the toner image on the recording medium S is little blurred, so that the resultant image is little disarranged.

It is noted that the high grip portion is formed by merely forming the exposing portions 1122*b* at both ends of the belt base 1122 itself. Therefore, the high grip portion of the embodiment is superior in strength to a high grip portion (not shown) additionally provided on the belt base 1122. In this respect, a reliability of the fixing device is increased. Further, the high grip portion of the embodiment may be manufactured more easily manufactured than to a high grip portion (not shown) additionally provided or formed on the belt base 1122.

(b) The oil coating mechanism 150 for coating the surface of the endless belt 110 with release oil is provided, so that an offset phenomenon is unlikely to occur.

As already stated, where the surface of the endless belt 110 is coated with the release oil, the oil will gradually move to the ends of the press contact portion N between the endless belt 110 and the pressure application roller 120.

Figure 20B:
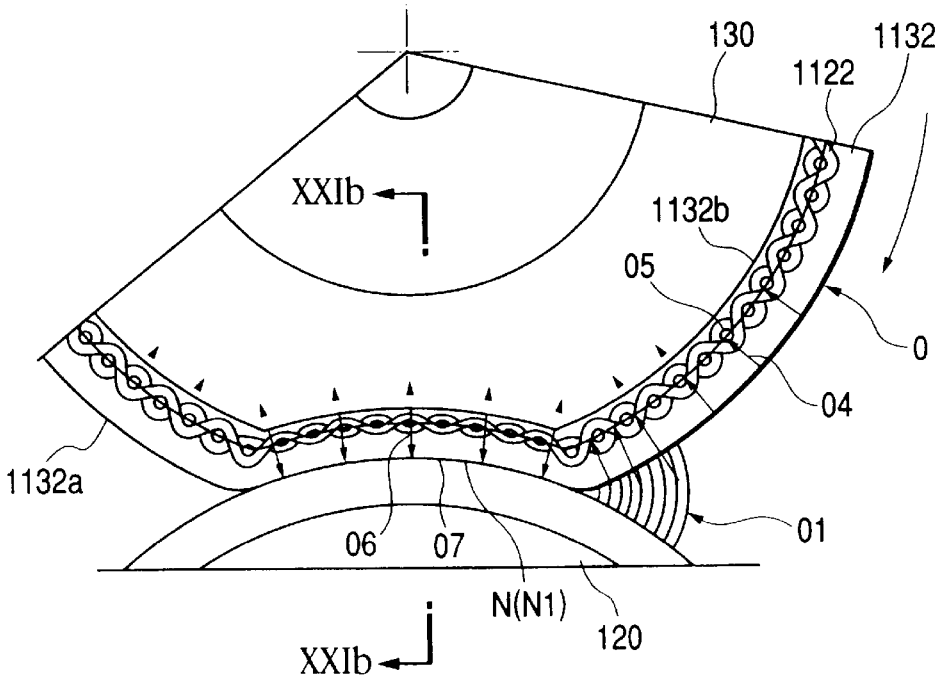
Figure 21A:
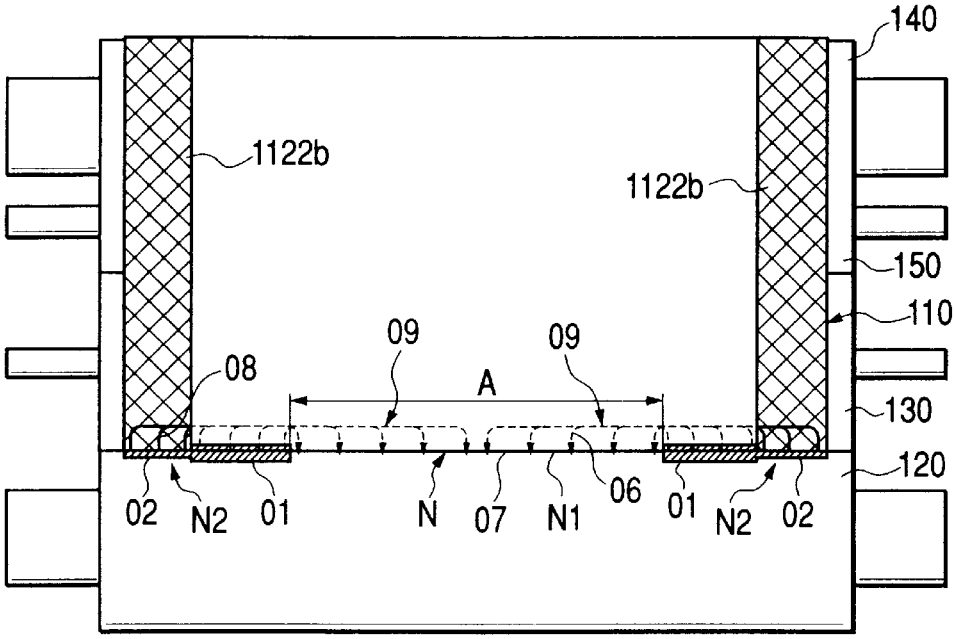
FIGS. 21A and 21B are explanatory diagrams useful in explaing the action of the mesh-like member.
Figure 21B:
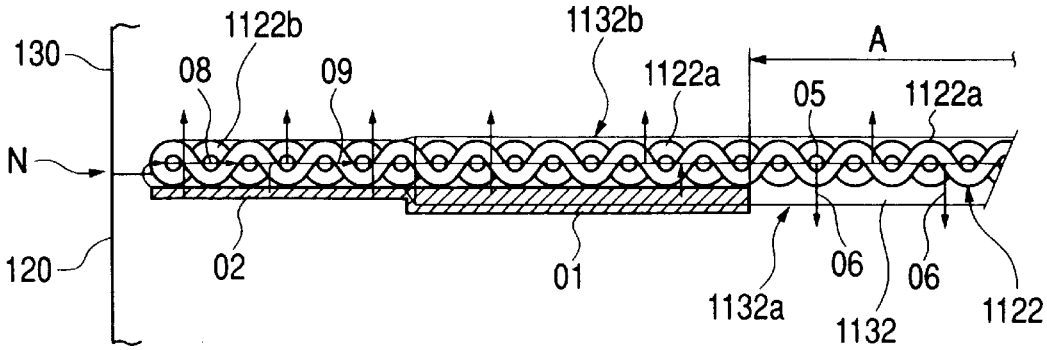

This will be described in detail with reference to FIGS. 20 and 21. FIG. 20A is a side view showing an operation of the fixing device including the endless belt. FIG. 20B is an enlarged view of a part of the fixing device. FIG. 21A is a front view showing the fixing device. FIG. 21B is an enlarged view of a part of the fixing device (corresponding to a cross sectional view taken on line XXIb—XXIb in FIG. 20B).

In FIGS. 21A and 21B, a zone denoted as A is a paper-passing zone within which a recording medium S is brought into contact with the endless belt 110 and the pressure application roller 120.

As shown in FIG. 20B, when the surface of the endless belt 110, viz., the surface 1132*a* of the surface belt layer 1132, is coated with release oil O, the release oil O comes in contact with the recording medium S within the zone A, so that it is absorbed by or transferred to the recording medium S. The release oil O located out of the zone A is not absorbed by and not transferred to the recording medium S. Therefore, as shown in FIGS. 20 and 21, it stays as surplus oil O1 at both ends of the paper-passing zone A at a position before the press contact portion N between the endless belt 110 and the pressure application roller 120 (upstream) as viewed in the paper traveling direction. The surplus oil O1 staying there moves to and reaches both ends N2 along the press contact portion N to its both ends N2. The surplus oil that has reached both ends N2 is denoted as 2.

As already stated, if no measure is taken for such surplus oil O2, a gripping force between the fixing belt 110 and the pressure application roller 120 decreases and a slip will occur.

In this connection, in the fixing device of this embodiment, the belt base 1122 is exposed (1122*b*) at both ends N2 of the press contact portion N. Further, the belt base 1122 is made of cloth or a mesh-like member of which the threads 1142*a* extending in the widthwise direction are formed with threads each consisting of an aggregation of a plural number of very fine threads. The oil having reached each end N2 of the press contact portion N penetrates into the threads 1142*a* each consisting of an aggregation of a plural number of very fine threads of the cloth or the mesh-like member (also to the threads 1142*b* in this embodiment).

Accordingly, a little amount of the release oil is present on the surface of both ends 1122*b* of the belt base 1122. As a result, a gripping force is satisfactorily secured at the both ends N1 of the press contact portion. The slip is prevented (at least its occurrence is extremely infrequent.). A stable fixing operation of the fixing device is performed.

Thus, the belt fixing device of this embodiment stably operates for fixing the toner image although it employs such a construction that the surface of the fixing belt 110 is coated with the release oil O.

(c) The high release material of the surface belt layer 1132 has a permeability to the release oil. Because of this nature, the oil O having being applied to the surface 1132*a* of the surface belt layer 1132 penetrates into the surface belt layer 1132 as indicated by arrows O4 in FIG. 20B, and then to the threads 1142*a* and 1142*b* each consisting of an aggregation of a plural number of very fine threads in the cloth or the mesh-like member, and retained in the cloth or the mesh-like member. The retained oil O oozes, by its pressure, out of the cloth or the threads at the press contact portion N (in particular the central part N1) as indicated by arrows O6 in FIG. 20B and FIGS. 21A and 21B, and further reaches the surface 1132*a*, or the fixing surface, of the surface belt layer 1132 to form an oil thin film 07 (see FIG. 20B) on the fixing surface. As a result, the oil film is uniformized on the fixing surface, so that a toner image fixed thereon is improved in its quality.

The release oil O8 having permeated into the ends 1122*b* of the belt base 1122 moves, as indicated by arrows O9, back to the central portion 1122*a* of the belt base 1122 through the widthwise-extending threads 1142*a* of the cloth or the mesh-like member which forms the belt base 1122. This reduces consumption of the release oil. That is, the release oil is absorbed by the recording medium in the paper-passing zone A, i.e., the central portion 1122*a*. Therefore, an amount of the permeated oil in the zone is smaller than that at the ends thereof. As a result, the release oil moves back to the central portion of the belt base, from the ends thereof.

In a case where the fixing operation is not performed for a certain time, and the surplus oil will stay at a region near the press contact portion N, the oil permeates into the surface belt layer 1132, and to the threads 1142*a* each of an aggregation of a plural number of very fine threads in the cloth or the mesh-like member of the belt base 1122, and is retained in the cloth or the mesh-like member. And a part of the retained release oil flows back to the central portion of the surface belt layer. Therefore, when the fixing operation is not performed for a certain time and then it is operated again, there is less chance that a first recording medium will be soiled by the surplus oil.

10th Embodiment

A basic construction of a fixing device 100 which constitutes an eighth embodiment of the present invention is substantially the same as of the fixing device shown in FIGS. 8 and 16. Then, like or equivalent portions are designated by like reference numerals.

A feature of the present embodiment resides in a structure of an fixing belt 110, and hence the structure of the fixing belt will be described.

Figure 22A:
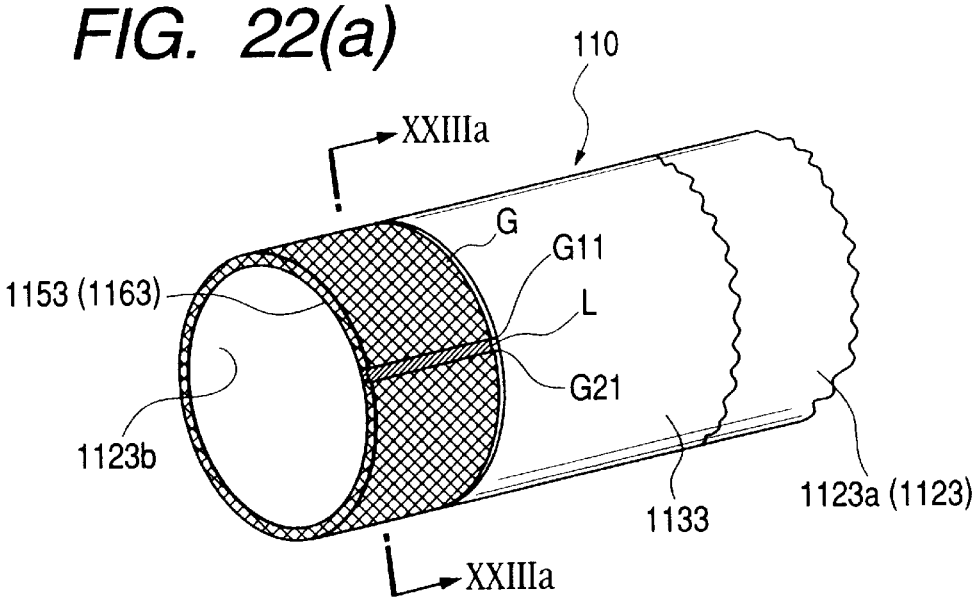
FIG. 22A is a partial perspective view showing the fixing belt 110 (before it extends around the backup roller 130 and the heating roller 140).
Figure 22B:
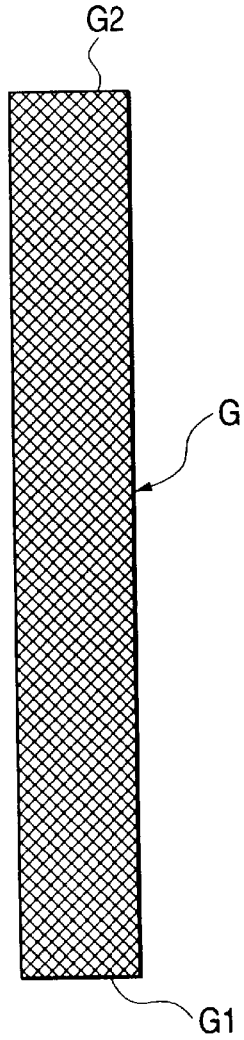
FIG. 22B is a front view showing a tape-like, high grip member.
Figure 23A:
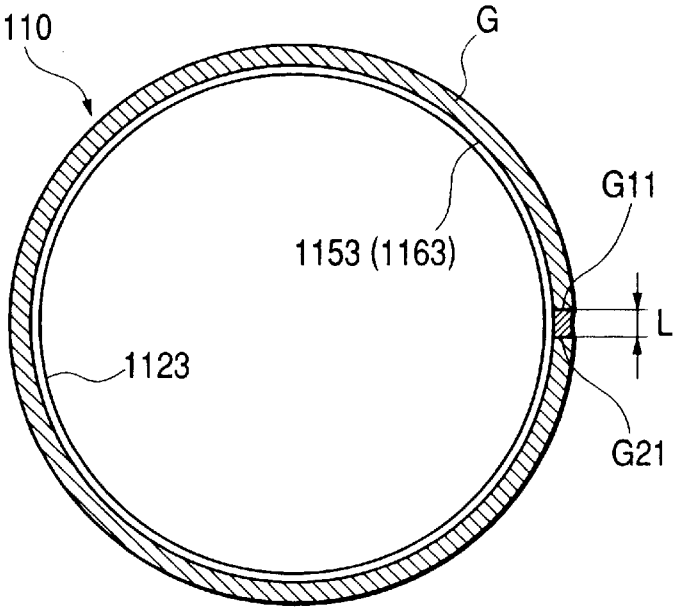
FIG. 23A is a cross sectional view taken on line XXIIIa—XXIIIa in FIG. 22.

FIG. 22A is a partial perspective view showing the fixing belt 110 (before it extends around the backup roller 130 and the heating roller 140). FIG. 22B is a front view showing a tape-like, high grip member. FIG. 23A is a cross sectional view taken on line XXIIIa—XXIIIa in FIG. 22.

The fixing belt 110, which is a heat-resistance belt, is formed with an fixing belt base 1123 and a surface belt layer 1133 which is applied to at least the surface side (the right side in FIG. 4B) of a central portion 1123*a* of the belt base 1123 when viewed in the widthwise direction (horizontal direction in FIG. 16, or the axial direction of each roller). Tape-like, high grip members G are wound around both side ends 1123*b* of the belt base 1123, respectively.

The belt base 1123 is made of, for example, polyimide being conductive.

The surface belt layer 1133 is formed by coating the central portion 1123*a* of the belt base 1123 as viewed in the widthwise direction with high release material (which exhibits good release characteristics to a recording medium and toner, and is silicone rubber, for example).

The tape-like, high grip member (referred to as a high grip tape) G may be made of any of various materials which will be described later and may take any of various structures which will also be described later. The high grip tape G may also be a tape simply having a rugged surface (or a protruded or recessed surface) and made of high friction material, such as rubber.

In this embodiment, a high grip tape G as shown in FIG. 22B is wound around each side end 1123*b* of the belt base 1123 and fastened thereto by adhesive.

Also in this embodiment, the high grip tape is wound on each side end of the belt base such that, as shown in FIGS. 22A and 23A, a winding start end G11 at which the winding of the high grip tape G starts is not lapped on a winding terminating end G21 at which its winding terminates. Accordingly, a gap L is present between the winding start end G11 and the winding terminating end G21. It is preferable that the gap L is as small as possible (at least it is shorter than a length (measured in the circumferential direction) of the press contact portion N between the fixing belt 110 and the pressure application roller 120).

Figure 23B:
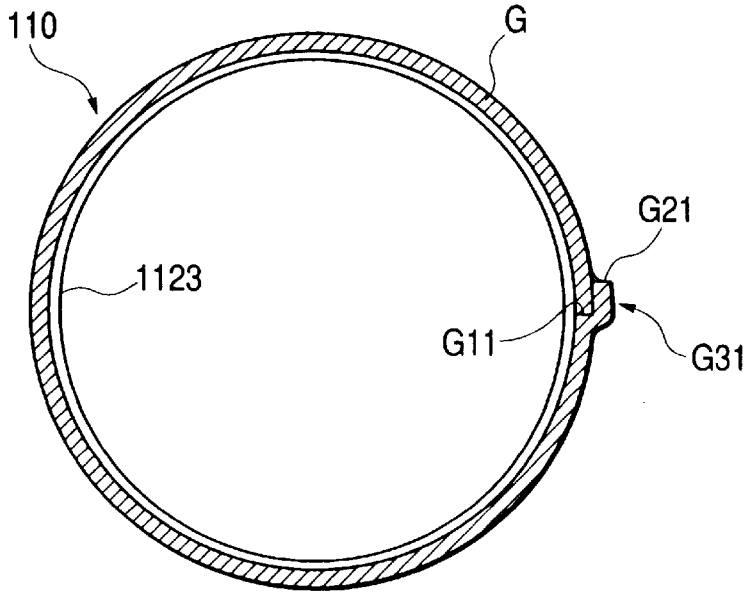
FIG. 23B is a cross sectional view showing a state that a winding start end G11 of a high grip member is lapped on a winding terminating end G21.

The high grip tape G may be wound on each side end of the belt base such that the winding start end G11 laps on the winding terminating end G21., and the former is fastened to the latter, as shown in FIG. 23B.

The fixing device 100 of this embodiment has the following advantageous effects.

(a) A recording medium S having a toner image formed thereon is moved to pass through a central part N1 of a press contact portion N between the fixing belt 110 and the pressure application roller 120 in a belt roller arrangement in which the fixing belt 110 is heated and the pressure application roller 120 as a rotary member is pressed against the fixing belt 110, and one of the fixing belt 110 and the pressure application roller 120 is driven to rotate while the other follows the one in rotation. As a result, the toner image is fused and permanently fixed on the recording medium S.

The high grip tape G is wound around each side end of the fixing belt and fastened thereto. As a result, high grip portions (G) which act on the pressure application roller 120, are formed at both side ends of the fixing belt 110.

Therefore, when a recording medium S, which relatively easily slips, is supplied to the central part N1 of the press contact portion N between the fixing belt 110 and the pressure application roller 120, and as a result, when a slip will occur between the pressure application roller 120 of the drive side and the recording medium S and/or the recording medium S and the fixing belt 110 of the follower side, the fixing belt 110 and the pressure application roller 120 rotate at substantially equal peripheral speeds since the follower action of the fixing belt 110 of the follower side for the pressure application roller 120 of the drive side is enhanced through the operation of the high grip portions G. Therefore, the slip is prevented (at least its occurrence is extremely infrequent). As a result, the fixing operation of the fixing device is stable. Accordingly, the toner image on the recording medium S is little blurred, so that the resultant image is little disarranged.

(b) Further, the high grip portions may be formed in such a simple manner that the high grip tapes G are wound around both the side ends of the fixing belt 110 and are fastened to the side ends. Therefore, the manufacturing of the fixing belt 110 (hence the fixing device) is simpler than in the case where ring-like, high grip members (not shown) are fit to both side ends of the belt 110 or where the side ends themselves of the belt are worked to be high grip portions.

(c) Further, the fixing device 100 of the embodiment has the following advantageous effects since the winding start end G11 of the high grip tape G is not lapped on the winding terminating end G21.

As already stated in connection with FIG. 23B, when the winding start end G11 of the high grip tape G is lapped on the winding terminating end G21, the lapping portion G31 is thick. Therefore, a speed of the turning fixing belt 110 when the lapping portion G31 is pressed on the pressure application roller 120 will be different from that when the lapping portion G31 is not pressed on the pressure application roller 120.

When the lapping portion G31 is pressed against the pressure application roller 120, stress will concentrate at a portion of the pressure application roller 120 where it is in contact with the lapping portion G31. As a result, an endurance of the pressure application roller 120 will be reduced.

In this connection, the winding start end G11 of the high grip portion G is not lapped on the winding terminating end G21 in the belt fixing device 100 of this embodiment. Because of this, the speed of the turning belt fixing belt 110 little varies. Additionally, little stress concentrates on the specific location of the pressure application roller 120, so that the endurance of the pressure application roller 120 is little reduced.

(d) The oil coating mechanism 150 for coating the surface of the fixing belt 110 with release oil is provided, so that an offset phenomenon is unlikely to occur.

As already stated, where the surface of the fixing belt 110 is coated with the release oil, the oil will gradually move to the ends of the press contact portion N between the fixing belt 110 and the pressure application roller 120. However, in this embodiment, the above-mentioned slip is unlikely to occur since the high grip tapes G are provided on both the side ends of the fixing belt 100.

A width of the oil coating on the fixing belt by the oil roller 150 is preferably shorter than the width of the surface belt layer 1133, or the paper-passing width (the width of the recording medium S).

11th Embodiment

Figure 24A:
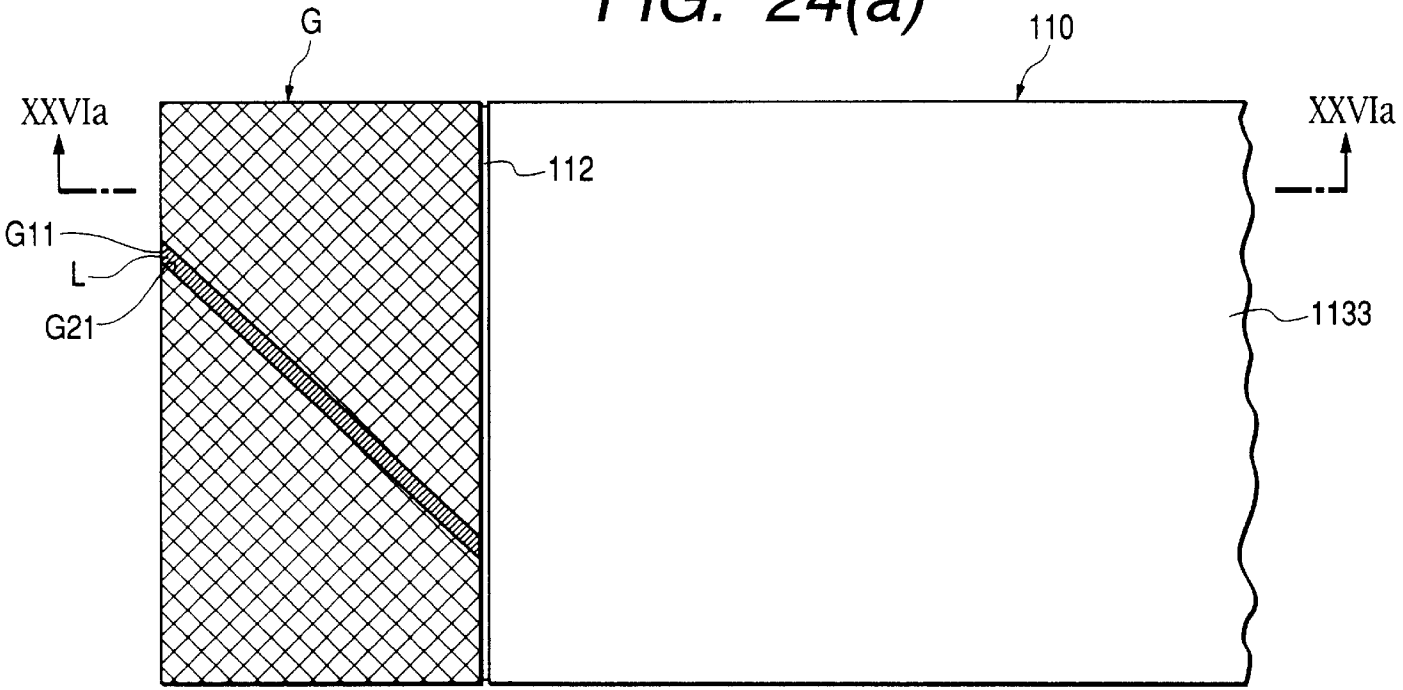
FIG. 24A is a partial front view showing a fixing belt 110 constructed according to the present invention.
Figure 24B:
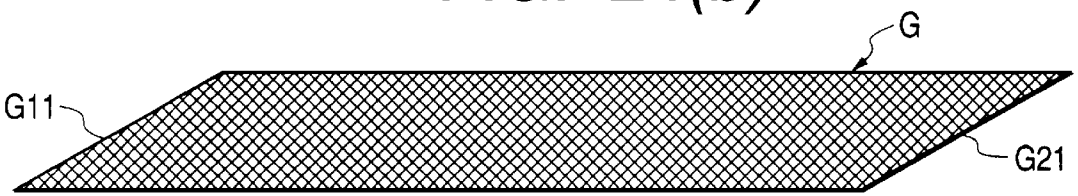
FIG. 24B is a development of a tape-like, high grip member G.

FIG. 24 is a diagram showing a major portion of an 11th embodiment of a belt fixing device according to the present invention. FIG. 24A is a partial front view showing a fixing belt 110 constructed according to the present invention. FIG. 24B is a development of a tape-like, high grip member G. In FIG. 24, like or equivalent portions are designated by like reference numerals used in the 10th embodiment already described.

The 11th embodiment of the invention is different from the 10th embodiment in that the winding start end G11 of the high grip member G is confronted with the winding terminating end G21 in a state that a gap L slanted to the axial direction of the pressure application roller is interposed therebetween. The remaing structure of the 11th embodiment is substantially the same as of the 10th embodiment. Thus, the winding start end G11 and the winding terminating end G21 of the high grip member G are not in parallel to the axial direction of the pressure application roller 120, and is also slanted to the circulating direction of the fixing belt 110.

The present embodiment has the following operations and advantageous effects in addition to the corresponding ones of the 10th embodiment.

If the winding start end G11 and the winding terminating end G21 of the high grip member G are not slanted (with respect to, for example, the width direction of the fixing belt 110 or the axial direction of the pressure application roller 120), a traveling speed of the fixing belt 110 when the gap L between the winding start end G11 and the winding terminating end G21 is in contact with the pressure application roller 120 will be different from that when it is not in contact with the pressure application roller 120. If the gap L in the 10th embodiment is longer than the length of the press contact portion N between the fixing belt 110 and the pressure application roller 120 as viewed in the circumferential direction, a probability of creating the above-mentioned speed difference will increase.

On the other hand, a probability of creating the above-mentioned speed difference of the fixing belt 110 of the follower side is small in the 11th embodiment since the winding start end G11 of the high grip member G is confronted with the winding terminating end G21 in a state that the gap L slanted to the axial direction of the pressure application roller is interposed therebetween.

12th Embodiment

Figures 25A, 25B, 25C, 25D:
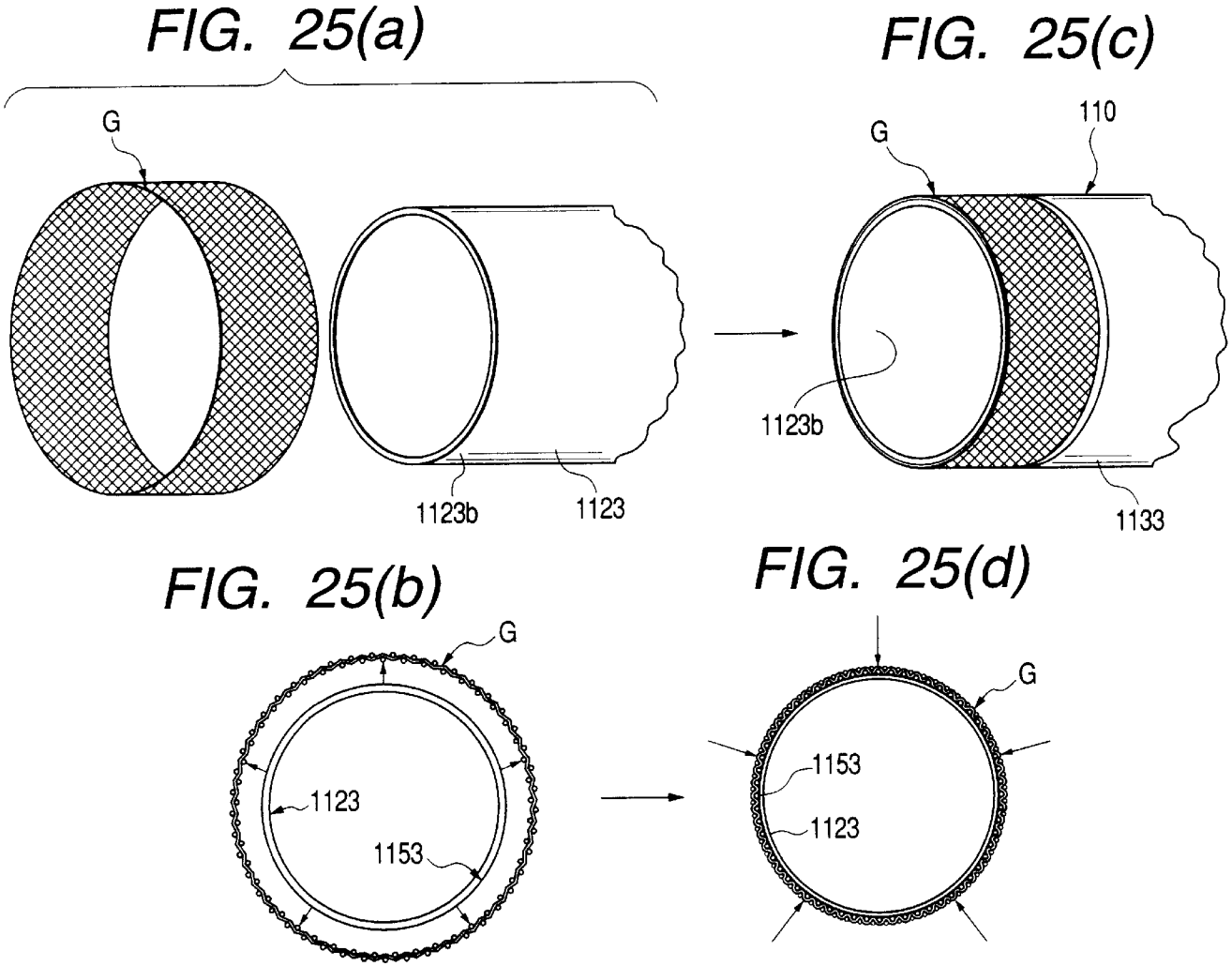
FIG. 25A is an exploded, perspective view showing one end of a fixing belt 110 constructed according to the invention (corresponding to the cross sectional view taken on line XXIIIa—XXIIIa in FIG. 24A)
FIG. 25B is a side view showing the belt end.
FIG. 25C is a perspective view of the belt end.
FIG. 25D is a side view showing the belt end.

FIG. 25 is a diagram showing a major portion of a 12th embodiment of a fixing belt according to the present invention. FIG. 25A is an exploded, perspective view showing one end of a fixing belt 110 constructed according to the invention (before the fixing belt 110 extends around the backup roller 130 and the heating roller 140). FIG. 25B is a side view showing the belt end. FIG. 25C is a perspective view of the belt end. FIG. 25D is a side view showing the belt end.

This embodiment is different from the 10th embodiment in that a high grip portion G is formed with an expandable member shaped like an endless belt (referred to as a belt-like high grip member). The belt-like high grip member has an inside diameter smaller than an outside diameter of each side end 1123*b* of the fixing belt when it is in a free state. As shown in FIGS. 25A and 25B, by the utilization of its expandability, the belt-like high grip member G is expanded to be somewhat larger than the outside diameter 1123*b* of the belt base 1123, and is fit to each side end 1123*b* with an adhesive layer 1153 being interposed therebetween, and is fastened to each side end 1123*b* of the belt base 1123 by its expandability and by use of the adhesive layer 1153.

The fixing belt 110 of this embodiment additionally produces the following advantageous effects.

As described above, the high grip portion G is formed with an expandable endless belt having an inside diameter smaller than an outside diameter of each side end 1123*b* of the fixing belt when it is in a free state. Therefore, by the utilization of its expandability, the belt-like high grip member is expanded and fit to the side ends 1123*b* of the fixing belt 110 to form a high grip portion G well fit to and around the side ends 1123*b* of the fixing belt 110.

Where the tape-like high grip member, or the high grip tape, is wound around each side end of the fixing belt 110, there is a fear that high grip tape is easy to peel off the belt at its seam (between the winding start and terminating ends). In the fixing belt in this embodiment, such a fear is not present and the belt-like high grip member doubles as a reinforcing member for the side end of the fixing belt. In this respect, a reliability of the fixing belt is increased. As a result, the fixing belt 110 may be thinned in structure. The fixing belt 110 well follows an unevenness corresponding to the amounts of attached toner forming a toner image. This results increase of a fixing strength or a fixing uniformity. Further, a heat capacity of the fixing belt 110 is small, so that it may be heated quickly.

The high grip portions may be formed in such a simple manner that the belt-like high grip members G are wound around both the side ends of the fixing belt 110 and are fastened to the side ends. Therefore, the manufacturing of the fixing belt 110 is simpler than in the case where the side ends themselves of the belt are worked to be high grip portions.

13th Embodiment

Figure 26A:
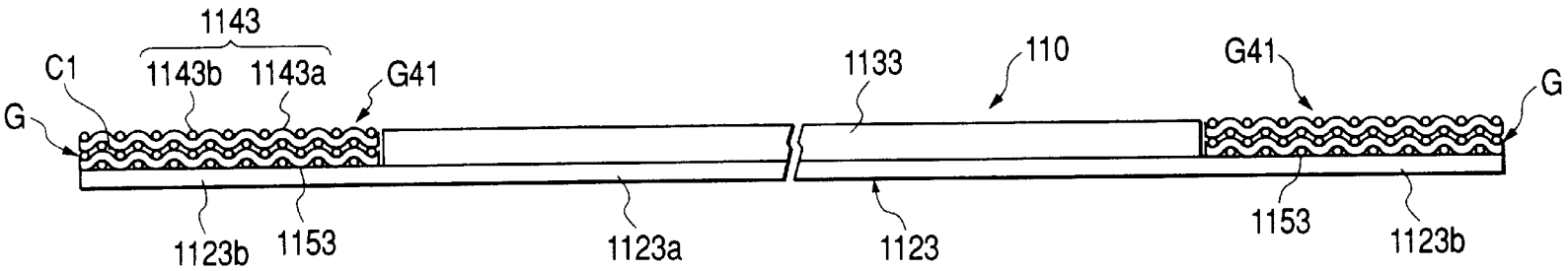
FIG. 26A diagrammatically shows a key portion of a thirteenth embodiment of a belt fixing device constructed according to the present invention, and is a cross sectional view showing a part of a fixing belt 110 (corresponding to the XXVIa—XXVIa cross section in FIG. 24A).
Figure 26B:
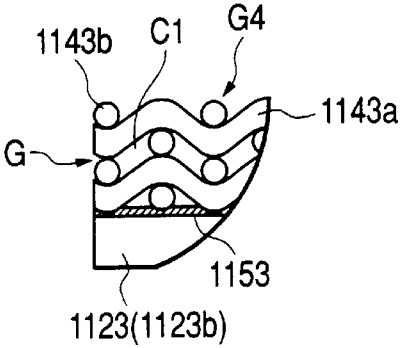
FIGS. 26B and 26C are enlarged views of a portion of the fixing belt.
Figure 26C:
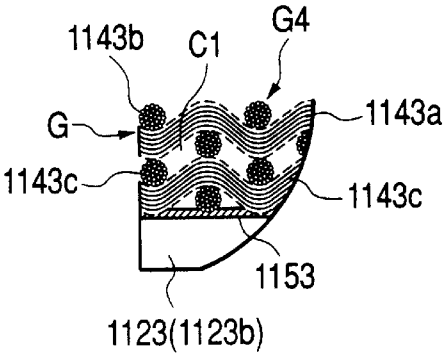

FIG. 26 is a diagram showing a key portion of a 13th embodiment of a belt fixing device constructed according to the present invention. FIG. 26A is a cross sectional view showing a part of a fixing belt 110 (before the fixing belt 110 extends around the backup roller 130 and the heating roller 140, and corresponds to the XXVIa—XXVIa cross section in FIG. 24A). FIGS. 26B and 26C are enlarged views of a portion of the fixing belt. In FIG. 26, like or equivalent portions are designated by like reference numerals used in the 10th to 12th embodiments already described.

A feature of the present embodiment resides in that high grip portions G are made of cloth.

Figure 27A:
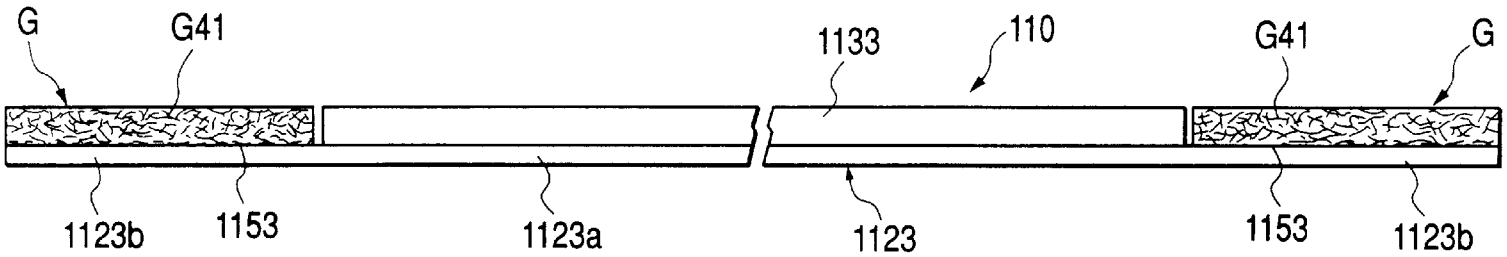
FIG. 27A is a cross sectional view showing a part of the modification (corresponding to the XXVIa—XXVIa cross section in FIG. 24A)
Figure 27B:
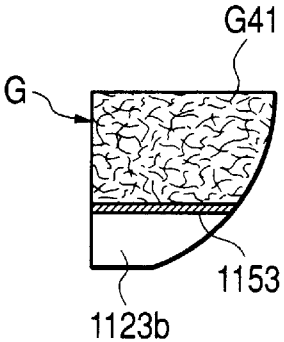
FIG. 27B is a cross sectional view showing a part of the modification in FIG. 27A.

The cloth G is formed by knitting or weaving threads 1143*a* and 1143*b* that run crosswise and lengthwise, and includes a mesh-like member with very fine meshes. Further, it may be unwoven fabric as shown in FIG. 27.

The threads (weft and warp) 1143 may be formed with single threads (, e.g., called mono-filaments) as shown in FIG. 26B or threads each consisting of an aggregation of a plural number of very fine threads (called multi-filaments, for example). The threads 1143 may be made of any of alamide, polyimide, glass fiber, PET (polyethylene terephthalate) and the like.

Also when the threads 1143 are formed with single threads as shown in FIG. 26B, oil may be retained in empty spaces C1 each between adjacent threads 1143. Accordingly, the cloth G has an oil absorption. When each of the threads 1143 consists of an aggregation of a plural number of very fine threads as shown in FIG. 26C, the oil is absorbed by and retained in the innards of the threads 1143 themselves. Therefore, to increase the oil absorption, it is preferable to use the threads 1143 each consisting of an aggregation of a plural number of very fine threads. It is preferable that at least one of the weft 1143*a* and the warp 1143*b* is formed with the threads each consisting of an aggregation of a plural number of very fine threads.

The empty spaces C1 extend vertically in FIG. 26, and are continuous in the belt circumferential direction (perpendicular to a paper surface in the drawing of FIG. 26). Therefore, the cloth G is permeable to the oil, and allows the oil to flow in the belt circumferential direction.

The cloth G may be an unwoven fabric (e.g., alamide unwoven fabric) as shown in FIG. 27. The unwoven fabric is also capable of absorbing the oil and is permeable to the oil, and allows the oil to flow in the belt circumferential direction.

In FIGS. 26 and 27, reference numeral 1153 is an adhesive layer (e.g., adhesive) for fastening the cloth G to the belt base 1123.

The fixing device 100 of this embodiment operates in the following ways and produces the following advantageous effects.

Since the high grip portion is formed with the cloth G, a surface G41 (see FIG. 26) of the high grip portion is defined by a number of vertical and horizontal fine ridges of the threads 1143 running crosswise and lengthwise. The fine ridge crossing pattern spreads substantially uniformly over the surface G41.

A vibration and a speed variation, which are generated at both ends of the fixing belt 110 by a drive force transmission, are extremely reduced, thereby ensuring a smooth drive force transmission.

Since the fine ridge crossing pattern are formed by the threads 1143, each ridge is rounded in cross section. With this configuration of the ridges, the stress concentration is lessened, and hence the endurance of the pressure application roller 120 is increased.

Further, the high grip portion of this embodiment is superior to that formed with a rubber member of an uneven surface in the strength (particularly to shearing).

To be more specific, in the case of the high grip portion G made of a film or a rubber member, for example, when a shearing force is applied to its edge, the edge first cracks, and then the crack rapidly propagates and the high grip portion is finally broken. In the case of the high grip portion G made of the cloth, when the fiber (thread) 1143 at the edge of the cloth cracks to be broken, the breakage of the fiber does not propagates. That is, only one fiber at the edge is broken.

When the side edge of the belt is brought into contact with the inner surface (145*a*) of a flange (the guide ring 145 of the heating roller 140 shown in FIG. 16) of the roller on which the fixing belt 110 is put in order to restrict a zig-zag traveling of the fixing belt 110, a shearing force acting on the side edge of the belt is great in magnitude. In this fixing device, the high grip portions of cloth are provided on both side ends of the fixing belt. Therefore, the high grip portion G is unlikely to be broken and propagation of the breakage to the whole fixing belt 110 is also greatly impeded.

In this embodiment, an offset phenomenon is unlikely to occur since the oil coating mechanism 150 for applying the release oil onto the surface of the fixing belt 110 is provided.

As already stated, where the surface of the fixing belt 110 is coated with the release oil, the oil will gradually move to the ends N2 of the press contact portion N between the fixing belt 110 and the pressure application roller 120. However, in this embodiment, the oil having reached the ends N2 of the press contact portion N is absorbed by the cloth G since the cloth G are fastened around both the side ends of the fixing belt 110 in the fixing device 100 and the cloth G has an oil absorbing capability.

Therefore, the amount of oil present on the surfaces of both the side ends of the fixing belt 110, viz., the surfaces G41 of the cloth G of the high grip portions G, is small. As a result, a gripping force is satisfactorily secured at the ends N2 of the press contact portion N. The slip is prevented (at least its occurrence is extremely infrequent), and a stable fixing operation of the fixing device is secured.

Thus, the fixing device 100 of this embodiment is able to stably fix the toner image although the surface of the fixing belt 110 is coated with the release oil.

Such an effect is produced not only when the high grip member G is made of cloth but also when it is made of a material having an oil absorbing capability.

As recalled, the cloth G allows the oil to flow in the belt circumferential direction. Therefore, if the cloth G is saturated with the oil, the oil entering the cloth G is moved in the belt circumferential direction and excluded out of the ends N2 of the press contact portion by the pressing force applied thereto.

Therefore, if the cloth G is saturated with the oil, the amount of oil present on the surfaces G41 of the cloth G of the high grip portions G at both the side ends of the fixing belt 110 is small at the press contact portion. As a result, a gripping force is satisfactorily secured at the ends N2 of the press contact portion N. The slip is prevented (at least its occurrence is extremely infrequent), and a stable fixing operation of the fixing device is secured.

This effect is produced not only when the high grip member G is made of cloth but also when it is made of a material allowing the oil to flow in the belt circumferential direction.

14th Embodiment

Figure 28A:
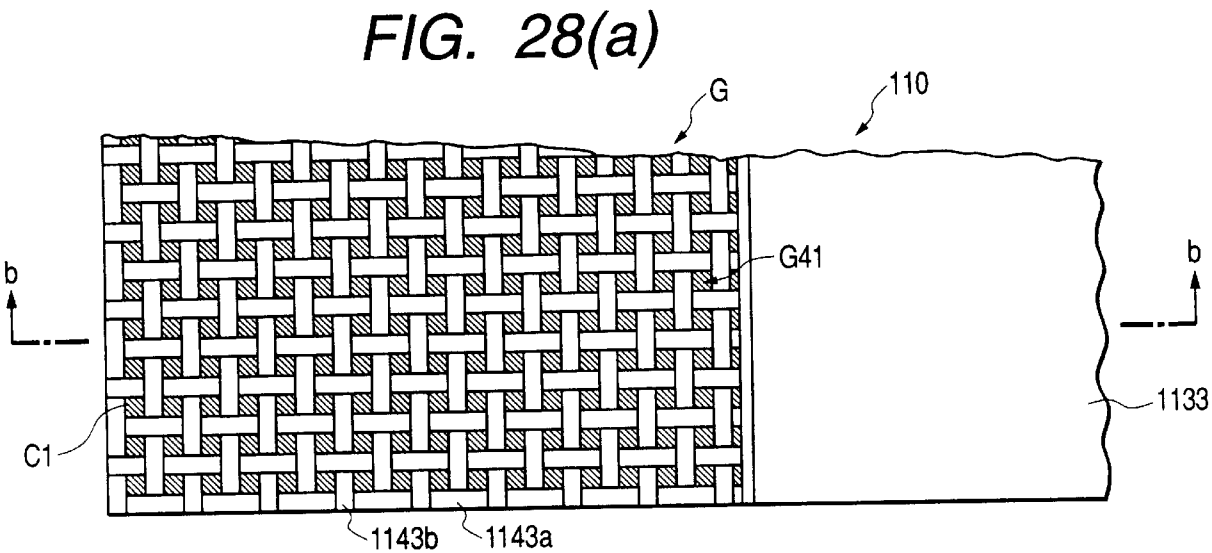
FIG. 28A is an enlarged front view showing one end of a fixing belt 110.
Figure 28B:
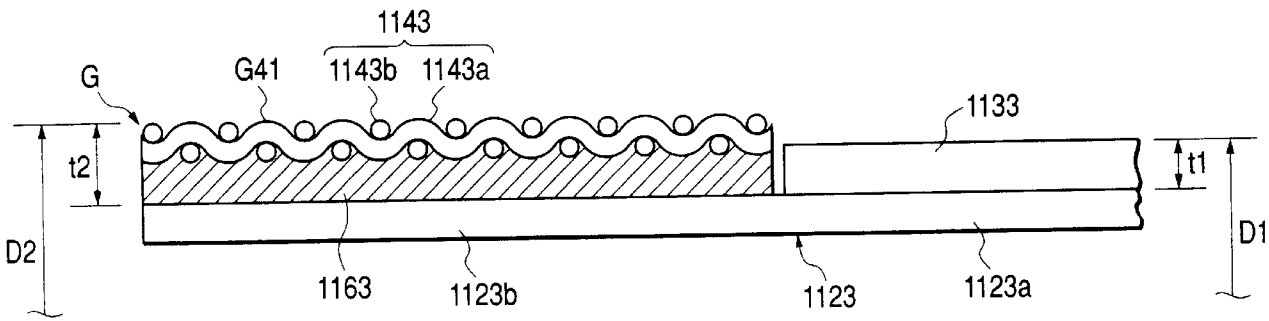
FIG. 28 shows a fourteenth embodiment of the present invention.

FIG. 28 is a diagram showing a 14th embodiment of a belt fixing device according to the present invention. FIG. 28A is a partial, enlarged front view showing one end of a fixing belt 110. FIG. 28B is a cross sectional view taken on line b—b in FIG. 28A.

In FIG. 28, like or equivalent portions are designated by like reference numerals used in the 10th to 13th embodiments already described.

A feature of this embodiment resides in that a high grip member G is fastened to the fixing belt with a flexible adhesive layer 1163 being interposed therebetween.

As shown in FIG. 28B, an outside diameter D2 of the high grip member G is larger than that D1 of the surface belt layer 1133.

In the embodiment, the outside diameter D2 of the high grip member G is set to be larger than that D1 of the surface belt layer 1133 by selecting a thickness t2 of each of the adhesive layer 1163 and the high grip member G to be larger than a thickness t1 of the surface belt layer 1133.

The high grip member G in this embodiment is made of cloth as described in the 13th embodiment (FIGS. 26 and 27).

The adhesive layer 1163 is a flexible adhesive layer made of adhesive capable of absorbing the release oil (e.g., silicone adhesive).

The fixing device 100 of this embodiment produces the following advantageous effects.

Figure 29:
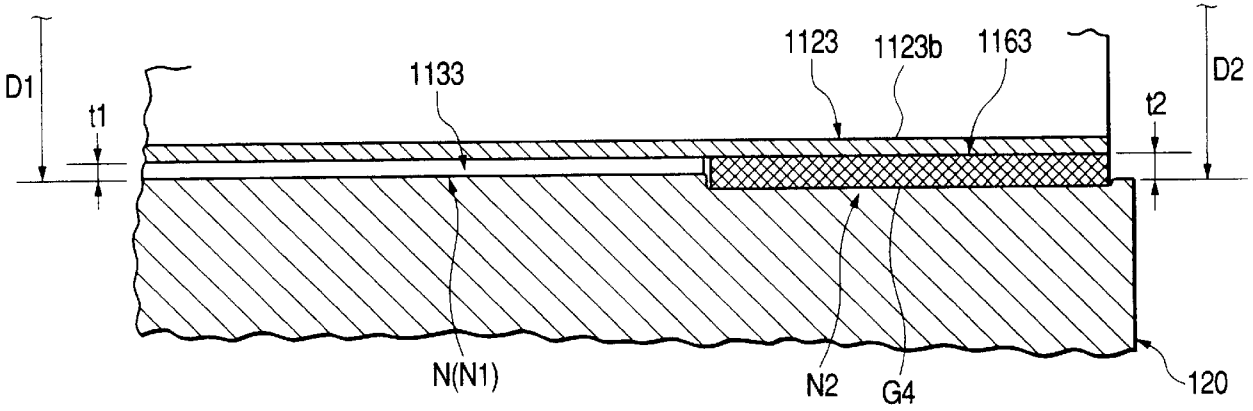
FIG. 29 is a cross sectional view showing the ends N2 of a press contact portion N of the fixing belt.

As described above, the outside diameter D2 of the high grip member G is larger than that D1 of the surface belt layer 1133. Therefore, at the ends N2 of the press contact portion N between the fixing belt 110 and the pressure application roller 120, the high grip members G are pressed against the pressure application roller 120 by a larger pressing force, as shown in FIG. 29. Accordingly, a gripping force is satisfactorily secured between the fixing belt 110 and the pressure application roller 120. And the slip is prevented with certainty (at least its occurrence is extremely infrequent.). As a result, a stable fixing Operation of the fixing device is secured.

The high grip member G is fastened to the fixing belt with the flexible adhesive layer 1163 being interposed therebetween. This feature yields the following advantageous effects.

In this type of the fixing device, during its operation, the fixing belt 110 is heated to be at high temperature (150° C. to 200° C., for example). If the adhesive layer which fastens the high grip member G to each side end of the fixing belt 110 is not flexible, a thermal expansion coefficient difference between the fixing belt 110 and the high grip member G will create the following problem: the belt end is easy to be broken or the high grip member G is easy to peel off the fixing belt.

In this connection, in the fixing device of this embodiment, the adhesive layer which fastens the high grip member G to each side end of the fixing belt 110 is flexible, the thermal expansion coefficient difference between the fixing belt 110 and the high grip member G is soaked up by the adhesive layer 1163. Therefore, there is no chance that the ends of the fixing belt 110 are broken or the high grip member G peels off the belt. The result is increase of the endurance of the fixing belt 110.

As already stated, where the surface of the fixing belt 110 is coated with the release oil, the oil will gradually move to the ends N2 of the press contact portion N between the fixing belt 110 and the pressure application roller 120. However, in this embodiment, the oil having reached the ends N2 of the press contact portion N is absorbed by the high grip member G since the high grip members G are fastened around both the side ends of the fixing belt 110 in the fixing device 100 and the high grip members G have an oil absorbing capability.

Therefore, the amount of oil present on the surfaces of both the side ends of the fixing belt, viz., the surfaces G41 of the cloth G of the high grip members, is small. As a result, a gripping force is satisfactorily secured at both the ends of the press contact portion. The slip is prevented (at least its occurrence is extremely infrequent), and a stable fixing operation of the fixing device is secured.

Thus, the fixing device 100 of this embodiment is able to stably fix the toner image although the surface of the fixing belt 110 is coated with the release oil.

As recalled, the high grip member G has an oil absorbing capability and allows the oil to flow in the belt circumferential direction. Therefore, if the cloth G is saturated with the oil, the oil entering the high grip member G is moved in the belt circumferential direction and excluded out of the ends N2 of the press contact portion (in the vertical direction in FIG. 28A) by the pressing force applied thereto.

Therefore, if the high grip member G is saturated with the oil, the amount of oil present on the surfaces G41 of both the side ends of the fixing belt 110, is small at the press contact portion N2. As a result, a gripping force is satisfactorily secured at both the ends N2 of the press contact portion. The slip is prevented (at least its occurrence is extremely infrequent), and a stable fixing operation of the fixing device is secured.

The high grip member G is permeable to the oil, and capable of absorbing the oil. Accordingly, the oil having entered the ends N2 of the press contact portion N is absorbed by the adhesive layer 1163 through the high grip members G.

Therefore, the amount of oil present on the surfaces G41 of both the side ends of the fixing belt 110, is small. As a result, a gripping force is satisfactorily secured at both the ends of the press contact portion. The slip is prevented (at least its occurrence is extremely infrequent), and a stable fixing operation of the fixing device is secured.

15th Embodiment

Figure 30:
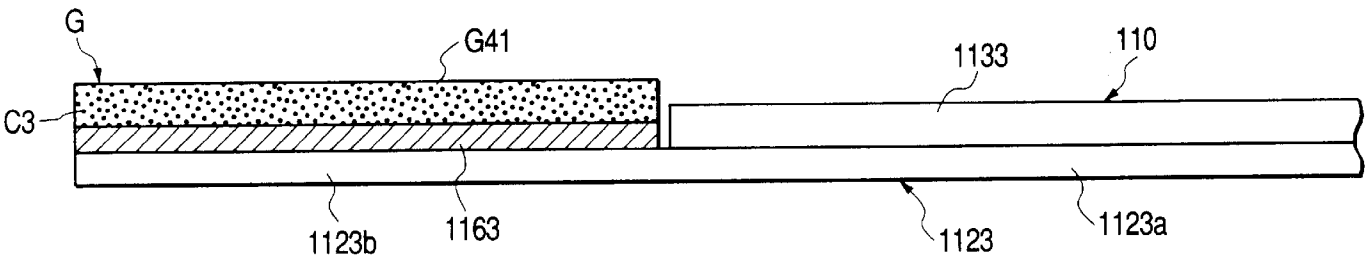
FIG. 30 is an enlarged cross sectional view showing one end of a fixing belt in a fifteenth embodiment of the present invention.

FIG. 30 is an enlarged view showing one end of a fixing belt in a 15th embodiment of a belt fixing device according to the present invention. In the figure, like or equivalent portions are designated by like reference numerals used in the 10th to 15th embodiments already described.

This embodiment is different from those 10th to 14th embodiments in that the high grip member G is made of open-cell (or continuous-cell) porous material (e.g., silicone sponge). The remaing structure of this embodiment is substantially the same as of each of those embodiments. In the figure, an open-cell portion is denoted as C3.

The high grip member G made of the open-cell porous material is also capable of absorbing the release oil, allows the oil to flow in the belt circumferential direction, and is permeable to the oil, by the property of the open-cell portion G3.

Therefore, this embodiment also produces the advantageous effects comparable with those by the 14th embodiment (except the effects by the cloth used for the high grip member G).

16th Embodiment

Figure 31A:
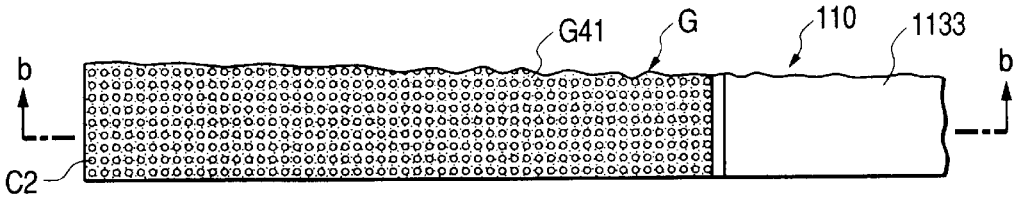
FIGS. 31A and 31B show a key portion of a sixteenth embodiment of the present invention.
Figure 31B:
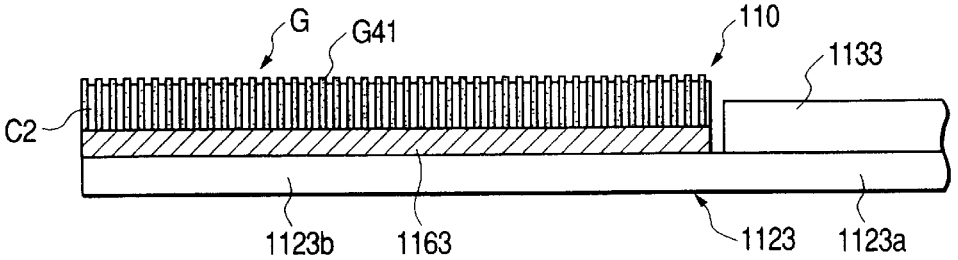

FIGS. 31A and 31B show a key portion of a 16th embodiment of the present invention: FIG. 31A is a plan view showing a part of a fixing belt 110; and FIG. 31B is a cross sectional view taken on line b—b in FIG. 31A. In the figure, like or equivalent portions are designated by like reference numerals used in the 10th to 14th embodiments already described.

This embodiment is different from the 10th to 14th embodiments in that a high grip member G is made of a heat-resistance sheet made of synthetic resin containg a number of empty spaces (or cavities) C2 each extending in the direction orthogonal to the belt surface (vertical direction in FIG. 31A), the lateral direction (horizontal direction in FIG. 31A), and longitudinal direction (vertical direction in FIG. 31A).

The heat-resistance sheet made of synthetic resin has also an uneven surface, and forms the high grip member G, and is also capable of absorbing the release oil, allows the oil to flow in the belt circumferential direction, and is permeable to the oil because of presence of the empty spaces C2.

Therefore, this embodiment also produces the advantageous effects comparable with those by the 14th embodiment (except the effects by the cloth used for the high grip member G).

17th Embodiment

Figure 31C:
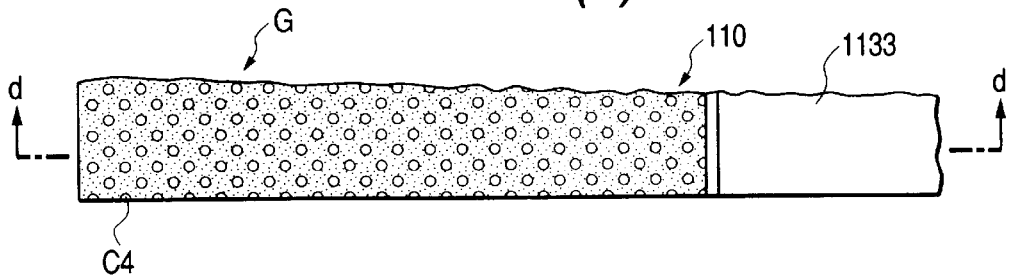
FIGS. 31C and 31D show a key portion of a seventeenth embodiment of the present invention.
Figure 31D:
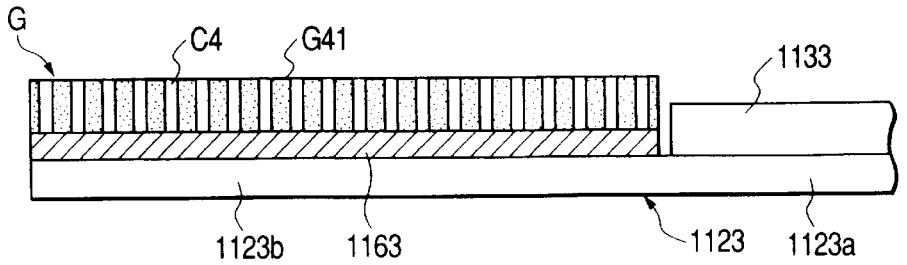

FIGS. 31C and 31D show a key portion of a 17th embodiment of the present invention: FIG. 31C is a plan view showing a part of a fixing belt 110; and FIG. 31D is a cross sectional view taken on line d—d in FIG. 31C. In the figure, like or equivalent portions are designated by like reference numerals used in the 10th to 14th embodiments already described.

This embodiment is different from the 10th to 14th embodiments in that a high grip member G is made of a heat-resistance sheet made of synthetic resin containg a number of perforations (or through-holes) C4. The remaing structure of this embodiment is substantially the same as of each of those embodiments.

The heat-resistance sheet made of synthetic resin has also an uneven surface, and forms the high grip member G, and is also capable of absorbing the release oil, and is permeable to the oil because of presence of the perforations C4.

Therefore, this embodiment also produces the advantageous effects comparable with those by the 14th embodiment (except the effects by the cloth used for the high grip member G and by the oil-flow permitting ability in the belt circumferential direction).

18th Embodiment

Figure 32A:
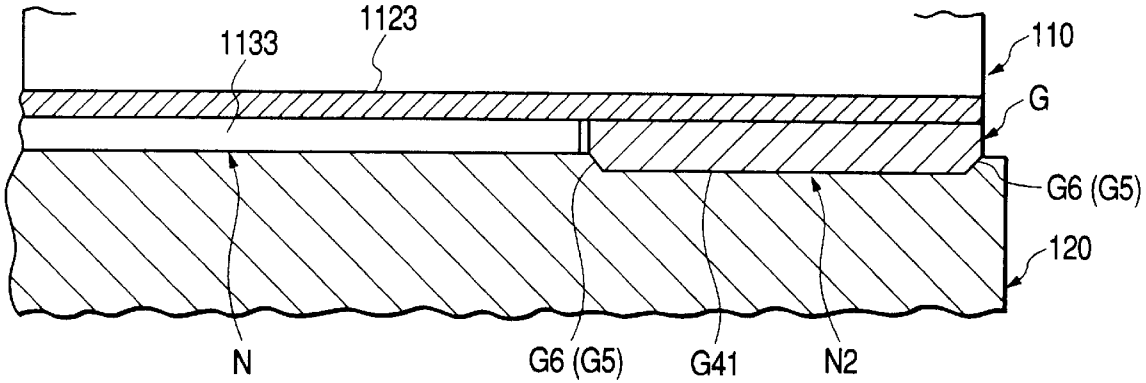
FIG. 32A shows a key portion of an eighteenth embodiment of the present invention and is a cross sectional view showing one end of a fixing nip portion N.

FIG. 32A shows a key portion of an 18th embodiment of the present invention and is a cross sectional view showing one end of a fixing nip portion N. In the figure, like or equivalent portions are designated by like reference numerals used in the 10th to 14th embodiments already described.

This embodiment is different from the 10th to 14th embodiments in that each end of a high grip member G as viewed in the width direction (horizontal direction in FIG. 32A) is beveled (or chamfered) as indicated by G6. The remaing structure of this embodiment is substantially the same as of each of those embodiments.

Figure 33:
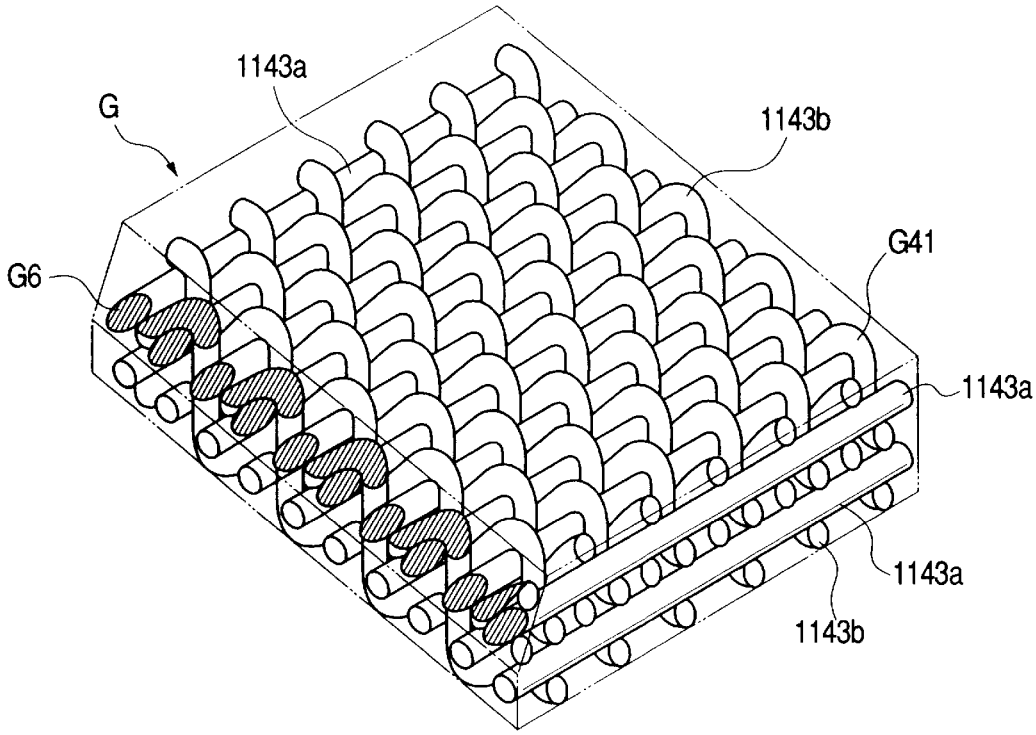
FIG. 33 is a perspective view showing an instance of a beveled surface G6 of a high grip portion G.

When a high grip member G having a double layer structure of mesh members or high grip member G formed with cloth is beveled at each end, the beveled face G6 is as shown in FIG. 33.

In this embodiment, each end of a high grip member Gas viewed in the width direction is beveled (indicated by G6). With the beveled end faces, the stress concentration on the pressure application roller 120 by the ends (G6) of the high grip member G is lessened, and hence the endurance of the pressure application roller 120 is increased, although this embodiment has such a construction that the outside diameter of the high grip member G is larger than that of the surface belt layer 1133, and therefore, at the ends N2 of the press contact portion N between the fixing belt 110 and the pressure application roller 120, the high grip members G are pressed against the pressure application roller 120 by a larger pressing force.

Figure 32B:
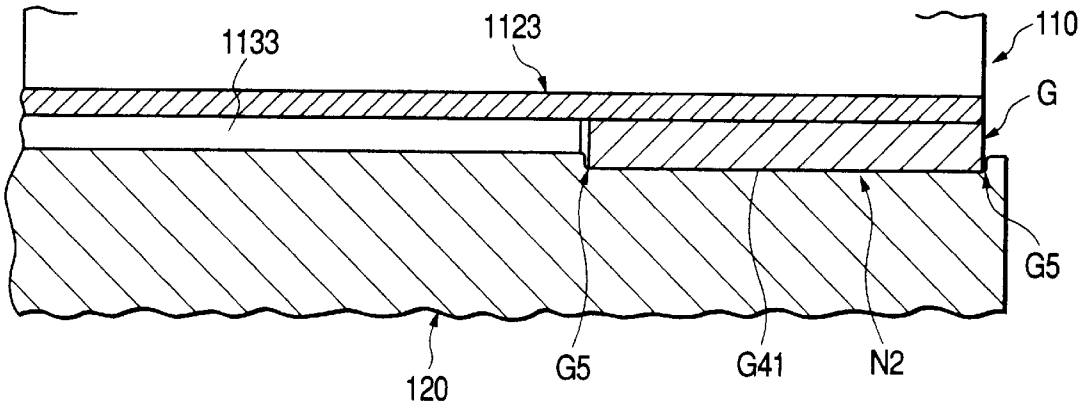
FIG. 32B is a cross sectional view showing an instance for comparison.

As shown in FIG. 32B, in the 10th to 17th embodiments, it is allowed that each end of a high grip member G as viewed in the width direction is not beveled. If not beveled, stress will concentrate on the pressure application roller 120 at its press contact portion with the ends G5 of the high grip member. This leads to reduction of the endurance of the pressure application roller 120. In this sense, that the ends of the high grip members are not beveled is not suggestible.

19th Embodiment

Figure 34:
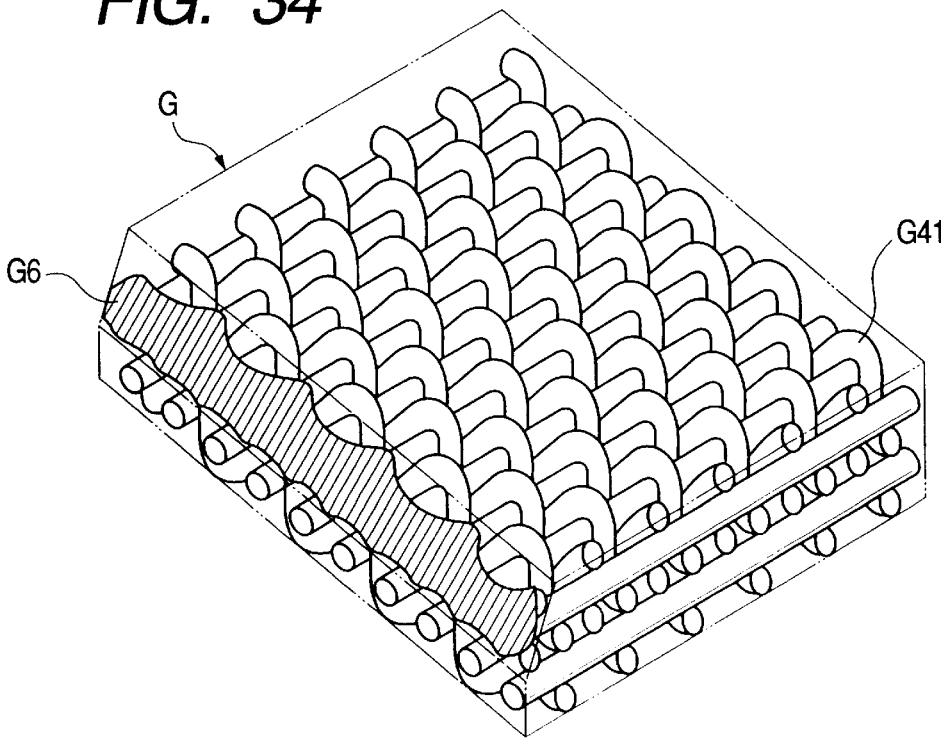
FIG. 34 is a perspective view showing a 19th embodiment of the present invention.

FIG. 34 is a perspective view showing a key portion of a 19th embodiment of the present invention. In the figure, like or equivalent portions are designated by like reference numerals used in the 18th embodiment.

A feature of this embodiment resides in that each beveled surface G6 is smoothed.

The beveled surface G6 may be smoothed in a manner that the beveled surface G6 is coated with fluorine resin or silicone resin, or that each end surface 6 is heated and molten to be slanted.

This embodiment further increases the endurance of the pressure application roller 120 since the beveled surface G6 is smoothed.

20th Embodiment

Figure 35A:
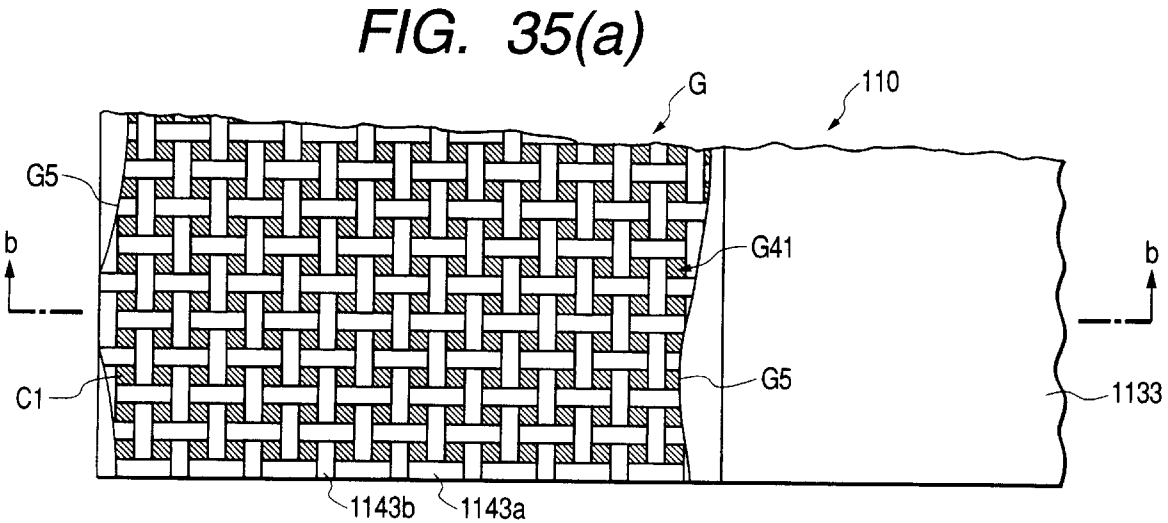
FIG. 35A is an enlarged front view showing one end of a fixing belt 110 in a 20th embodiment of the present invention.
Figure 35B:
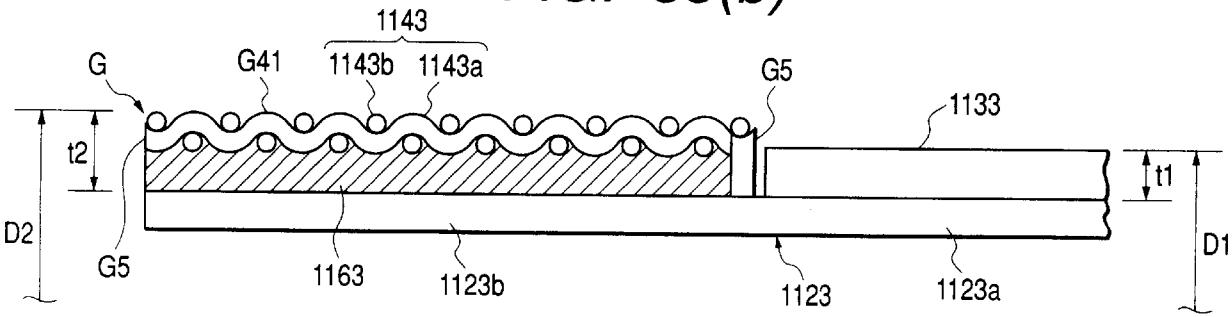
FIG. 35B is a cross sectional view taken on line b—b in FIG. 35A.
Figure 36:
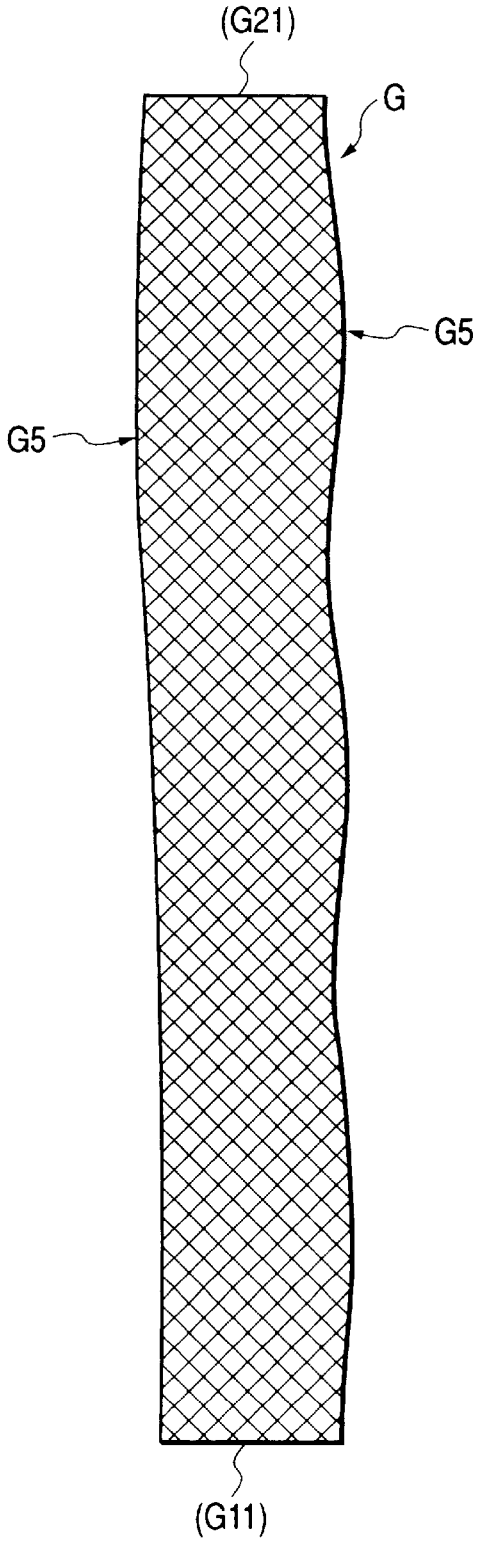
FIG. 36 is a development of a high grip member G.

FIG. 35A is an enlarged front view showing a part of a fixing belt 110 in a 20th embodiment of the present invention, and FIG. 35B is a cross sectional view taken on line b—b in FIG. 35A. FIG. 36 is a development of a high grip member G. In FIGS. 35 and 36, like or equivalent portions are designated by like reference numerals used in the 19th embodiment.

A feature of this embodiment resides in that each side edge G5 of a high grip member G is not linear or is offset in the circumferential direction as shown in FIGS. 35 and 36.

In other words, the side edge is not linear in the direction orthogonal to the belt width direction (horizontal direction in FIG. 35). In this embodiment, both side edges G5 are configured to be gently wavy when viewed from front or along the circumference of the fixing belt.

Also in this embodiment, the outside diameter D2 of the high grip member G is larger than that D1 of the surface belt layer 1133, as shown in FIG. 35B. In the embodiment, the outside diameter D2 of the high grip member G is set to be larger than that D1 of the surface belt layer 1133 by selecting a thickness t2 of each of the adhesive layer 1163 and the high grip member G to be larger than a thickness t1 of the surface belt layer 1133.

Figure 37:
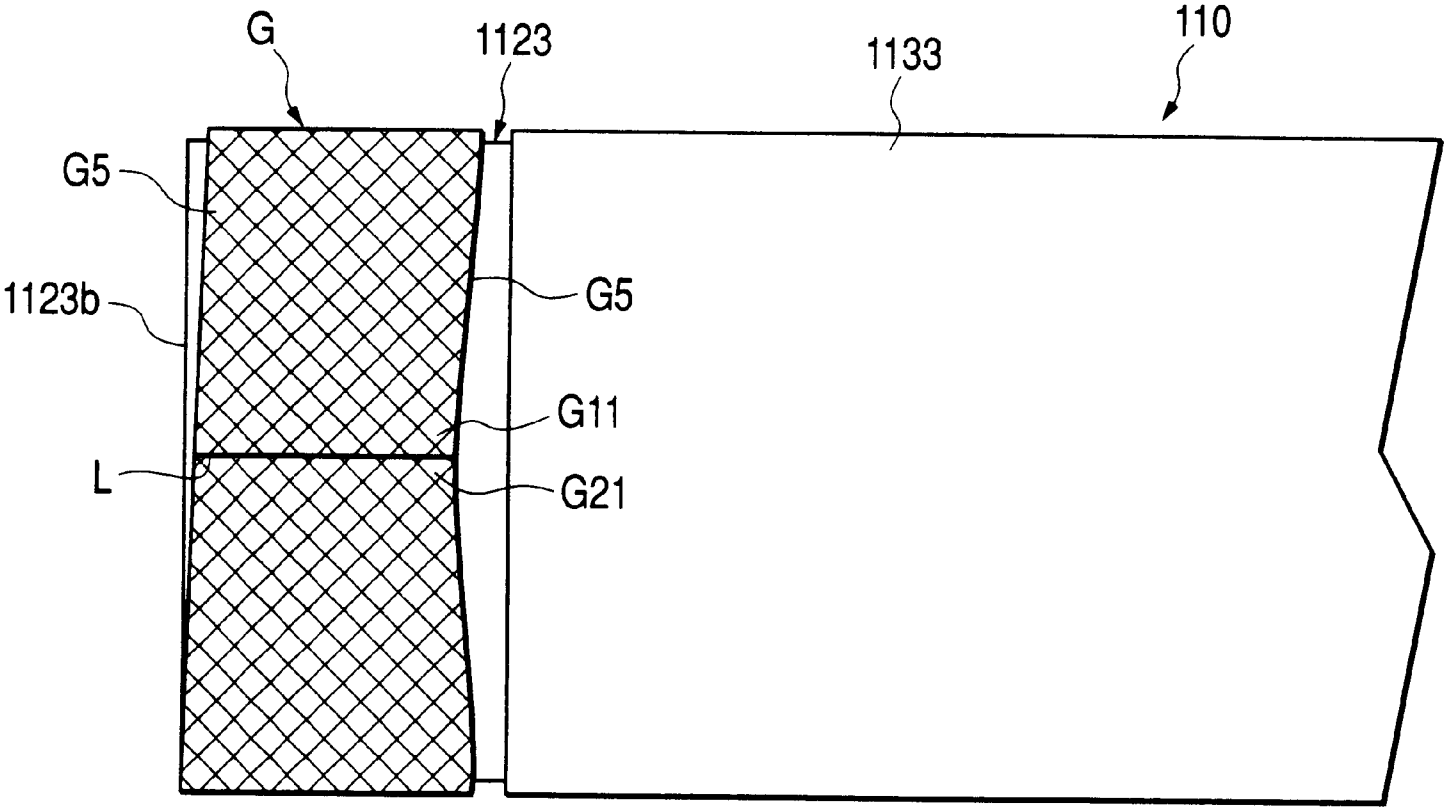
FIG. 37 is a front view showing one end of a modification of the fixing belt 110.
Figure 38A:
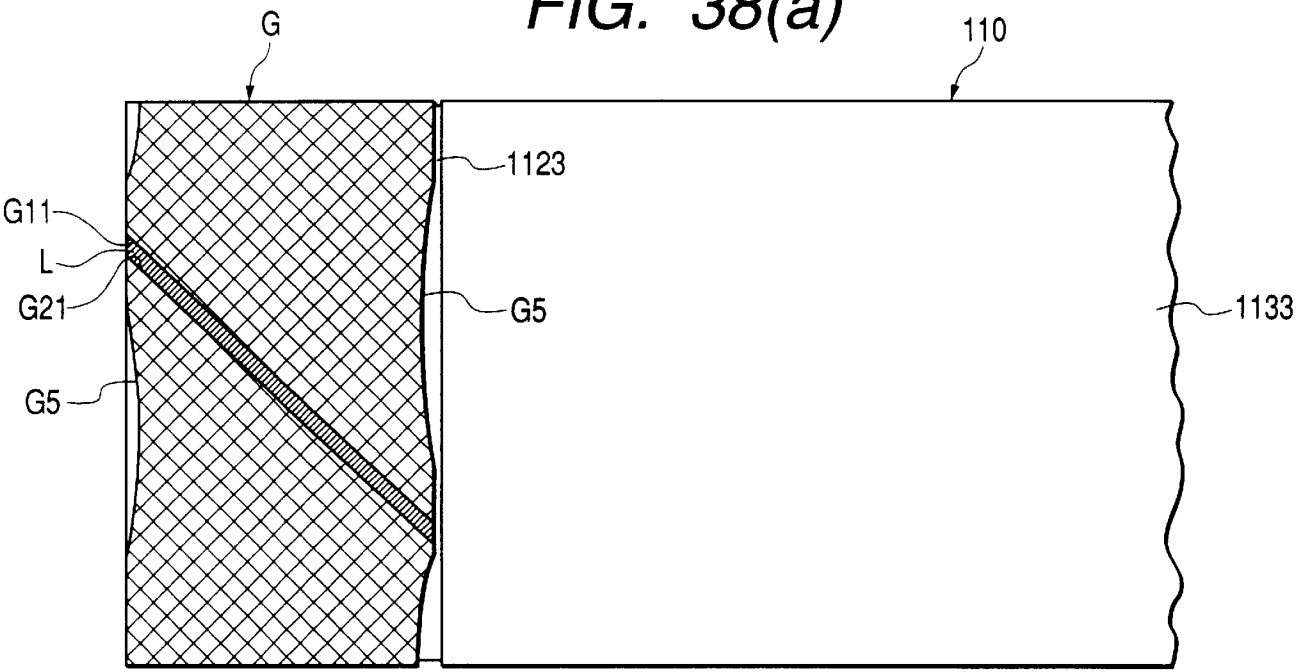
FIG. 38A is a front view showing a part of the fixing belt 110.
Figure 38B:
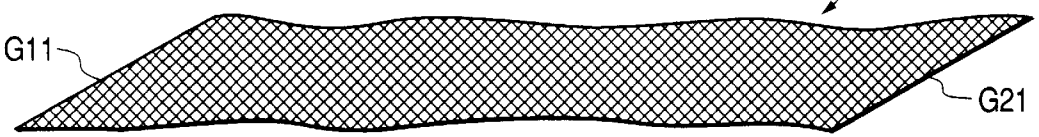
FIG. 38B is a development of a high grip member G.

This embodiment may be designed such that the high grip portion G is formed with an expandable member shaped like an endless belt. The belt-like high grip member has an inside diameter smaller than an outside diameter of each side end 1123*b* of the fixing belt when it is in a free state. By the utilization of its expandability, the belt-like high grip member G is expanded to be somewhat larger than the outside diameter 1123*b* of the belt base 1123, and is fit to each side end 1123*b* with an adhesive layer 1163 being interposed therebetween, and is fastened to each side end 1123*b* of the belt base 1123 by its expandability and by use of the adhesive layer 1163. Alternatively, a tape-like high grip member G is put around each side end of the fixing belt as shown in FIG. 37. FIG. 36 is a development of the high grip member G. FIG. 38A is a front view showing a part of a fixing belt 110 constructed such that the winding start end G11 of the tape-like high grip member G is confronted with the winding terminating end G21 in a state that a gap slanted to the axial direction of the pressure application roller is interposed therebetween. FIG. 38B is a development of the tape-like, high grip member G.

This embodiment in which each side edge of a high grip member is not linear in the circumferential direction produces the following advantageous effects.

Figure 39:
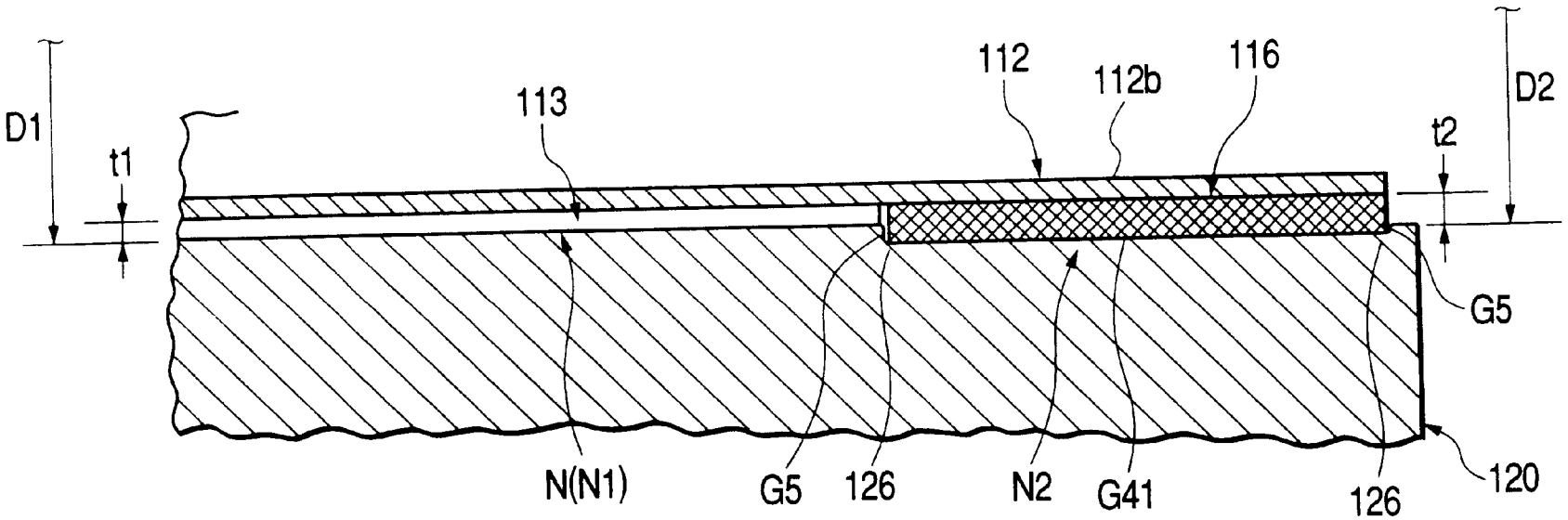
FIG. 39 is a cross sectional view showing the ends N2 of the press contact portion N in the embodiment, useful in explaing the operation thereof.

If each side edge of the high grip member is linear in the circumferential direction (it is linear in the direction orthogonal to the belt width direction (horizontal direction in FIG. 35), positions 126 (see FIG. 39) of the pressure application roller 120, which is to be in pressing contact with the fixing belt 110, at which it is pressed against the side edges G5 of the high grip member G are locally worn or deformed, to thereby possibly reduce the endurance of the pressure application roller 120.

In this connection, in this embodiment, each side edge of the high grip member is not linear in the circumferential direction. Because of this configuration, the local wearing or deformation of the pressure application roller 120 are lessened (those are broken up in the direction in which the side edge is wavy). This results increase of the endurance of the pressure application roller 120.

The advantageous effects may be produced when the outside diameter D2 of the high grip member G is not larger than that D1 of the surface belt layer 1133 of the fixing belt 110; however, the effects are marked when the outside diameter D2 of the high grip member G is not larger than that D1 of the surface belt layer 1133. That is, where the outside diameter D2 of the high grip member G is not larger than that D1 of the surface belt layer 1133 of the fixing belt 110, if no measure is taken, the local wearing or deformation at the positions 126 of the pressure application roller 120 at which it is pressed against the side edges G5 of the high grip member G will be promoted. In this embodiment, however, each side edge of the high grip member is not linear in the circumferential direction, the local wearing or deformation of the pressure application roller 120 are lessened and hence the pressure application roller 120 is improved in its endurance.

21st Embodiment

Figure 40:
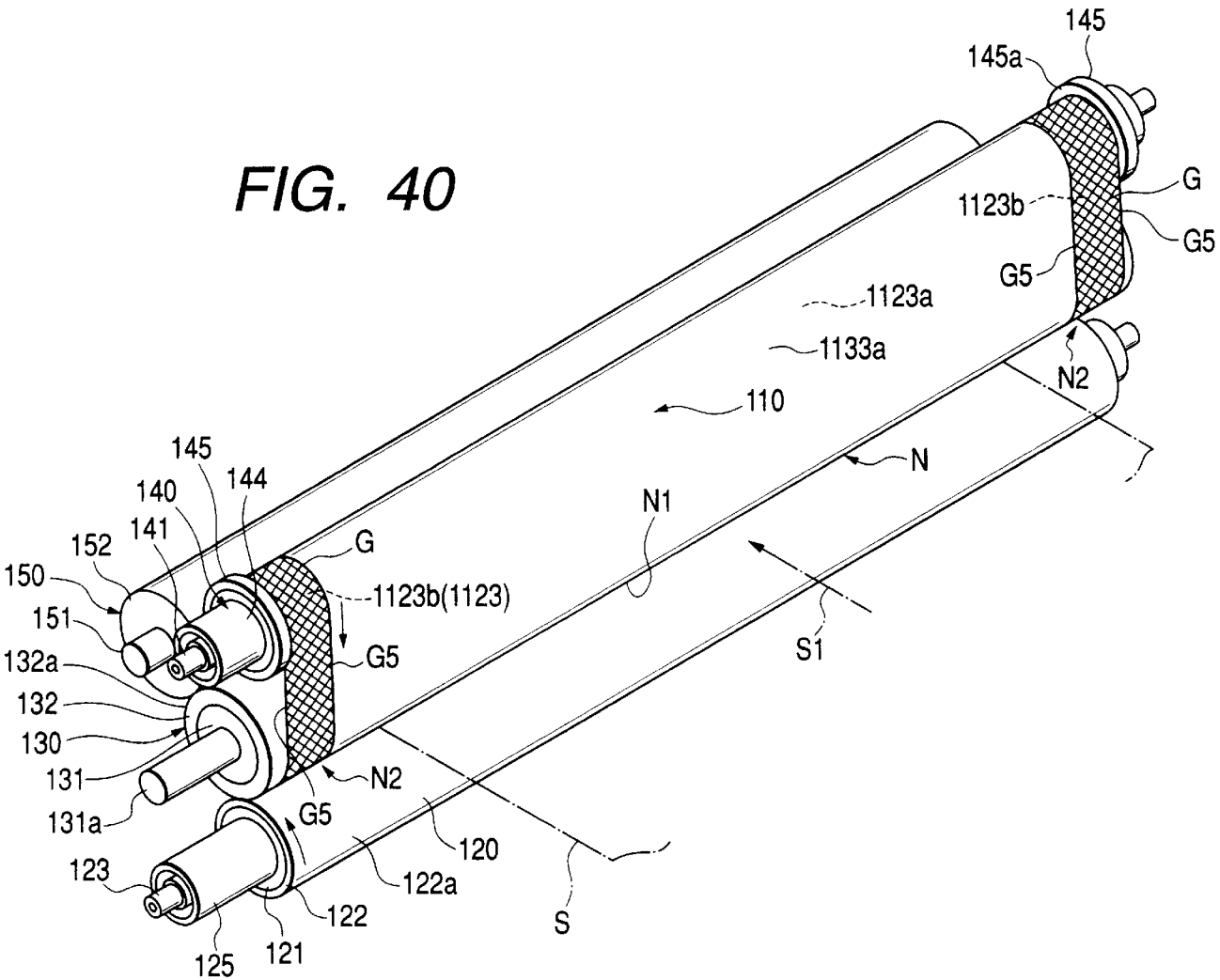
FIG. 40 is a perspective view showing a key portion of a 21st embodiment of the present invention.
Figure 41A:
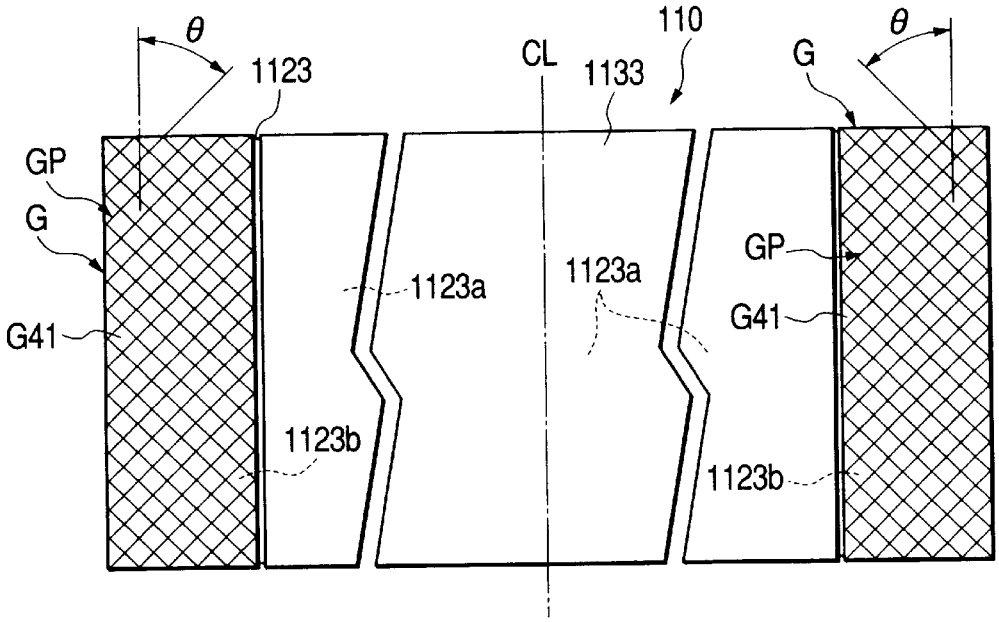
FIG. 41A is a front view showing a part of a fixing belt 110.
Figure 41B:
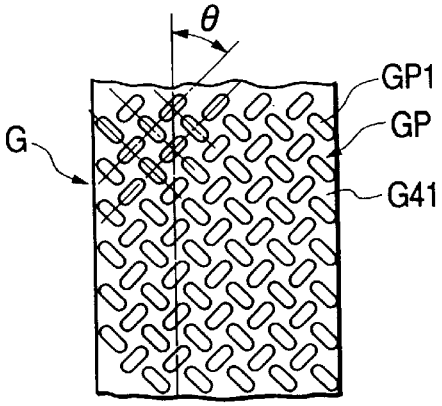
FIGS. 41B and 41C are front views showing exemplary uneven patterns.
Figure 41C:
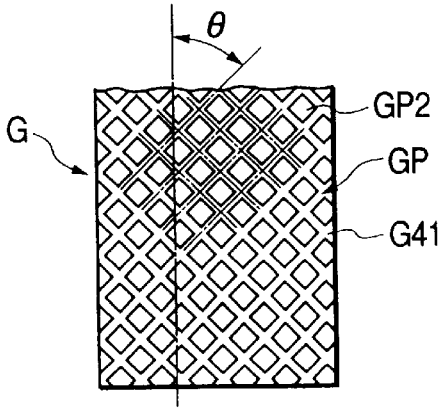

FIG. 40 is a perspective view showing a key portion of a 21st embodiment of the present invention. FIG. 41A is a front view showing a part of a fixing belt 110. FIGS. 41B and 41C are front views showing exemplary uneven patterns. In the figure, like or equivalent portions are designated by like reference numerals used in the 10th to 20th embodiments already described.

A feature of this embodiment resides in that an uneven pattern GP on a surface G41 of a high grip member G is slanted with respect to the width direction. In FIG. 41, an angle of an inclination of the uneven pattern GP to the circumferential direction of the belt (vertical direction in FIG. 41) is denoted as θ. The inclination angle of the uneven pattern GP is preferably selected such that those uneven patterns are axially symmetry with respect to the center line CL as view in the width direction of the fixing belt 110. In this embodiment, it is approximately 45°.

The high grip member G may be made of an appropriate material, e.g., rubber or synthetic resin. An appropriate pattern may be used for the uneven pattern GP on the surface of the high grip member. A lattice pattern is illustrated in FIG. 41A. A pattern shown in FIG. 42B consists of successions of elongated holes (or indentations) or elliptical (track-like) protrusions GP1. A pattern shown in FIG. 42C consists of successions of rectangular or diamond indentations (or holes) or protrusions GP2.

Figures 42A, 42B:
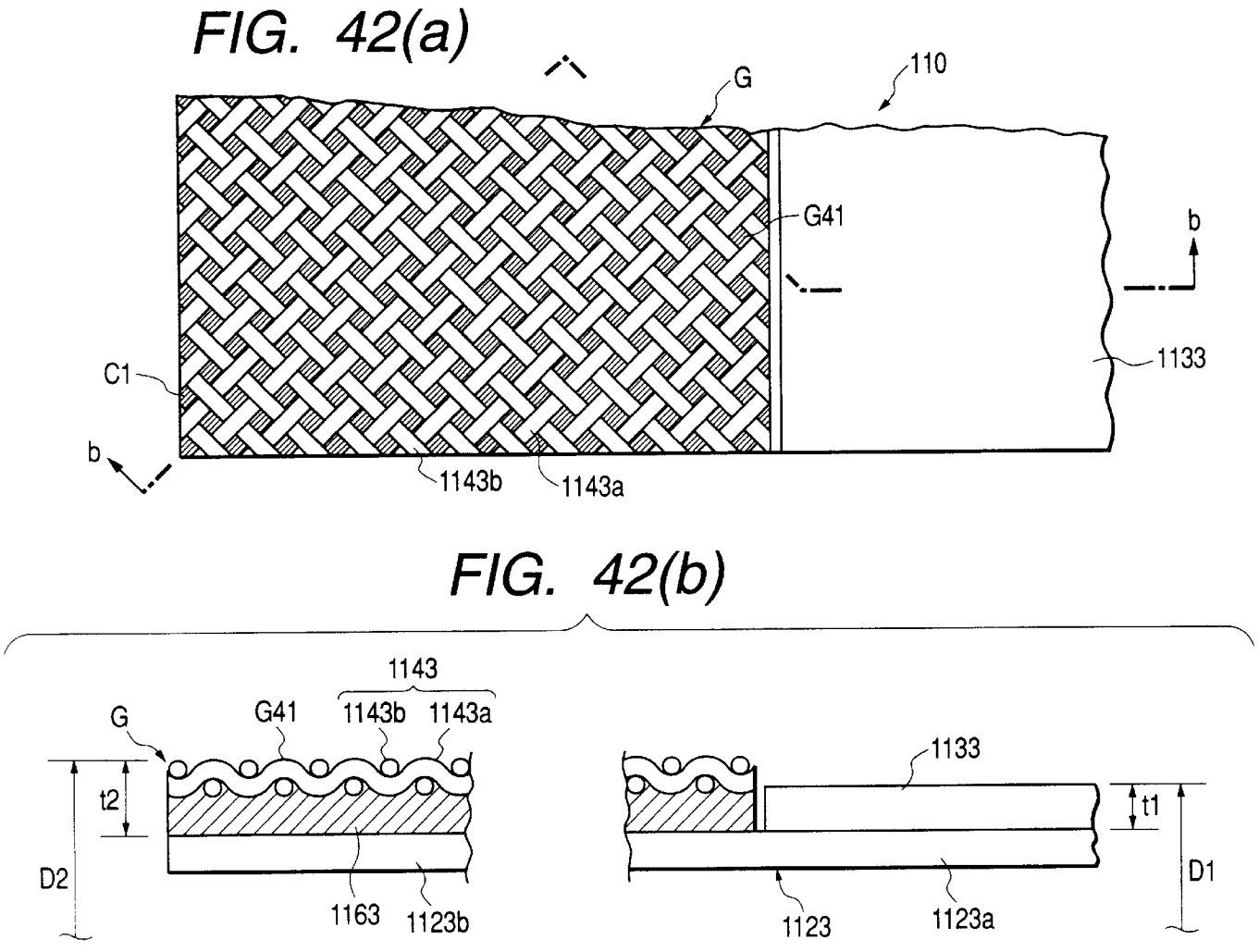
FIG. 42A is a front view showing a part of the belt.
FIG. 42B is a cross sectional view taken on line b—b in FIG. 42A.

FIG. 42 diagrammatically shows one end of a fixing belt 110 employed in this embodiment. FIG. 42A is a front view showing a part of the belt. FIG. 42B is a cross sectional view taken on line b—b in FIG. 42A.

In this embodiment, the high grip member G is made of cloth (involving a mesh-like member) formed by weaving or knitting threads 1143*a* and 1143*b* crossing each other, as shown in FIG. 42.

This embodiment produces additional advantageous effects as described below.

The uneven pattern GP on the surface G41 of the high grip member G is slanted with respect to the width direction. This feature produces a called wedge effect (wedge effect in the rotational direction (power transmission direction)) by the uneven pattern GP at the press contact portion N2 (see FIG. 40) of it with the pressure application roller 120. As a result, the gripping force by the high grip portion (G) is increased, and an uneven pattern GP on a surface G41 of a high grip member G is slanted with respect to the width direction. The slip is prevented (at least its occurrence is extremely infrequent), and a stable fixing operation of the fixing device is secured.

If the uneven pattern on the surface of the high grip member is not slanted with respect to the width direction (it is parallel to the axial direction of the pressure application roller 120, for example), a vibration by the drive power transmission (vibration due to the uneven pattern) may increase. However, in this embodiment, such a vibration is remarkably reduced since the uneven pattern GP on the surface G41 of the high grip member G is slanted with respect to the width direction. Accordingly, a smooth drive power transmission is secured.

Further, the uneven patterns on the surface G41 of the high grip member G are axially symmetry with respect to the center line CL as view in the width direction of the fixing belt 110. Therefore, thrust forces (acting in the belt width direction) caused by the inclination of the uneven pattern GP are cancelled, so that the fixing belt 110 stably runs.

22nd Embodiment

Figure 43A:
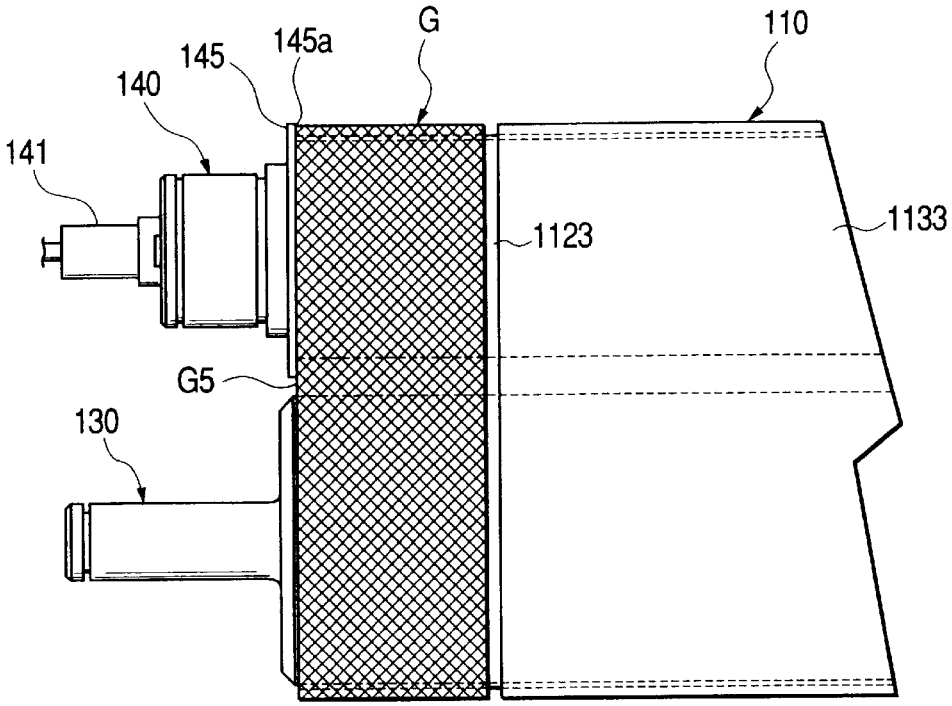
FIG. 43A is a front view of the belt end.
Figure 43B:
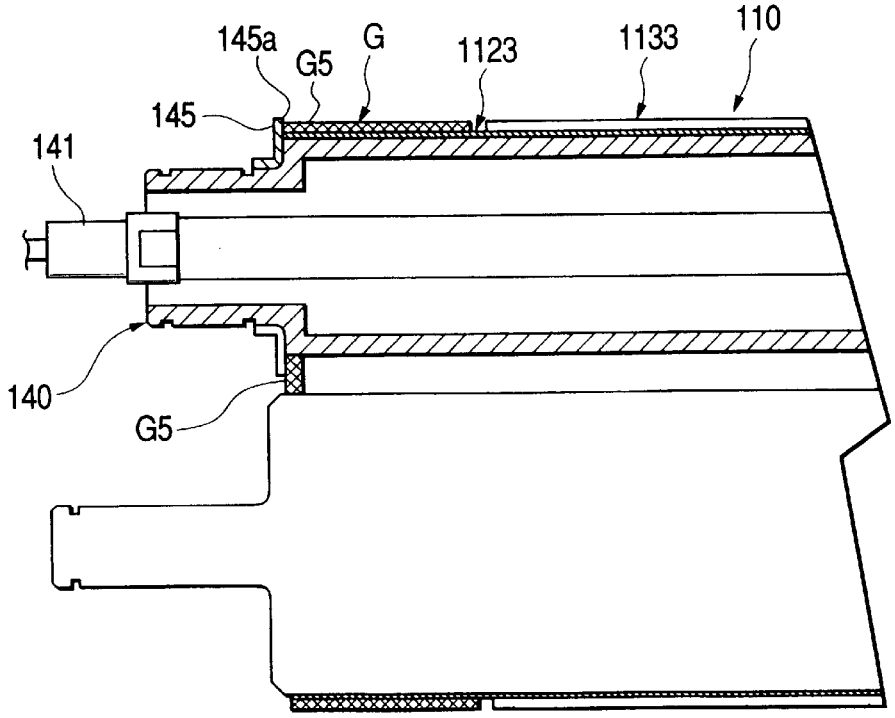
FIG. 43B is a longitudinal sectional view showing the same.

FIG. 43 diagrammatically shows one end of a fixing belt 110 extending around the backup roller 130 and heating roller 140 in a 22nd embodiment of a belt fixing belt according to the present invention. FIG. 43A is a front view of the belt end. FIG. 43B is a longitudinal sectional view showing the same. In those figures, like or equivalent portions are designated by like reference numerals used in the 10th to 21th embodiments already described.

Figure 44A:
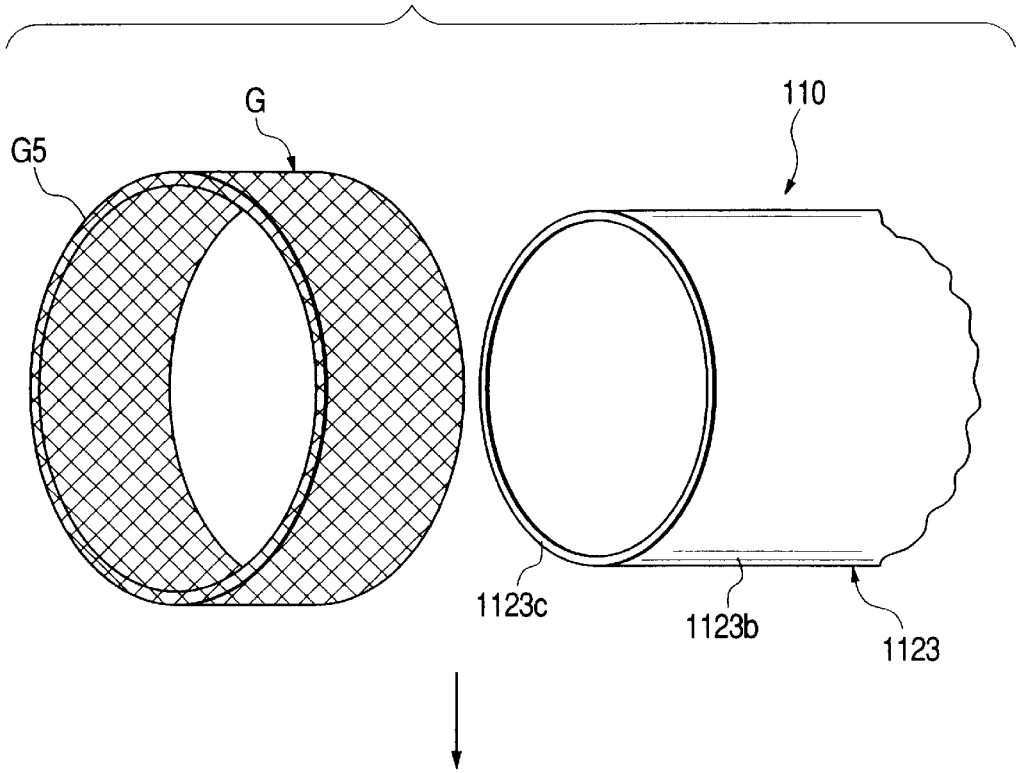
FIG. 44A is an exploded, perspective view showing one end of the fixing belt 110 (before it is extended over the backup roller 130 and the heating roller 140)
Figure 44B:
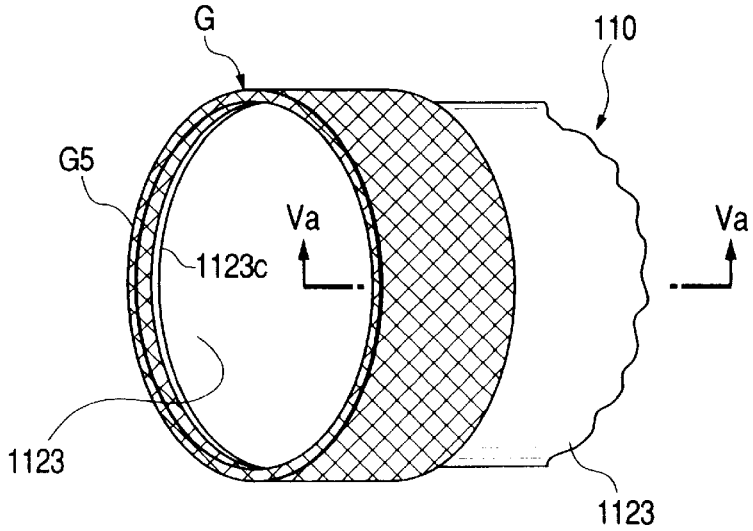
FIG. 44B is a perspective view showing the end thereof.
Figure 45:
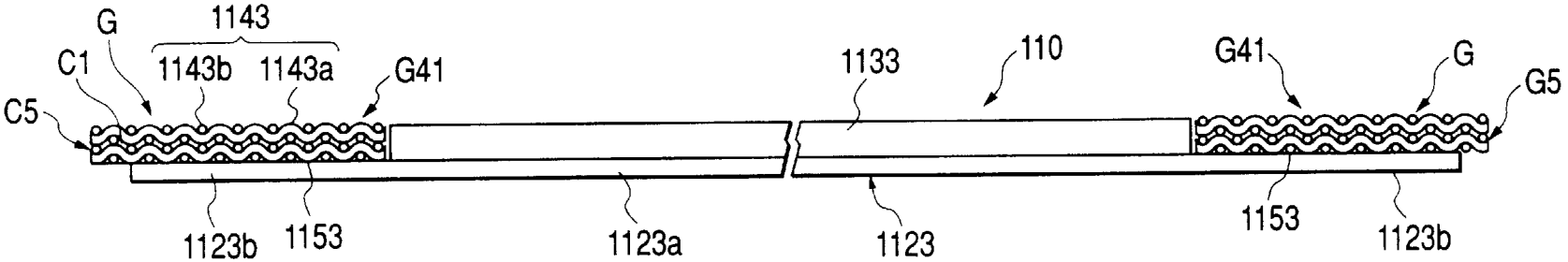
FIG. 45 a cross sectional view showing a part of the fixing belt 110.

Feature of this embodiment reside in that as shown in FIGS. 44B and 45, a high grip member G is fastened to each side end 1123*c* of the belt base 1123 such that the outer end G5 of the high grip member G is extended outward beyond the side end 1123*c* of the belt base 1123, and that the outer end G5 of the high grip member G is brought into contact with the inner face 145*a* of a guide ring 145 as a restricting mechanism.

FIGS. 44A and 44B show an instance where the high grip member G is formed with an expandable member shaped like an endless belt, which has an inside diameter smaller than an outside diameter of each side end 1123*b* of the fixing belt when it is in a free state, and as shown in FIG. 44A, by the utilization of its expandability, the belt-like high grip member G is expanded to be somewhat larger than the outside diameter 1123*b* of the belt base 1123, and is fit to each side end 1123*b* with an adhesive layer 1153 (not shown in FIG. 44) being interposed therebetween as shown in FIG. 44B, and is fastened to each side end 1123*b* of the belt base 1123 by its expandability and by use of the adhesive layer 1153.

FIG. 45 a diagrammatically shows an instance in which the high grip member G is made of cloth.

Figure 46A:
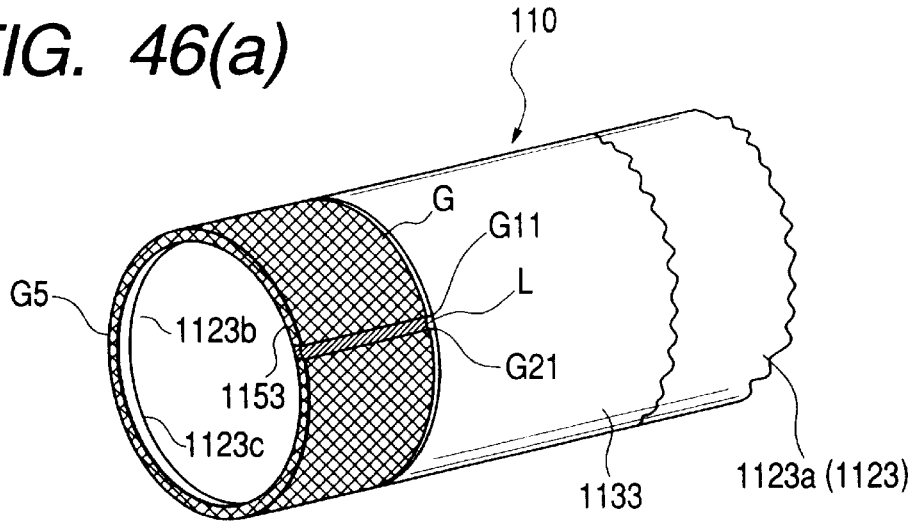
FIG. 46A is a perspective view showing a part of the fixing belt 110 (before it is extended over the backup roller 130 and the heating roller 140)
Figure 46B:
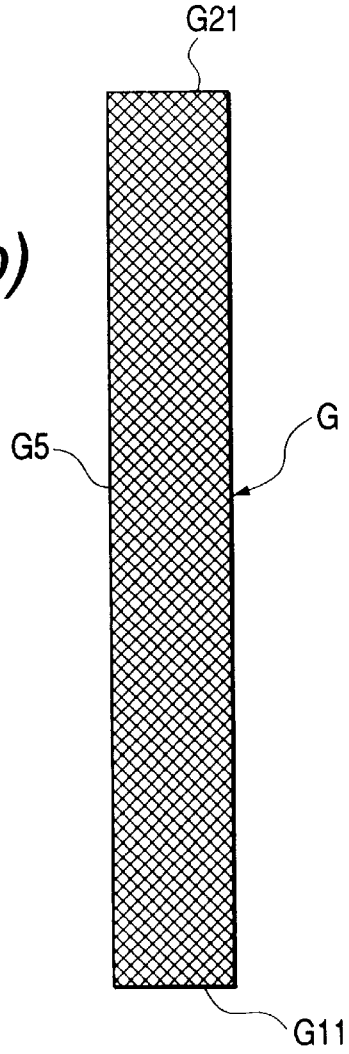
FIG. 46B is a development of a high grip member G.

FIG. 46 diagrammatically shows an instance in which a tape-like, high grip member G as shown in FIG. 46B is bonded to and around each of the side ends 1123*b* of the belt base 1123 by use of an adhesive layer 1163 as shown in FIG. 46A.

Figure 47A:
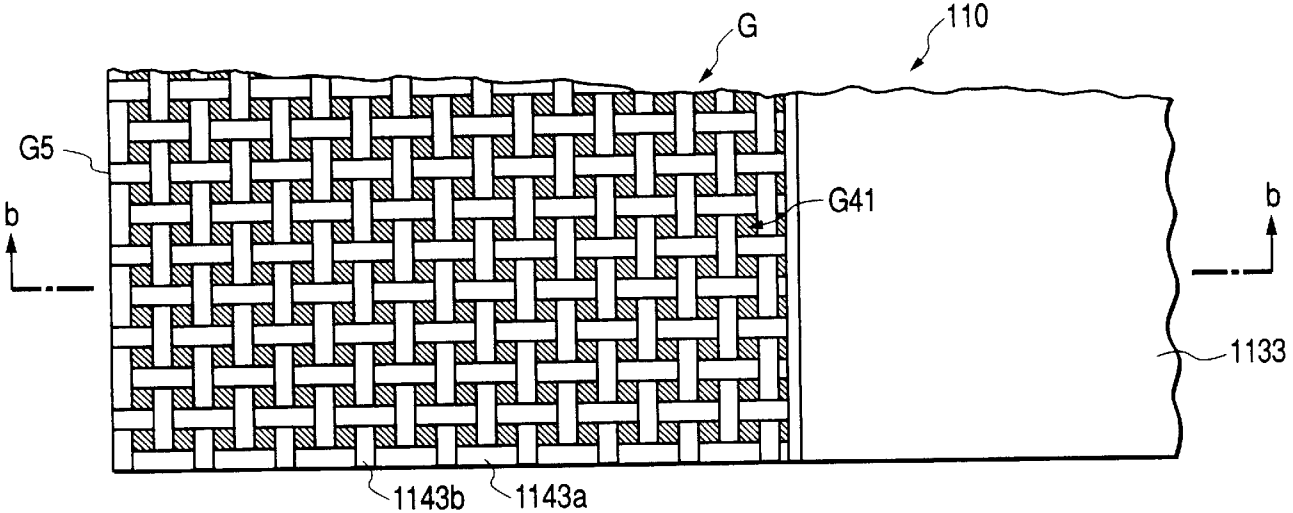
FIG. 47A is an enlarged, front view of the belt end.
Figure 47B:
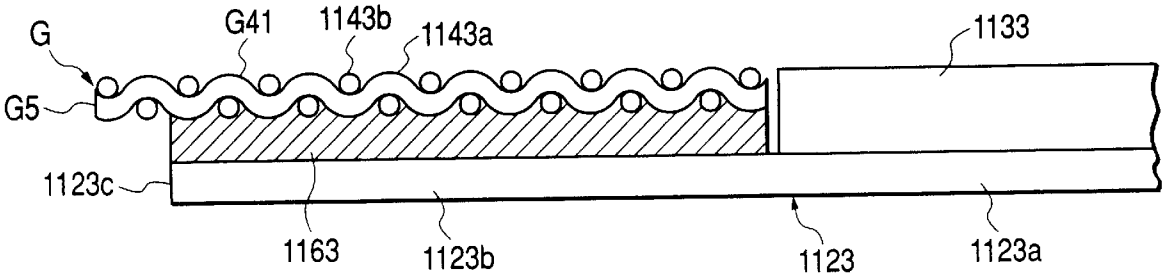
FIG. 47B is a cross sectional view taken on line b—b in FIG. 47A.

FIG. 47 is a diagram showing an instance where a high grip member G is bonded to and around each of the side ends 1123*b* of the belt base by use of an adhesive layer 1163 having an oil absorbing capability (e.g., silicone adhesive layer).

Figure 48A:
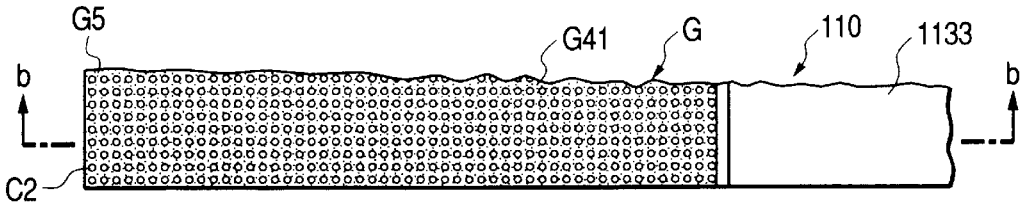
FIGS. 48A and 48B show a modification of the fixing belt.
Figure 48B:
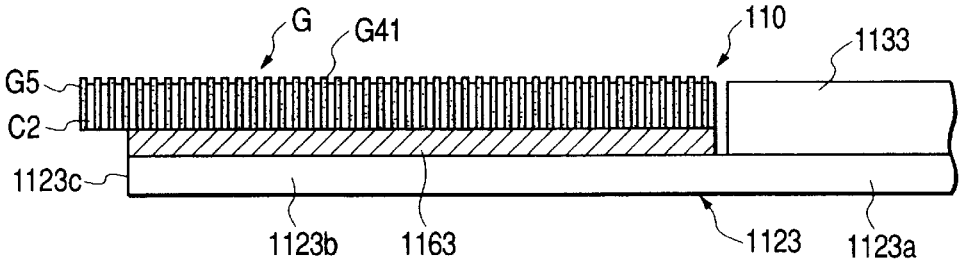

FIGS. 48A and 48B show an instance where a high grip member G is made of a heat-resistance sheet made of synthetic resin containg a number of empty spaces C2 each extending in the direction orthogonal to the belt surface (vertical direction in FIG. 48B), the lateral direction (horizontal direction in FIG. 48A), and longitudinal direction (vertical direction in FIG. 48A).

Figure 48C:
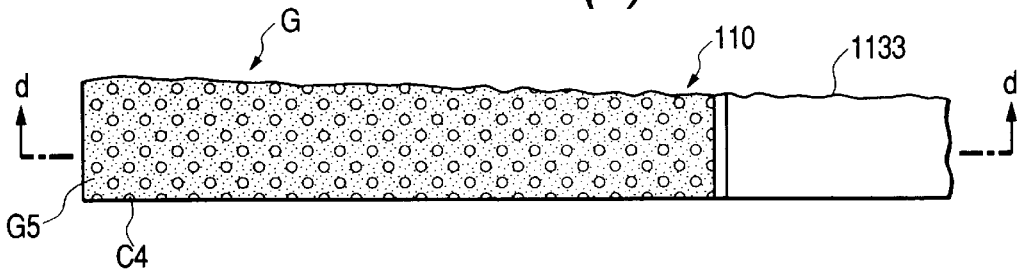
FIGS. 48C and 48D show another modification of the fixing belt.
Figure 48D:
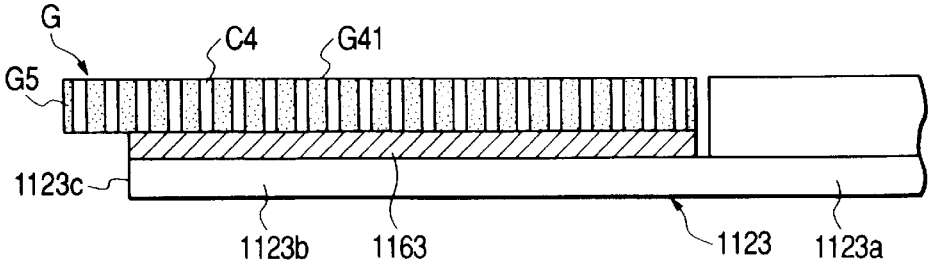

FIGS. 48C and 48D show an instance where a high grip member G is made of a heat-resistance sheet made of synthetic resin containg a number of perforations C4.

This embodiment produces additional advantageous effects as described below.

The side edges G5 of the fixing belt 110 is brought into contact with the restricting members 145, so that such a behavior of the traveling fixing belt 110 as to move aside is restricted.

Since the side edges G5 of the fixing belt 110 is brought into contact with the restricting members 145, the following advantageous effects are produced additionally.

The high grip members G are fastened to both side ends of the fixing belt 110, so that the both side ends of the fixing belt 110 are reinforced. Further, the high grip member G comes into contact with the restricting member 145. Therefore, the endurance of the fixing belt 110 is increased although such a construction is employed that the side end of the fixing belt 110 comes into contact with the restricting member 145.

Therefore, the fixing belt 110 may be thinned in structure. The fixing belt 110 well follows an unevenness corresponding to the amounts of attached toner forming a toner image. This results increase of a fixing strength or a fixing uniformity. Further, a heat capacity of the fixing belt 110 is small, so that it may be heated quickly.

When the side edge G5 of the fixing belt 110 is brought into contact with the restricting members 145 to restrict a zig-zag traveling of the fixing belt 110, a shearing force acting on the side edge of the belt is great in magnitude. If the high grip members G that are applied to both side ends of the fixing belt 110 are made of cloth, the high grip portion G is unlikely to be broken and propagation of the breakage to the whole fixing belt 110 is also greatly impeded.

23rd Embodiment

Figure 49A:
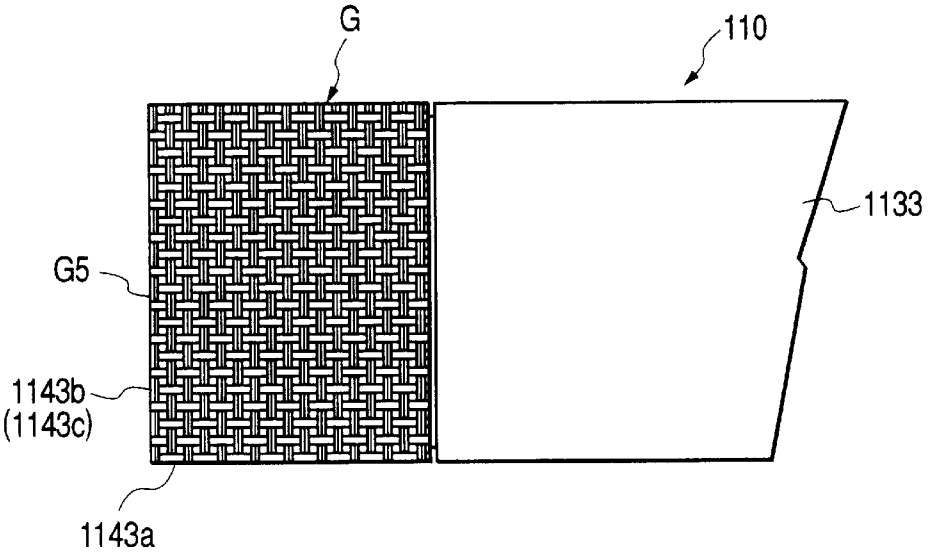
FIG. 49A is a front view of the belt end.
Figure 49C:
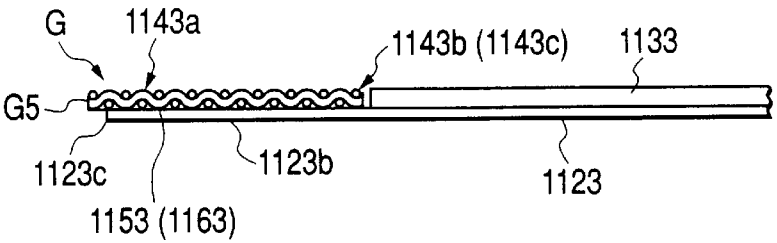
FIG. 49C is a cross sectional view taken on line c—c in FIG. 49B.
Figure 49B:
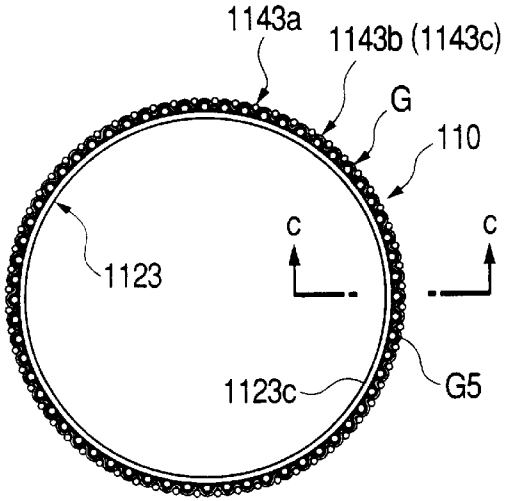
FIG. 49B is a side view of the same.

FIG. 49 is a perspective view showing one end of a fixing belt 110 which is a 23rd embodiment of the present invention. FIG. 49A is a front view of the belt end. FIG. 49B is a side view showing the same. FIG. 49C is a cross sectional view taken on line c—c in FIG. 49B. In those figures, like or equivalent portions are designated by like reference numerals used in the 22nd embodiment already described.

This embodiment is different from the 22nd embodiment in that a rigidity of the high grip member G in the belt width direction (horizontal direction in FIG. 49A) is larger than that in the belt circumferential direction (vertical direction in FIG. 49A). The remaing structure of this embodiment is substantially the same as of the 22nd embodiment.

In this embodiment, the high grip member G is made of cloth in which the weft 1143*a* is formed with single threads (, e.g., called mono-filaments), and the warp 1143*b* is formed of threads each consisting of an aggregation of a plural number of very fine threads (called multi-filaments, for example), whereby a rigidity of the high grip member G in the belt width direction is larger than that in the belt circumferential direction.

The advantageous effects produced by this embodiment are similar to those by the 22nd embodiment. Additionally, this embodiment produces the follow effects. That is, since a rigidity of the high grip member G in the belt width direction is larger than that in the belt circumferential direction, the following advantageous effects are obtained.

Since the rigidity of the high grip member G in the belt circumferential direction is relatively small, when the high grip member G is fastened to the side end of the fixing belt 110, the high grip member G is expanded, so that the fitting of the high grip member G to the belt side end is easy. Further, the high grip member G is well fit around the side end of the fixing belt. Since the rigidity of the high grip member G in the belt width direction is relatively large, its buckling strength is increased when it is brought into contact with the restricting members 145. As a result, such a behavior of the traveling fixing belt 110 as to move aside is restricted satisfactorily.

24th Embodiment

Figure 50:
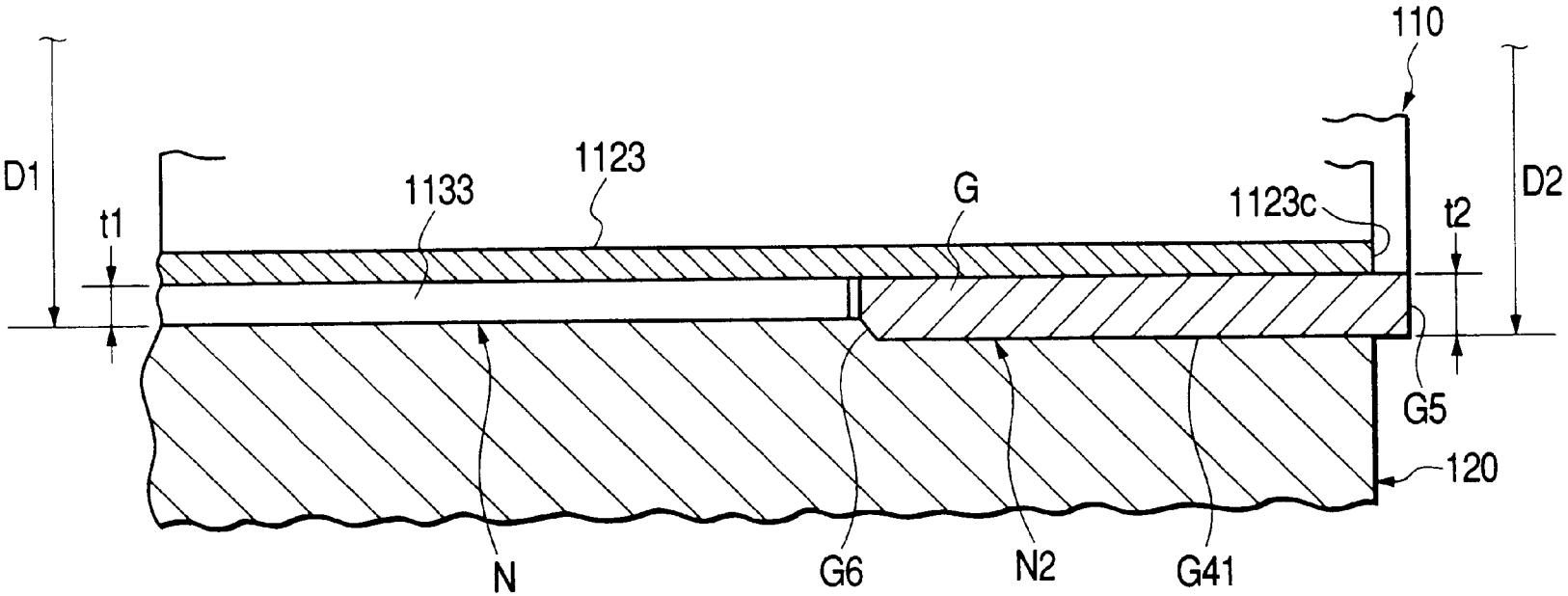
FIG. 50 is a cross sectional view showing the ends of a fixing nip (press contact portion) N in a key portion of a 24th embodiment of the present invention.

FIG. 50 is a cross sectional view showing one end of a press nip portion (press contact portion) N of a fixing belt which is a 24th embodiment of the present invention. In the figure, like or equivalent portions are designated by like reference numerals used in the 22nd embodiment already described.

This embodiment is different from the 22nd and 23rd embodiments in that an outside diameter D2 of a high grip member G is larger than that D1 of the surface belt layer 113, and that the inner side edge G6 of the high grip member G is beveled. The remaing construction of the second embodiment is substantially the same as of those embodiments.

In this embodiment, the outside diameter D2 of the high grip member G is set to be larger than that D1 of the surface belt layer 1133 by selecting a thickness t2 of the high grip member G to be larger than a thickness t1 of the surface belt layer 1133.

This embodiment produces the following advantageous effects in addition to those by the 22nd and 23rd embodiments.

The outside diameter D2 of the high grip member G is larger than that D1 of the surface belt layer 1133. Therefore, at both the ends N2 of the press contact portion N between the fixing belt 110 and the pressure application roller 120, the high grip members G are pressed against the pressure application roller 120 by a larger pressing force. Accordingly, a gripping force is satisfactorily secured between the fixing belt 110 and the pressure application roller 120. And the slip is prevented with certainty (at least its occurrence is extremely infrequent.). As a result, a stable fixing operation of the fixing device is secured. Further, stress concentration on the pressure application roller 120 is lessened since the inner side edge G6 of the high grip member G is beveled.

25th Embodiment

A feature of this embodiment resides in that in each of the 10th to 24th embodiments, the high grip member G is made of a material having a thermal expansion coefficient substantially equal to that of the belt base 1123.

When the belt base 1123 is made of conductive polyimide, for example, the high grip member G is made of the polyimide.

That an adhesive layer 1153 in this embodiment is flexible is not essential. Use of adhesive of polyimide is preferable for the adhesive layer.

This embodiment has the following advantageous effects since a thermal expansion coefficient of the high grip member G is substantially equal to that of the fixing belt 110.

As already stated, in this type of the fixing device, when it is operated, the fixing belt 110 is heated to high temperature (e.g., approximately 150° C. to 200° C.). If the thermal expansion coefficient of the high grip member G fastened to each side end of the fixing belt 110 is greatly different from than that of the fixing belt 110, a stress is generated at both the fastening faces (1153) by the thermal expansion coefficient difference. As a result, the bent side ends are easy to be broken or the high grip member G is easy to strip off the belt.

In this connection, in this embodiment, the thermal expansion coefficient of the high grip member G is substantially equal to that of the fixing belt 110 (viz., it is made of a material having a thermal expansion coefficient substantially equal to that of the fixing belt 110). Therefore, little or a little stress is caused by the thermal expansion coefficient difference. As a result, the problem of damaging the side ends of the fixing belt 110 and the stripping of the high grip member G is solved. Consequently, the endurance of the fixing device is increased.

This will be described in detail with reference to FIGS. 51 and 52.

Figures 51A, 51B, 51C, 51D:
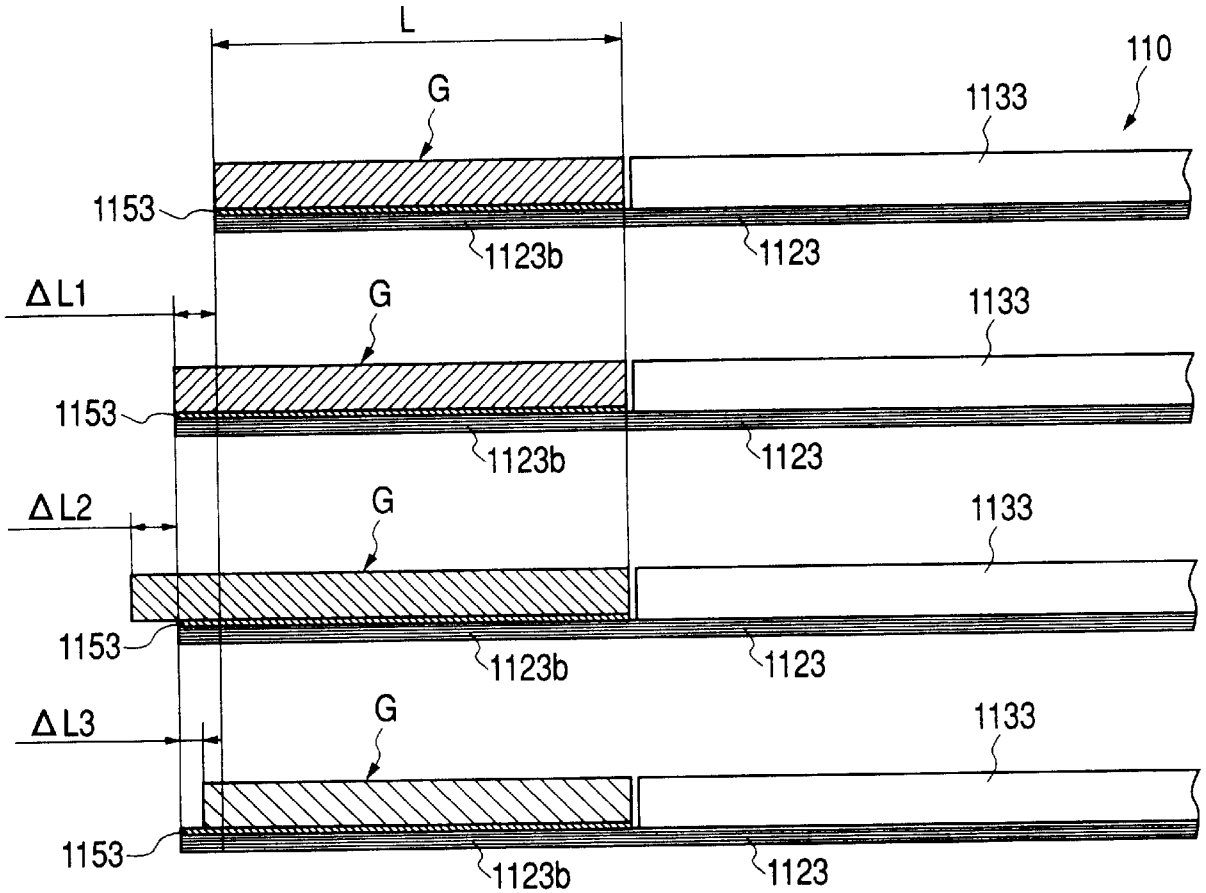
FIGS. 51A to 51D are cross sectional views showing the belt end in a 25th embodiment of the present invention, useful in explaining the operation of the embodiment.

FIGS. 51A to 51D are cross sectional views showing the belt end. FIG. 51A shows a structure state of the belts before the fixing device is operated (before the fixing belt 110 is heated). FIGS. 51B to 51D show structure states of the fixing belt after the fixing device is operated (after the fixing belt 110 is heated). FIG. 51B shows a structure of this embodiment. FIG. 51C shows a structure state in a case where a thermal expansion coefficient of the high grip member G is larger than that of the fixing belt 110 (belt base 1123). FIG. 51D shows a structure state in a case where a thermal expansion coefficient of the high grip member G is smaller than that of the fixing belt 110.

Figure 52A:
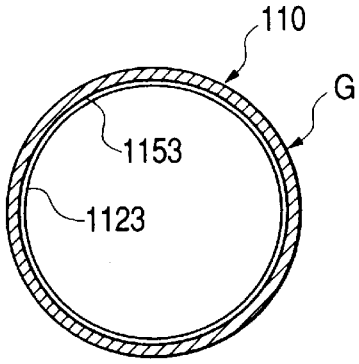
FIGS. 52A to 52D are cross sectional views showing the belt end in a 26th embodiment of the present invention, useful in explaining the operation of the embodiment.
Figure 52B:
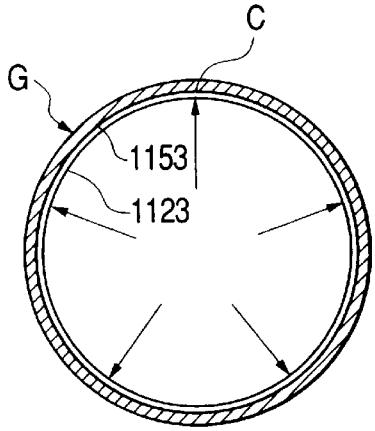
Figure 52C:
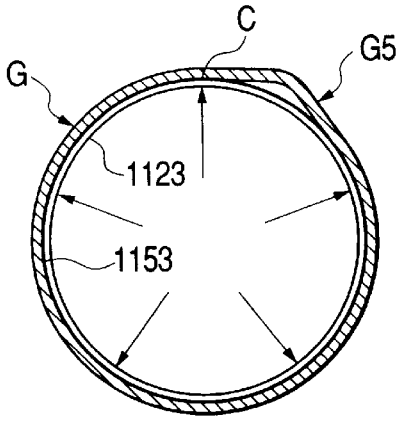
Figure 52D:
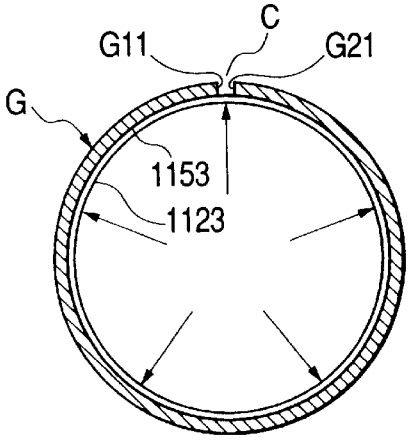

FIGS. 52A to 52D are side views showing the belt end. FIG. 52A shows a structure state of the belts before the fixing device is operated (before the fixing belt 110 is heated). FIGS. 52B to 52D show structure states of the fixing belt after the fixing device is operated (after the fixing belt 110 is heated). FIG. 52B shows a structure of this embodiment. FIG. 52C shows a structure state in a case where a thermal expansion coefficient of the high grip member G is larger than that of the fixing belt 110 (belt base 1123). FIG. 52D shows a structure state in a case where a thermal expansion coefficient of the high grip member G is smaller than that of the fixing belt 110.

As shown in FIGS. 51C and 52C, when a thermal expansion coefficient of the high grip member G is larger than that of the fixing belt 110, a stress ($\Delta L2/L$) is generated in each of the fastening portions (1153) of them by a thermal expansion coefficient difference $\Delta L2$ between those members. The belt ends are easy to be broken or as shown in FIG. 52C, the high grip member G is easy to peel off the belt. A peeling portion is denoted as G5.

As shown in FIGS. 51D and 52D, when a thermal expansion coefficient of the high grip member G is smaller than that of the fixing belt 110, a stress ($\Delta L3/L$) is generated in each of the fastening portions (1153) of them by a thermal expansion coefficient difference $\Delta L23$ between those members. The belt ends are easy to be broken. Also in this case, the high grip member G is easy to peel off the belt. When the high grip member G is a tape-like one, as shown in FIG. 52D, a gap C between the winding start end G11 and the winding terminating end G21 will increase.

In this connection, in the fixing device 100 of this embodiment, the thermal expansion coefficient of the high grip member G is substantially equal to that of the fixing belt 110. As shown in FIG. 51B, those members are thermally expanded by approximately equal length $\Delta L1$. Therefore, as shown in FIGS. 51B and 52B, little or a little stress is generated in the fastening portions of those members by the thermal expansion coefficient difference. The problems of damaging the side ends of the fixing belt 110 and the peeling of the high grip member G from the fixing belt 110 are solved successfully. Further, the problem of the increasing of the gap C is also solved.

26th Embodiment

Figure 53A:
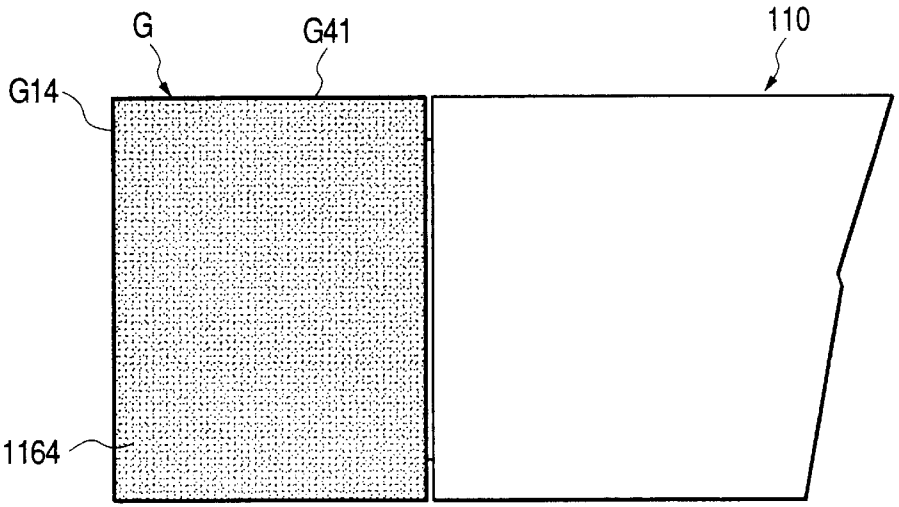
FIG. 53A is a front view showing a part of a fixing belt 110.
Figure 53B:
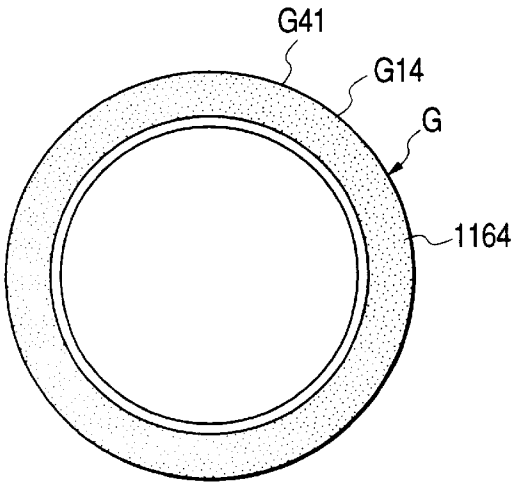
FIG. 53B is a left side view of the same.
Figure 53C:
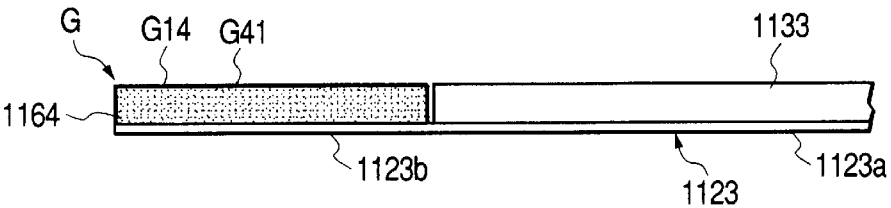
FIG. 53C is a traverse cross sectional view showing of the belt end.

FIG. 53 is a diagrammatic view showing a major portion of a 26th embodiment of the present invention: FIG. 53A is an enlarged, front view showing a part of a fixing belt 110 (before it is extended around the backup roller 130 and the heating roller 140); FIG. 53B is a left side view of the same; and FIG. 53C is a traverse cross sectional view showing of the belt end. In FIG. 53, like or equivalent portions are designated by like reference numerals used in the 10th to 25th embodiment already described.

A feature of this embodiment resides in that the high grip member G is made of a composite material of high friction material G114 and material 1164 having an oil absorbing capability. The high friction material G114 may be particulate material (e.g., glass beads) for creating gripping force for the pressure application roller 120. The material 1164 having an oil absorbing capability may be silicone rubber having an adhesive property. The particulate material is mixed into the silicone rubber. The side ends 1123*b* of the belt base 1123 are coated with the composite material to form high grip portions G. Accordingly, a tremendous number of particles of the high friction material G114 appear on the surfaces G41 of the high grip portions G thus formed.

In this embodiment, since the high grip portion G is made of a composite material of high friction material G114 and material 1164 having an oil absorbing capability, the following advantageous effects are produced.

Where the surface of the fixing belt 110 is coated with the release oil, the oil will gradually move to the ends N2 of the press contact portion N. However, in this embodiment, the high grip portion G is made of a composite material of high friction material G114 and material 1164 having an oil absorbing capability. Therefore, the oil having reached the ends N2 of the press contact portion N is absorbed by the material 1164 having the oil absorbing capability.

Accordingly, the amount of oil present on the surfaces G41 of the high grip portions G where the high friction material G114 are exposed, is small. As a result, a gripping force is satisfactorily secured at both the ends N2 of the press contact portion. The slip is prevented (at least its occurrence is extremely infrequent), and a stable fixing operation of the fixing device is secured.

Thus, the fixing device 100 of this embodiment is able to stably fix the toner image although the surface of the fixing belt 110 is coated with the release oil.

Further, since the high grip member G is made of a composite material of high friction material G114 and material 1164 having an oil absorbing capability, its strength is also increased. The and material 1164 has an oil absorbing capability. Thence, a strength of the high grip portion G is further increased.

27th Embodiment

Figure 54A:
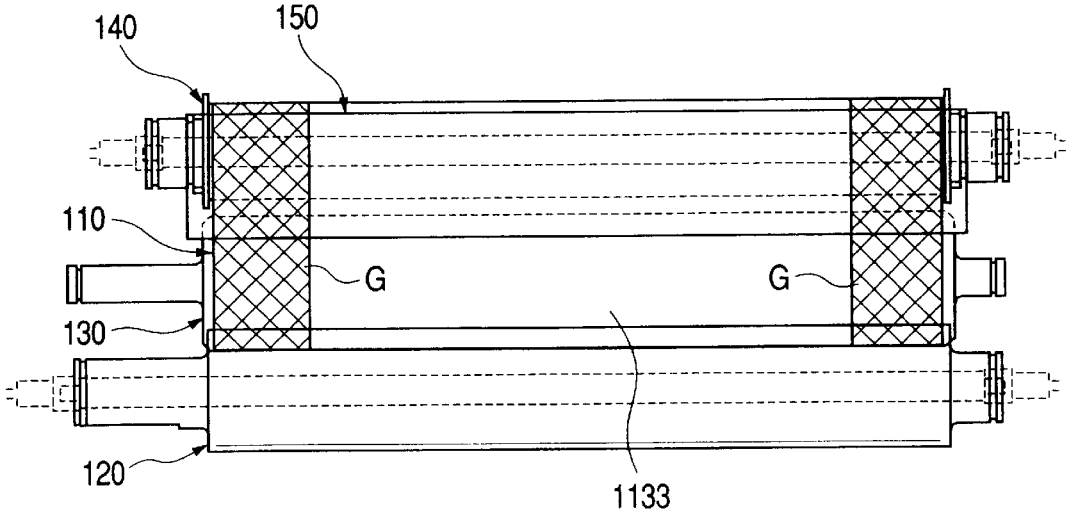
FIGS. 54A and 54B are front views showing a key portion when viewed from the oil coating roller 150 side.
Figure 54B:
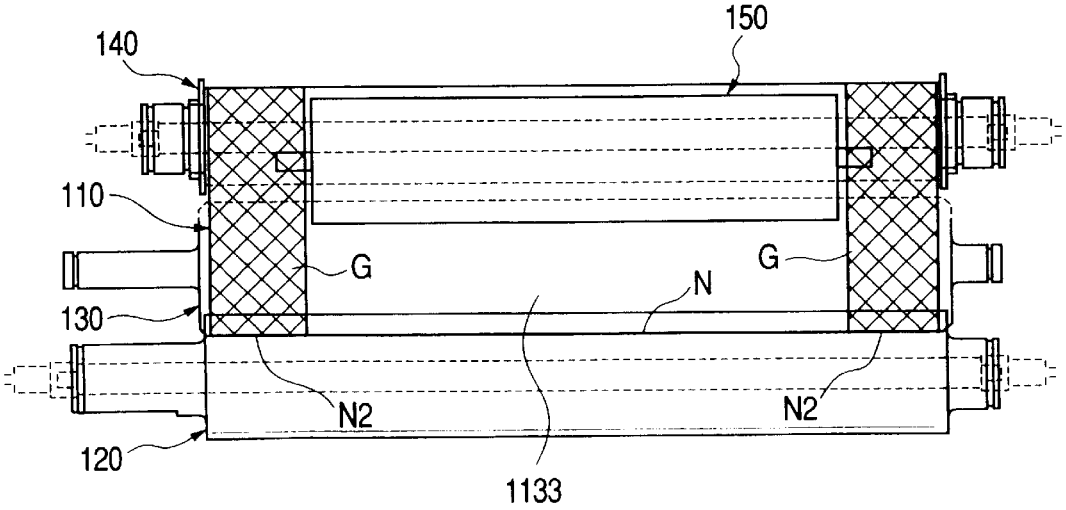

A feature of this embodiment resides in that as shown in FIG. 54B, a length of the oil coating roller 150 is somewhat shorter than the width of the surface belt layer 1133, whereby release oil is applied to only an image forming area.

Figure 55:
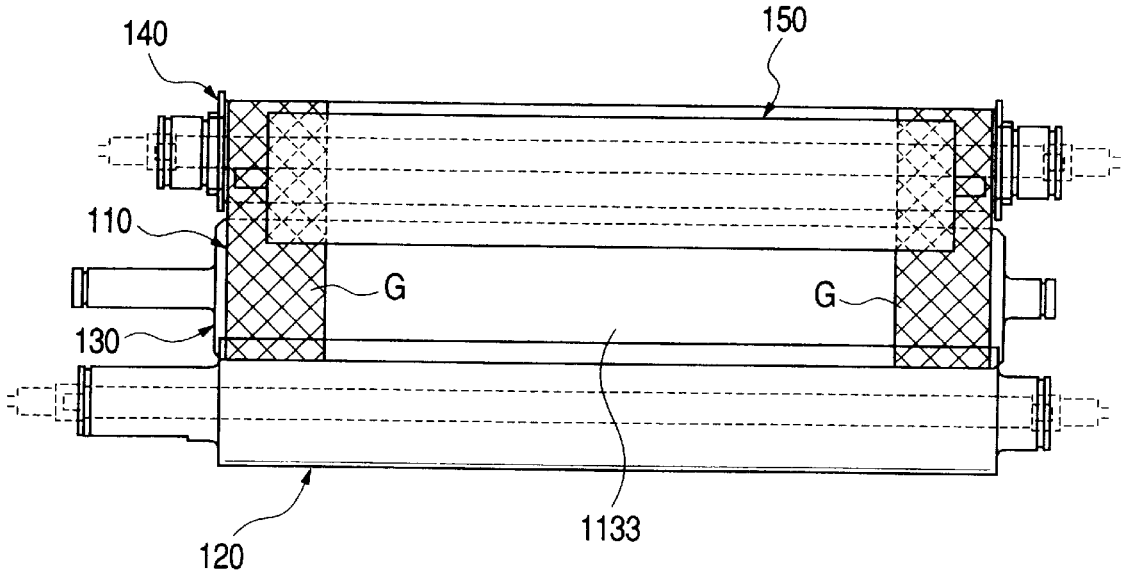
FIG. 55 is an explanatory diagram showing another modification of the 27th embodiment (front view when viewed from the oil coating roller 150 side).

In the 10th to 26th embodiments, as shown in FIG. 54A, a length of the oil coating roller 150 is somewhat longer than the width of the surface belt layer 1133. Alternatively, it may be longer than the width of the surface belt layer 1133 but shorter than the width of the fixing belt 110, as shown in FIG. 55. When as shown in FIG. 54A, the length of the oil coating roller 150 is longer than the width of the fixing belt 110, stress caused in the fixing belt 110 may be lessened.

Where the length of the oil coating roller 150 is somewhat shorter than the width of the surface belt layer 1133 to apply the release oil to only the image forming area, the oil is unlikely to flow to the end N2 of the fixing contact portion N.

EXAMPLES

Specific examples of the embodiments will be described.

Fixing belt 110

In the 9th embodiment, the fixing belt 110 is a seam less belt. The belt base 1122 is a mesh-like member made of heat-resistance multi-filament (threads) of alamide fiber. A thickness of the belt base 1122 is bout 100 μm. Also in the case where it is made of cloth, its thickness is 100 μm.

A width of the belt base 1122 is 392 mm. Only its central portion is coated with silicone rubber so as to have a thickness of about 200 μm, whereby a surface belt layer 1132 is formed. Exposed portions 1122*b* of about 27 mm wide are formed on both sides of it.

An inside diameter of the belt base 1122 is about ϕ60 mm.

In each of other embodiments, the fixing belt 110 is a seam less belt. The belt base 1122 is an endless sheet made of conductive polyimide. A thickness of the belt base 1123 is bout 150 μm.

A width of the belt base 1122 is 392 mm. Only its central portion is coated with silicone rubber to be about 200 μm thick, whereby a surface belt layer 1133 is formed. Exposed portions 1122*b* of about 27 mm wide are formed on both sides of it.

An inside diameter of the belt base 1123 is about ϕ60 mm.

In the 14th, 20th and 21st embodiments, high grip members G are fastened to the exposing portions 1123*b*, respectively. A thickness of the high grip member G including the adhesive layer 1163 is about 300 μm.

Pressure Application Roller 120

A pipe portion 121 is extended from both ends of the pressure application roller. An elastic layer 122 of silicone rubber is layered around the outer circumferential surface of the pipe portion 121 made of iron (SUM24), about ϕ32 mm in outside diameter and ϕ22 mm inside diameter. The pipe portion includes a hollowed shaft 125 (see FIG. 16). A surface layer 122*a* of fluorine plastics is further layered on the elastic layer 122.

Rubber hardness of the elastic layer 122 is about JIS-A20°, and a thickness of it is about 1.5 mm.

The surface layer 122*a* is a fluorine latex film formed by applying fluorine latex coating there and heat-hardening it. Its thickness is about 60 μm.

About 230W at 100V is selected for the amount of heat generated by the halogen lamp 123 located in the hollowed portion.

An outside diameter of the pressure application roller 120 is about 35.2 mm.

The roller width (length in the axial direction) including the shaft portion 124 is about 444.3 mm.

Pressing load to the backup roller 130 is applied to the shaft portions 125, about 60 Kg (totally 120 Kg) for each side. In this case, the backup roller 130 and the pressure application roller 120 are fixed at predetermined positions (shaft-shaft distance is fixed), and any special pressing means is not used. The pressure application roller 120 and the backup roller 130 are fixed to the frame 101 so that the shaft-shaft distance is smaller than the sum of the outside diameters of the rollers 120 and 130, and both the rollers are compressed together. Then, the pressing load is generated. Load action points to the roller are coincident with the fixing points to the frame, and those are the positions of the bearings (not shown) of the shaft 124.

A length L2 of its press contact portion N with the fixing belt 110 is about 11 mm.

Backup roller 130

A solid roller of iron (SUM24) of about ϕ26 with a shaft portion 131*a* of about ϕ10 extended from both ends of the roller. An elastic layer 132 of silicone rubber is layered around the outer circumferential surface of the roller. A surface layer 132*a* of PFA (tetrafluoroethylene perfluoroalkoxy ethylene copolymer) is further layered on the elastic layer 132.

An outside diameter of the backup roller 130 is about 38.5 mm, and the roller width except the shaft portion 131*a* is about 398 mm.

A thickness of the elastic layer 132 is about 6.25 mm. Rubber hardness is about JIS-A10°.

The surface layer 132*a* is a thermal shrinking PFA resin tube. Its thickness after coated is about 110 μm.

Heating Roller 140

The roller includes a shaft portion 144 of about ϕ20 extended from both sides thereof. The roller is an aluminum, pipe-like roller of about ϕ28 in outside diameter and about 3 mm in thickness.

The roller width except the shaft portion 144 is about 393 mm.

The heat generating means 141, located within the hollow of the roller is a halogen lamp. About 695W at 100V is selected for the amount of heat generated by the halogen lamp.

Oil Coating Roller 150

An oil retaing layer 152 including an oil contained layer 152*a* and an oil supplying layer 152*b* and a surface layer 153 are layered, one on the other, on a shaft 151 made of iron (SUM24), about ϕ10 mm.

An outside diameter of the oil coating roller 150 is about 36 mm, the roller width exclusive of the shaft portion is about 338 to 392 mm, preferably a width wide enough to cover the paper-passing width, not reaching the high grip portions.

The oil-contained layer 152*a* is made of sponge, about 11 mm thick.

The oil supplying layer 152*b* is made of felt, about 2 mm thick.

The surface layer 153 is made of porous PTFE (tetrafluoroethylene ethylene copolymer) resin, about 120 μm.

The release oil is dimethyl silicone oil. Its viscosity (at 20°C.) is about 100 centistokes, and its total amount is about 140 g.

Contact load (pressing load) to the fixing belt 110 is within a range of about 0.5 to 2 Kg in total, preferably about 1 Kg.

A contact width (length in the belt traveling direction) between the oil coating roller 150 and the fixing belt 110 is about 3 mm.

While the present invention has been described by use of the preferred embodiments and examples, it should be understood that the invention is not limited to those described ones, but may variously be modified, altered and changed within the true spirits of the invention. For example, the present invention may also be implemented in the following ways:

(1) Those described embodiments may properly be combined (a construction of an embodiment is applied to another embodiment).

(2) In the first to sixth, 12th image forming apparatus, and the 18th, and the 21st to 33rd belt fixing devices, the oil coating mechanism is not essential.

Figure 56:
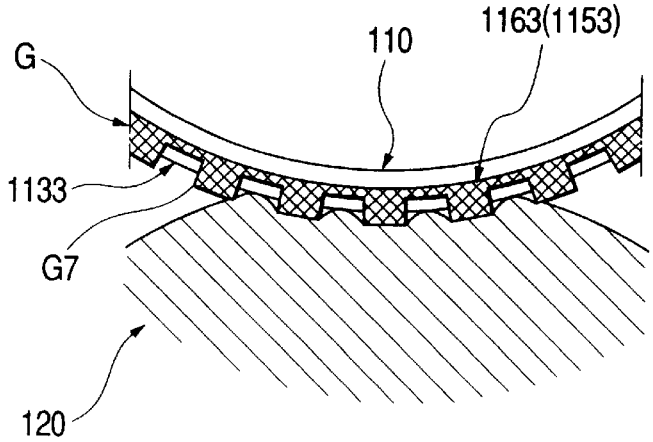
FIG. 56 is a cross sectional view showing a modification of the embodiment.
Figure 57:
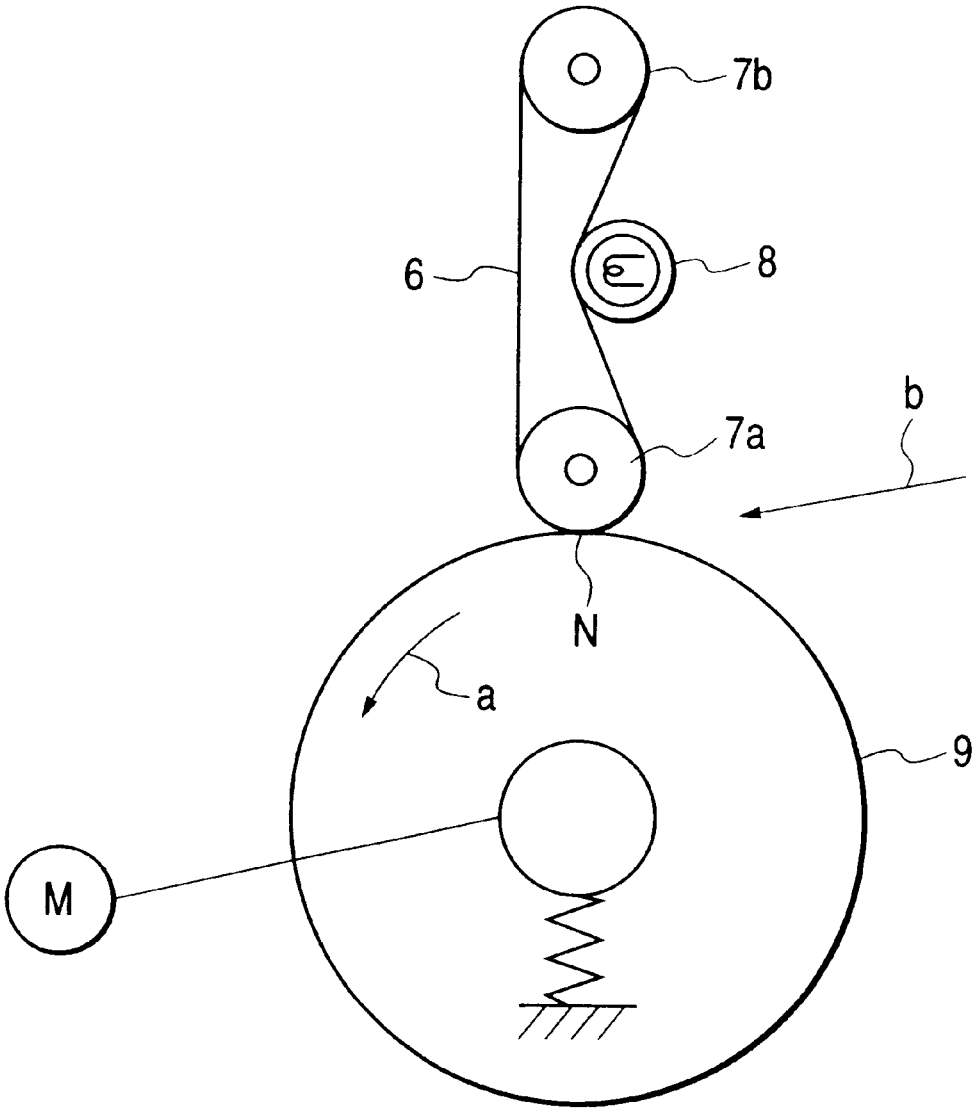
FIG. 57 is an explanatory diagram for explaing a conventional technique.
Figure 58:
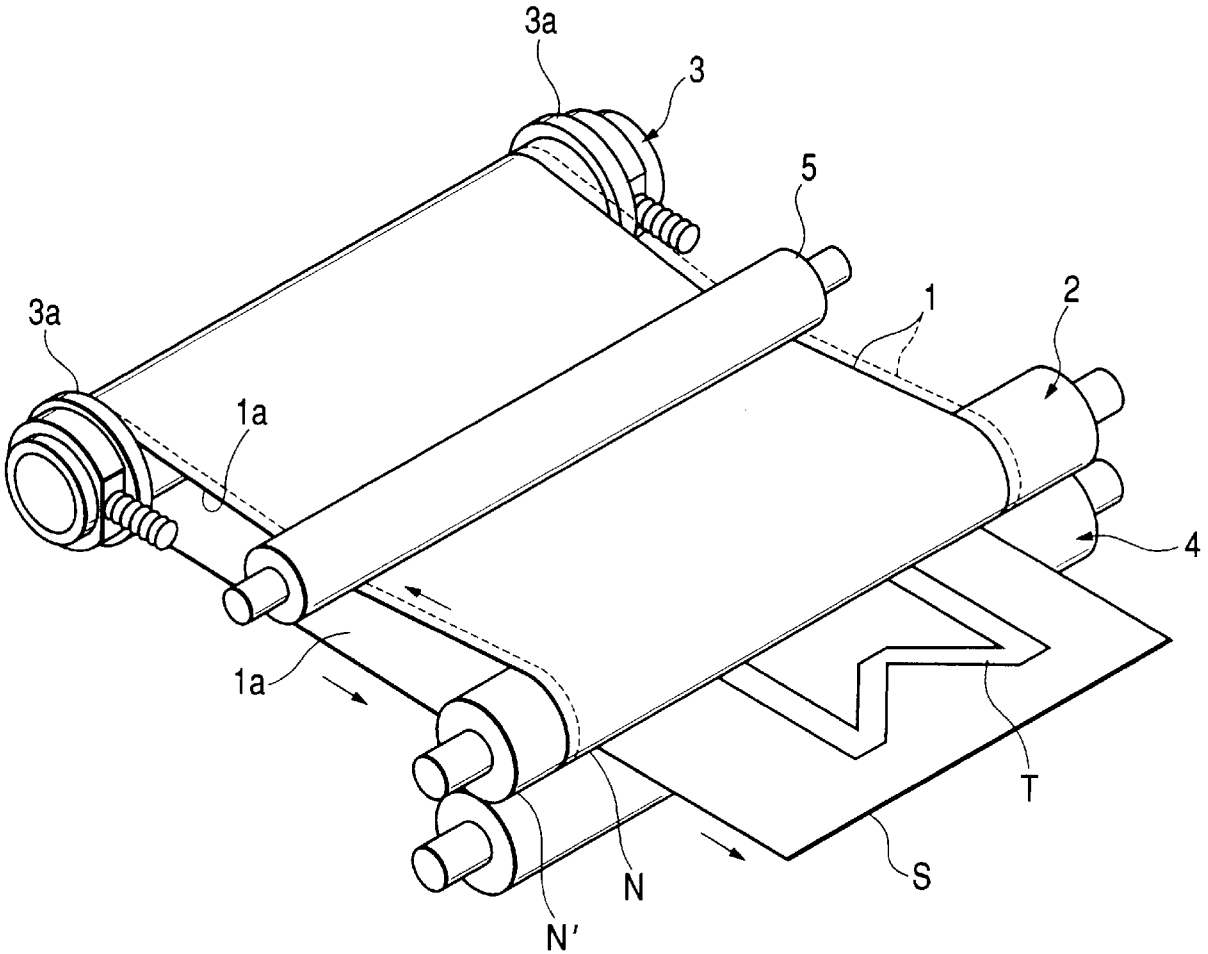
FIG. 58 is an explanatory diagram for explaing another conventional technique.

(3) In the 21st to 23th, 26th to 27th, and 30th to 33rd belt fixing devices, the high grip portion G may be formed with a number of ridges G7 extending in the width direction (perpendicular to a paper surface of the drawing of FIG. 56) may be formed on the surface of the rubber belt.

What is claimed is:

1. An image forming apparatus having a fixing device, said fixing device including:

an endless belt to be heated, and a rotary member to be in pressing contact with said endless belt, wherein one of said endless belt and said rotary member is driven while the other follows said one of said endless belt and said rotary member in rotation, and a recording medium having a toner image formed thereon is moved to pass through a part of a press contact portion in said fixing device, to thereby fuse and fix the toner image on the recording medium, wherein a high grip portion is provided at a portion of said endless belt which is not pressed by the recording medium but pressed by said rotary member.

2. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a tape-like, high grip member is fixedly wound on a side end of said fixing belt.

3. A belt fixing device in accordance with claim 2, wherein a winding start end at which winding of said tape-like, high grip member starts is not lapped on a winding terminating end at which the winding of said tape-like, high grip member terminates.

4. A belt fixing device in accordance with claim 2, wherein said winding start end of said high grip member is located adjacent to said winding terminating end in a state that each of said winding start and terminating ends is inclined.

5. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip members is provided on a side end of said fixing belt, and said high grip member is made up of an expandable endless belt having an inside diameter smaller than an outside diameter of the side end of said fixing belt when said endless belt is in a free state.

6. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member made of cloth is provided on a side end of said fixing belt to extend along a circumferential direction of said fixing belt.

7. A belt fixing device comprising:

a fixing belt to be heated, said fixing belt having an endless belt base and a surface belt layer layered over said belt base, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is provided on a side end of said fixing belt to extend along a circumferential direction of said fixing belt, and an outside diameter of said high grip member is larger than an outside diameter of said surface belt layer.

8. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is provided on a side end of said fixing belt to extend along a circumferential direction of said fixing belt, and a side edge of said high grip members is offset in the circumferential direction.

9. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is provided on a side end of said fixing belt to extend along a circumferential direction of said fixing belt, and an uneven pattern on a surface of said high grip member is slanted with respect to a width direction of said fixing belt.

10. A belt fixing device in accordance with claim 9, wherein said high grip members are respectively provided on both side ends of said fixing belt, and said uneven patterns on the surfaces of said high grip members are symmetrical to each other with respect to a widthwise central line of said fixing belt.

11. A belt fixing device comprising:

a fixing belt to be heated, a rotary member to be in pressing contact with said fixing belt, and a restricting member which comes in contact with a side end of said fixing belt to restrict such a behavior of said fixing belt as to move aside, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is fixed onto said side end of said fixing belt to come in contact with said restricting member.

12. A belt fixing device in accordance with claim 11, wherein a rigidity of said high grip member in a belt width direction is larger than a rigidity of said high grip member in a belt circumferential direction.

13. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member, having a thermal expansion coefficient substantially equal to a thermal expansion coefficient of said fixing belt, is fixed onto a side end of said fixing belt.

14. A belt fixing device comprising:

a fixing belt to be heated, and a rotary member to be in pressing contact with said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is fixed onto a side end of said fixing belt through a flexible adhesive layer.

15. A belt fixing device comprising:

a fixing belt to be heated, a rotary member to be in pressing contact with said fixing belt, and an oil coating mechanism for applying release oil to a surface of said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is provided on a side end of said fixing belt to extend along a circumferential direction of said fixing belt, and said high grip member has an oil absorption capability.

16. A belt fixing device in accordance with claim 15, wherein said high grip member has a capability of allowing the oil to flow in a belt circumferential direction.

17. A belt fixing device comprising:

a fixing belt to be heated, a rotary member to be in pressing contact with said fixing belt, and an oil coating mechanism for applying release oil to a surface of said fixing belt, wherein one of said fixing belt and said rotary member is driven while the other follows said one of said endless belt and said rotary member in rotation, and a recording medium having a toner image formed thereon is moved to pass through a central part of a press contact portion between said fixing belt and said rotary member, to thereby fuse and fix the toner image on the recording medium, wherein a high grip member is provided on a side end of said fixing belt to extend along a circumferential direction of said fixing belt, and said high grip member is made of a mixture of a high friction material and a material having an oil absorption capability.

18. A belt fixing device in accordance with any one of claims 6 to 16, wherein said high grip member is constructed by an expandable endless belt having an inside diameter smaller than an outside diameter of said side end of said fixing belt when said endless belt is in a free state.

19. A belt fixing device in accordance with any one of claims 6 to 16, wherein said high grip member is a tape-like member, and wound around and fixed to said side end of said fixing belt.

20. A belt fixing device in accordance with claim 19, wherein a winding start end of said tape-like, high grip member is not lapped on a winding terminating end thereof.

21. A belt fixing device in accordance with claim 19, wherein said winding start end of said high grip member is confronted with said winding terminating end in a state that they are slanted.

22. A belt fixing device in accordance with any one of claims 7 to 16, wherein said high grip member is constructed by cloth.

23. A belt fixing device in accordance with any one of claims 2 to 7, and 9 to 17, wherein a side edge of said high grip member is offset in a circumferential direction.

24. A belt fixing device in accordance with any one of claims 2 to 6, and 8 to 17, wherein said fixing belt has an endless belt base and a surface belt layer formed on a central portion of a surface of said belt base layer, and an outside diameter of said high grip member is larger than an outside diameter of said surface belt layer.

25. A belt fixing device in accordance with any one of claims 2 to 17, wherein a side end of said high grip member is beveled.

26. A belt fixing device in accordance with claim 25, wherein said beveled side end defines a smooth surface.

27. A belt fixing device in accordance with any one of claims 2 to 12, and 15 or 16, wherein said high grip member is made of a material having a thermal expansion coefficient substantially equal to a thermal expansion coefficient of said fixing belt.

28. A belt fixing device in accordance with any one of claims 2 to 12, and 15 or 16, wherein said high grip member is fixed through a flexible adhesive layer.

29. A belt fixing device in accordance with any one of claims 2 to 14, wherein an oil coating mechanism is provided for coating a surface of said fixing belt with release oil, and said high grip member has an oil absorbing capability.

30. A belt fixing device in accordance with claim 29, wherein said high grip member has a capability of allowing the oil to flow in a belt circumferential direction.

31. A belt fixing device in accordance with claim 29, wherein said oil coating mechanism applies said release oil to only a press contact portion of said fixing belt with said recording medium.

32. A belt fixing device in accordance with any one of claims 2 to 14, wherein an oil coating mechanism is provided for coating a surface of said fixing belt with release oil, said high grip member is permeable to said release oil, and is fixed to the side end of said fixing belt with an adhesive layer capable of absorbing the oil.

33. A belt fixing device in accordance with claim 32, wherein said oil coating mechanism applies said release oil to only a press contact portion of said fixing belt with said recording medium.

34. A belt fixing device in accordance with any one of claims 15 to 17, wherein said oil coating mechanism applies said release oil to only a press contact portion of said fixing belt with said recording medium.

35. A belt fixing device in accordance with any one of claims 2 to 17, wherein toner images may be fixed on both sides of said recording medium.

36. A belt fixing device in accordance with any one of claims 2 to 17, wherein a full color image formed by superimposing a plurality of different colors may be formed on said recording medium.

* * * * *